US008393918B2

(12) United States Patent
Cheng et al.

(10) Patent No.: US 8,393,918 B2
(45) Date of Patent: Mar. 12, 2013

(54) MINIATURIZED CONNECTORS AND METHODS

(75) Inventors: Keh-Chang Cheng, Taoyuan Hsien (TW); Pen-Yuan Tsai, Taoyuan Hsien (TW); Cheng-Jung Tsou, Taoyuan Hsien (TW)

(73) Assignee: Pulse Electronics, Inc., San Diego, CA (US)

( * ) Notice: Subject to any disclaimer, the term of this patent is extended or adjusted under 35 U.S.C. 154(b) by 0 days.

(21) Appl. No.: 12/482,371

(22) Filed: Jun. 10, 2009

(65) Prior Publication Data

US 2011/0014800 A1 Jan. 20, 2011

Related U.S. Application Data

(60) Provisional application No. 61/196,064, filed on Oct. 14, 2008, provisional application No. 61/131,817, filed on Jun. 11, 2008.

(51) Int. Cl.
*H01R 12/24* (2006.01)

(52) U.S. Cl. ..... 439/495; 439/931

(58) Field of Classification Search ..... 439/492, 439/495–497, 607.22, 607.28, 607.31, 931
See application file for complete search history.

(56) References Cited

U.S. PATENT DOCUMENTS

| | | | | | |
|---|---|---|---|---|---|
| 4,616,893 | A | | 10/1986 | Feldman | |
| 4,900,269 | A | * | 2/1990 | Lynch | 439/499 |
| 4,969,840 | A | * | 11/1990 | Ii et al. | 439/495 |
| 5,087,211 | A | | 2/1992 | Prunier et al. | |
| 5,356,308 | A | * | 10/1994 | Toba et al. | 439/495 |
| 5,501,610 | A | * | 3/1996 | Ikemoto | 439/498 |
| 6,010,359 | A | * | 1/2000 | Etters et al. | 439/496 |
| 6,086,412 | A | * | 7/2000 | Watt et al. | 439/496 |
| 6,146,190 | A | * | 11/2000 | Fuerst et al. | 439/496 |
| 6,290,540 | B1 | | 9/2001 | Nishio et al. | |
| 6,302,736 | B1 | | 10/2001 | Nishio et al. | |
| 6,371,797 | B1 | * | 4/2002 | Kikuchi et al. | 439/496 |
| 6,626,698 | B2 | * | 9/2003 | Matsumura | 439/496 |
| 6,642,827 | B1 | | 11/2003 | McWilliams | |
| 6,733,326 | B2 | * | 5/2004 | Lee | 439/495 |
| 6,749,459 | B2 | * | 6/2004 | Koch et al. | 439/496 |
| 6,942,382 | B2 | | 9/2005 | Demeocq | |
| 6,971,919 | B1 | * | 12/2005 | Huang | 439/630 |
| 7,128,597 | B2 | * | 10/2006 | Niitsu et al. | 439/495 |
| 7,155,815 | B2 | | 1/2007 | Gernhardt et al. | |
| 7,220,148 | B2 | * | 5/2007 | Zhao et al. | 439/630 |
| 7,232,334 | B2 | * | 6/2007 | Shimizu et al. | 439/496 |
| 7,358,921 | B2 | * | 4/2008 | Snyder et al. | 343/795 |
| 7,445,496 | B2 | * | 11/2008 | Kao | 439/496 |
| 7,467,970 | B2 | * | 12/2008 | Ikuta et al. | 439/496 |
| 7,540,747 | B2 | * | 6/2009 | Ice et al. | 439/79 |

* cited by examiner

*Primary Examiner* — Thanh Tam Le
(74) *Attorney, Agent, or Firm* — Gazdzinski & Associates, PC

(57) ABSTRACT

Improved miniaturized interconnect connector apparatus and methods for their manufacture. These miniaturized interconnect connectors minimize overall size, while at the same time offering acceptable and even improved electrical performance over prior art interconnect connector designs. In one exemplary embodiment, the interconnect connector comprises a plug and corresponding receptacle manufactured from a laser direct structuring (LDS) polymer material. In another embodiment, the interconnect connector comprises a composite structure which takes advantages of the properties of multiple selected materials. In yet another embodiment of the invention, precisely plated polymers such as the aforementioned LDS polymer are utilized in conjunction with known technologies such as flexible printed circuits (FPC) to produce miniaturized interconnect connectors.

15 Claims, 63 Drawing Sheets

MINIATURIZED CONNECTORS AND METHODS

PRIORITY AND RELATED APPLICATIONS

This application claims priority to co-owned and co-pending U.S. Provisional Patent Application Ser. No. 61/131,817 filed Jun. 11, 2008 of the same title, as well as co-owned and co-pending U.S. Provisional Patent Application Ser. No. 61/196,064 filed Oct. 14, 2008 of the same title, the contents of each which are incorporated by reference herein in their entirety.

COPYRIGHT

A portion of the disclosure of this patent document contains material that is subject to copyright protection. The copyright owner has no objection to the facsimile reproduction by anyone of the patent document or the patent disclosure, as it appears in the Patent and Trademark Office patent files or records, but otherwise reserves all copyright rights whatsoever.

BACKGROUND OF THE INVENTION

1. Field of Invention

The present invention relates generally to electronic elements, and particularly in one exemplary aspect to an improved design and method of manufacturing miniature electronic connectors.

2. Description of Related Technology

Connectors, such as for example those that interconnect two electrical circuits (hereinafter referred to generally as an "interconnect connector") are well known in the electronics industry. Such connectors are adapted to receive one or more electrical signals from a first circuit, and communicate those signals (whether over a short or long distance) to a second circuit. So-called printed circuit board interconnect connectors typically interface two or more printed circuit board substrates together or otherwise connect an electronic device with a printed circuit board. For example, Teledyne Interconnect Devices Clip-On LCD Connector for LCD Displays is an interconnect connector which connects an LCD display with a printed circuit board substrate.

Many different considerations are involved with producing an effective and economically viable interconnect connector design. Such considerations include, for example: (i) volume and "footprint" available for the connector; (ii) the cost and complexity associated with assembling and manufacturing the connector; (iii) the ability to accommodate various electrical components and signal conditioning configurations; (iv) the electrical and noise performance of the device; (v) the reliability of the device; (vi) the ability to modify the design to accommodate complementary technologies; (vii) compatibility with existing terminal and "pin out" standards and applications; and (viii) the potential for maintenance or replacement of defective components.

Of particular concern is the miniaturization of electronic devices as technologies converge, and more and more functionality is expected out of a user device. For example, devices such as the now ubiquitous Apple iPhone™ have converged a variety of wireless technologies (i.e. Bluetooth™, Wi-Fi, Quad band GSM, and GPRS/EDGE), along with a built-in camera and touch screen with a virtual keyboard, into a small handheld device. With the increasing number of features expected to be filled by a portable device, interconnect connectors are expected to decrease in size as well so as to permit the ability for electronic devices to become more "feature rich" without making them larger.

Many prior art interconnect connectors and their associated manufacturing processes have sought to provide a miniaturized design. However, despite the foregoing variety of design configurations and manufacturing techniques, such prior art interconnect manufacturing processes are currently approaching their design limitations in terms of, inter alia, size and material properties. For example, in the context of interconnect connectors which utilize post-insertion techniques for their manufacture, the size of the terminal pins utilized in these connectors are becoming increasing fragile and susceptible to damage during product manufacture. For interconnect connectors which utilize well known insert-molding techniques, the thickness of the polymer base material between conductive pins is reaching its theoretical limitations, thereby potentially leaving voids in the header during the injection molding process.

In addition to interconnect connector miniaturization, interconnect connectors are increasingly being used in data networking applications, whether for computers or other electronic devices (such as routers, gateways, hubs, switching centers, digital set-top boxes, mobile handsets, etc.) which demand ever-increasing data rates. Increased data rate requirements, such as those mandated under connection technologies such as "PCI Express", "InfiniBand", "Serial SCSI", "Express Card", "IEEE 1394", "Display Port", and "Back plane" are expected to boost transmission speeds past 10 Gbps and beyond. Unfortunately, increased interconnect connector miniaturization coupled with increasing data rate requirements means that the parasitics associated with these interconnect connector designs will become increasingly problematic for electronic designers.

Accordingly, improved miniaturized interconnect connector apparatus and methods of manufacture are needed which address these issues, i.e.: (1) connector miniaturization; (2) increased data transmission speeds; and (3) cost. Such improved apparatus would decrease the size of the connector by minimizing spacing ("pitch") between terminal pins, while at the same time offering improved electrical performance at high data transmission speeds. Ideally, such improved apparatus and methods would provide precise control of the interconnect connector dimensions so as to provide consistent electrical performance amongst and between devices, and also be able to be produced in a cost-effective manner.

SUMMARY OF THE INVENTION

The foregoing needs are satisfied by the present invention, which provides improved inductive apparatus and methods for manufacturing the same.

In a first aspect of the invention, a connector is disclosed. In one embodiment, the connector is miniaturized and comprises: a polymer receptacle comprising a plurality of electrical receptacle contact portions, said receptacle contact portions disposed directly on said polymer receptacle; and a polymer plug comprising a plurality of electrical plug contact portions, said plug contact portions disposed directly on said polymer plug.

In another embodiment, both the receptacle and plug contact portions comprise a plurality of differential transmission connections. In one variant, these differential transmission connections are electrically isolated from one another via internally shielded cavities. In yet another variant, the receptacle and/or plug contact portions of the connector comprise a composite construction thereby enhancing a physical characteristic of the connector. In yet another variant, the receptacle contact portion construction differs from the plug contact portion construction thereby resulting in a composite connector construction.

In yet another embodiment, a connector comprising one or more contacts, a base housing, one or more hold-down elements and one or more fasteners is disclosed. In one variant, the contacts comprise stamped and formed contacts. In yet another variant, one or more surfaces of the aforementioned housing and/or fastener(s) is plated utilizing an exemplary LDS manufacturing process.

In yet another embodiment, connectors used for flexible printed circuit boards (FPC) are disclosed. In one variant, these connectors comprise a plug portion, a flex circuit and a latch portion that secures the flex circuit to the plug portion. In yet another variant, the plug portion is manufactured utilizing exemplary LDS technology.

In yet another embodiment, the FPC is encased in an Electromagnetic Interference (EMI) shield. In one variant, the EMI shield comprises a metallic foil substantially encasing the FPC. In another variant, at least a portion of the EMI shield is overlapped so as to ensure that there are no gaps in the EMI shield. In yet another variant, a ferrite material is disposed at least partly about the FPC to shield signal paths on the FPC from EMI.

In a further variant, the latch portion may be further adapted to include one or more grounding mechanisms for grounding to the EMI shield. An integrated metallic grounding insert may also utilized in the plug portion and adapted to mechanically interface with the latch portion.

In another embodiment, the plug portion further comprises an integrated ferrite core; the ferrite core further dissipates high frequency noise.

In a second aspect of the invention, methods of manufacturing the aforementioned connector are disclosed. In one embodiment, the connector is miniaturized and the method comprises: injection molding a polymer receptacle and a plug; activating a plurality of areas on each of said receptacle and plug; and plating said plurality of areas to form a plurality of electrical contacts thereby forming a miniaturized interconnect connector.

In one variant, the receptacle and plug are fabricated at least in part using a laser direct structure (LDS) material.

In a third aspect of the invention, a method of using the aforementioned connector is disclosed. In one embodiment, the method comprises plugging a first portion of a connector assembly into a second receptacle portion of the connector assembly. In another embodiment, the method further comprises disposing the first portion on a first electronic circuit and disposing the second portion on a second electronic circuit.

In a fourth aspect of the invention, a connector assembly is disclosed. In one embodiment, the assembly is manufactured by the method comprising: injection molding a polymer receptacle and a plug; activating a plurality of areas on each of said receptacle and plug; and plating said plurality of areas to form a plurality of electrical contacts thereby forming a miniaturized interconnect connector. In one variant, the receptacle and plug are fabricated at least in part using a laser direct structure (LDS) material.

In a fifth aspect of the invention, a connector receptacle that has been manufactured using an LDS process is disclosed.

In a sixth aspect of the invention, a connector plug that has been manufactured using an LDS process, and which is complementary to the aforementioned receptacle, is disclosed.

In a seventh aspect of the invention, business methods utilizing the aforementioned apparatus and methods of manufacture are disclosed. In one embodiment, the business method comprises providing a miniaturized interconnect connector for an assembly, and obviating the necessity for one or more signal conditioning components on an external substrate of the assembly, thereby reducing the overall assembly cost.

In another embodiment, the business method comprises reducing the costs associated with manufacturing a connector by utilizing a free form contact placing technique, where the free form contact placing technique obviates the necessity for contact manufacturing tooling.

BRIEF DESCRIPTION OF THE DRAWINGS

The features, objectives, and advantages of the invention will become more apparent from the detailed description set forth below when taken in conjunction with the drawings, wherein:

FIG. 1I is a detailed perspective view of the conductors from the receptacle portion of the interconnect connector shown in FIG. 1H.

DETAILED DESCRIPTION OF THE INVENTION

Figure 1:
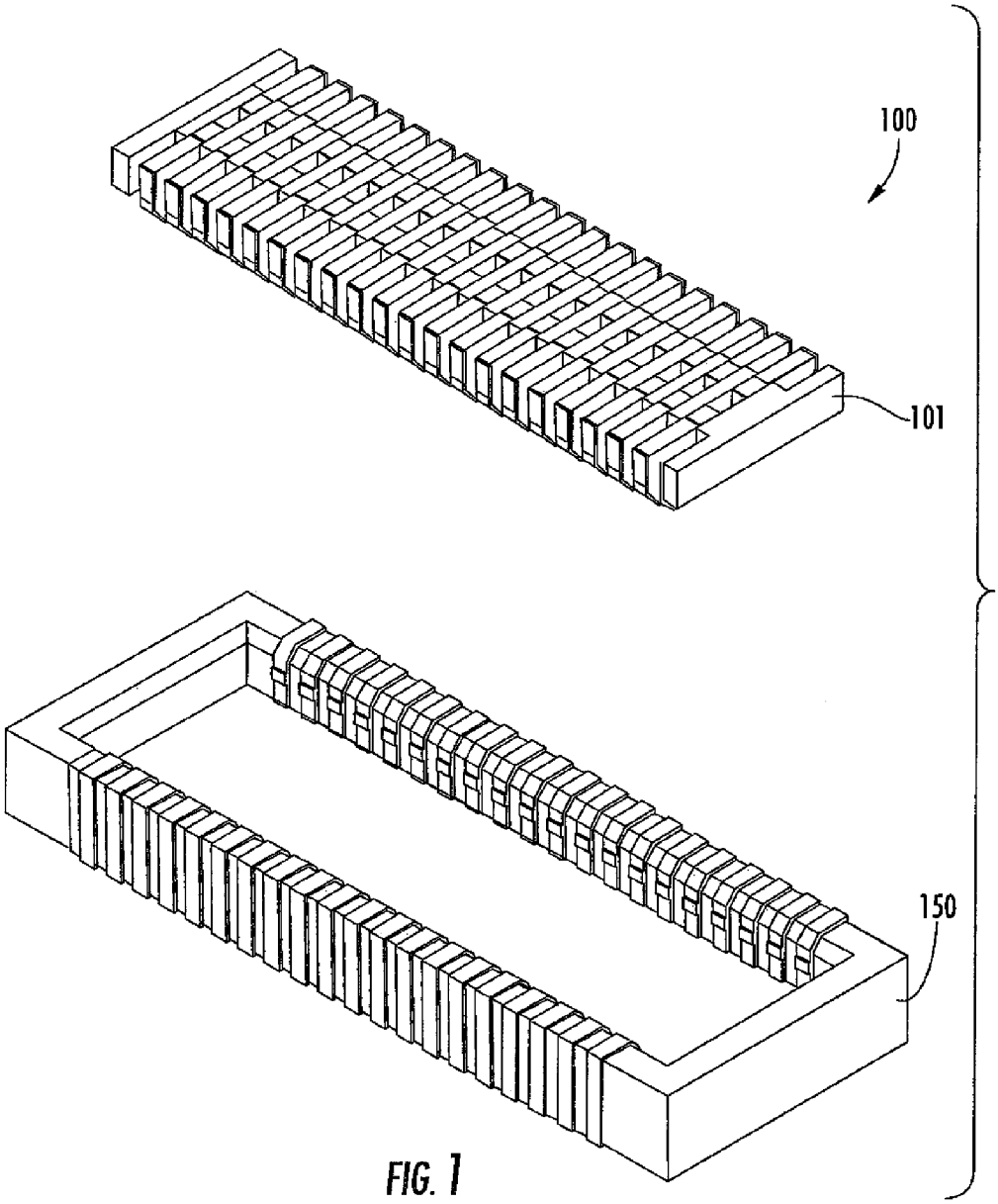
FIG. 1 is a perspective exploded view of a first exemplary interconnect connector manufactured in accordance with the principles of the present invention.

Reference is now made to the drawings wherein like numerals refer to like parts throughout.

It is noted that while the following description is cast primarily in terms of board-to-board interconnect connectors of the type well known in the art, the present invention may be used in conjunction with any number of different connector applications, such as for example those of the RJ-type which connect circuitry over a twisted pair cable. Accordingly, the following discussion of interconnect connectors is merely exemplary of the broader concepts.

As used herein, the terms "client device", "user device" and "UE" include, but are not limited to cellular telephones, smartphones, personal computers (PCs), and minicomputers, whether desktop, laptop, or otherwise, as well as other mobile or non-mobile devices such as handheld computers, PDAs, video cameras, set-top boxes, personal media devices (PMDs), such as for example an MP3 music player, or any combinations of the foregoing.

As used herein, the terms "electrical component" and "electronic component" are used interchangeably and refer to components adapted to provide some electrical function, including without limitation inductive reactors ("choke coils"), transformers, filters, gapped core toroids, inductors, capacitors, resistors, operational amplifiers, and diodes, whether discrete components or integrated circuits, whether alone or in combination. For example, the improved toroidal device disclosed in Assignee's co-pending U.S. patent application Ser. No. 09/661,628 entitled "Advanced Electronic Microminiature Coil and Method of Manufacturing" filed Sep. 13, 2000, which is incorporated herein by reference in its entirety, may be used in conjunction with the invention disclosed herein.

As used herein, the term "integrated circuit (IC)" refers to any type of device having any level of integration (including without limitation ULSI, VLSI, and LSI) and irrespective of process or base materials (including, without limitation Si, SiGe, CMOS and GaAs). ICs may include, for example, memory devices (e.g., DRAM, SRAM, DDRAM, EEPROM/Flash, and ROM), digital processors, SoC devices, FPGAs, ASICs, ADCs, DACs, transceivers, memory controllers, and other devices, as well as any combinations thereof.

As used herein, the term "memory" includes any type of integrated circuit or other storage device adapted for storing digital data including, without limitation, ROM. PROM, EEPROM, DRAM, SDRAM, DDR/2 SDRAM, EDO/FPMS, RLDRAM, SRAM, "flash" memory (e.g., NAND/NOR), and PSRAM.

As used herein, the terms "microprocessor" and "digital processor" are meant generally to include all types of digital processing devices including, without limitation, digital signal processors (DSPs), reduced instruction set computers (RISC), general-purpose (CISC) processors, microprocessors, gate arrays (e.g., FPGAs), PLDs, reconfigurable compute fabrics (RCFs), array processors, secure microprocessors, and application-specific integrated circuits (ASICs). Such digital processors may be contained on a single unitary IC die, or distributed across multiple components.

As used herein, the terms "network" and "bearer network" refer generally to any type of data, telecommunications or other network including, without limitation, data networks (including MANs, PANs, WANs, LANs, WLANs, micronets, piconets, internets, and intranets), hybrid fiber coax (HFC) networks, satellite networks, cellular networks, and telco networks. Such networks or portions thereof may utilize any one or more different topologies (e.g., ring, bus, star, loop, etc.), transmission media (e.g., wired/RF cable, RF wireless, millimeter wave, optical, etc.) and/or communications or networking protocols (e.g., SONET, DOCSIS, IEEE Std. 802.3, 802.11, 802.16, 802.20, ATM, X.25, Frame Relay, 3GPP, 3GPP2, WAP, SIP, UDP, FTP, RTP/RTCP, H.323, etc.).

As used herein, the term "signal conditioning" or "conditioning" shall be understood to include, but not be limited to signal voltage transformation, filtering, current limiting, sampling, processing, and time delay.

Overview

In one salient aspect, the present invention provides an improved miniaturized interconnect connector that minimizes overall size, while at the same time offering acceptable and even improved electrical performance as compared to prior art interconnect connector designs. In one exemplary embodiment, the interconnect connector comprises a plug and corresponding receptacle manufactured from a laser direct structuring (LDS) polymer material. The polymer can then be activated by a freely moving laser which can precisely position areas on the connector components that are desired to be plated at a later stage. The subsequent activated components are then plated to produce the final interconnect connector components. In yet another exemplary embodiment, an interconnect connector and a corresponding support structure are also disclosed.

In another aspect, the interconnect connector comprises a composite structure which takes advantages of the properties of multiple selected materials. For example, in one embodiment, the composite structure can comprise an LDS polymer over molded onto a metallic material (such as a copper alloy) that gives the underlying LDS interconnect connector increased flexibility over a homogenous construction. Alternatively, in another exemplary embodiment, the composite structure could be utilized to minimize costs by e.g. substituting cheaper materials or combining cheaper materials with the aforementioned more expensive LDS polymer.

In another embodiment, the interconnect connector comprises an LDS polymer plug and receptacle. The interconnect connector itself includes contacts for both transmitting signals between the plug and receptacle portions as well as contacts for grounding to ensure the same ground potential of both the plug and the receptacle. In addition, shielding is provided around the periphery of the receptacle portion so as to isolate the signal paths themselves within the interconnect connector. In another exemplary configuration, the signal paths comprise differential transmission pairs which are isolated from one another via shielding layers deposited between adjacent differential transmission pairs. In yet another exemplary configuration, the contacts within the receptacle portion of the interconnect connector comprise a composite structure incorporating a metal to increase the elasticity of the beam.

In yet another aspect of the invention, an exemplary board-to-board interconnect is illustrated comprising a polymer base, a plurality of contacts, fasteners for securing the contacts to the polymer base and hold down guides disposed at opposing ends of the polymer base.

In yet a further aspect of the invention, the use of precisely plated polymers, such as the aforementioned LDS polymer, can be utilized in conjunction with known technologies such as flexible printed circuits (FPC) to produce miniaturized interconnect connectors.

In addition to the aforementioned properties, the use of precise plating techniques such as LDS also allows for the direct placement of signal conditioning compensation circuitry directly within the signal paths themselves thereby improving electrical performance characteristics (such as e.g. return loss) in the miniaturized interconnect connector with minimal or no added cost to the underlying design.

Exemplary Apparatus—

It will be recognized that while the following discussion is cast primarily in terms of exemplary interconnect connectors manufactured using laser direct structuring (LDS) techniques, aspects of the invention are equally applicable to other manufacturing processes discussed subsequently herein or other manufacturing processes otherwise known in the electronic arts. For example, a number of embodiments discussed herein could readily be adapted for other processing techniques such as screen printing, inkjet printing, etc., by one of ordinary skill given the present disclosure. Accordingly, the following discussion of interconnect connectors is merely illustrative of the broader concepts.

LDS is a process whereby an otherwise insulative base material is subjected to manufacturing steps which allow the insulative base material to be plated with a conductive material. A typical product is manufactured as follows: Typically, the base of the underlying part is created using standard injection molding processes. The polymers used can vary according to any number of different design considerations such as physical characteristics like strength, and resistance to heat. Typical polymers might include a nylon based material or a liquid crystal polymer (LCP) of the type well known in the electronic arts. The underlying polymer is blended with a metal-organic complex often containing iron particles. The blended polymer is molded into any number of shapes and the molded part is then exposed to a laser process. The blended polymer is activated with a laser beam (i.e., coherent light), which exposes the organic complex in the doped plastic. The exposed metal atoms then can act as a "nucleus" layer for a subsequent electro-less plating processes.

The laser activation process in LDS is typically performed by a diode-pumped infrared (IR) laser with a wavelength of 1,064 nm operating at a pulse repetition rate between 1 kHz and 100 kHz with a minimum beam diameter of forty (40) microns. Currently, LDS can create traces as small as 100 microns with a 150-micron gap, thereby providing improved resolution over other prior art techniques which require a photo-resist or other techniques for providing a conductive layer on top of an insulating layer. It will be appreciated however that the present invention is in no way limited to such dimensions.

Accordingly, electrical contacts which take advantage of the aforementioned processing limitations of LDS can provide highly miniaturized size and spacing for connector contacts, such as those described subsequently herein. Copper is typically used to create tracks and paths for the circuit structure during the electro-less plating process and subsequent plating steps, in many cases nickel and gold, both of which have excellent resistance to oxidation are also added for a more robust surface finish. However, other suitable materials may be used for these purposes as well, such as for example alloys of the foregoing.

Dual Interconnect Connector Embodiments—

Referring now to FIG. 1, a first exemplary miniature interconnect connector 100 is illustrated. The interconnect connector 100 shown comprises a receptacle portion 150 and a plug portion 101 of a plug-receptacle pair. In one exemplary embodiment, the receptacle 150 and plug 101 portions comprise an LDS polymer base material having a generally rectangular shape. Within the cavity is a plurality of plated contacts (discussed in further detail below), preferably made from the aforementioned LDS processing techniques discussed above.

The interconnect connector 100 illustrated in FIG. 1 possesses many advantages over prior art stamped and plated post or insert-molded interconnects. The interconnect connector 100 of FIG. 1 is lower in cost due to the obviation of the copper contacts themselves. Moreover, tooling costs are substantially reduced, as the necessity for the stamping dies and contact insertion machines (in the case of post-inserted interconnects) is eliminated. Typical costs for prior art tooling for a post-insert molded interconnect can run in the neighborhood of $800K USD or more, depending on the complexity of the tooling.

Another advantage of the interconnect connector of FIG. 1 also relates to flexibility of design and reduced lead time; i.e., the fact that tooling is obviated by use of the LDS process. Specifically, because LDS is a programmable process, the interconnect connector 100 design is flexible in design and can be produced without the necessity for long lead times in producing the stamping and contact insertion equipment. By reducing and/or eliminating such long lead times associated with prior art manufacturing techniques, custom products (e.g., based on user or customer-supplied specifications or requirements) can be brought to market much faster than previously was available to designers of these connectors.

In addition to cost and time-to-market considerations, the interconnect connector illustrated in FIG. 1 further has the advantage of high precision—as detailed above with regards to the exemplary LDS processing techniques. Specifically, the contacts can be manufactured with extreme precision, thereby providing a high degree of consistency and repeatability between contacts. In addition, the contacts may be constructed with various shapes or designs that are cost-prohibitive, and/or not technologically suitable, for traditional processing techniques such as stamping (e.g., tapers, bends, cutouts, unusual shapes, etc.). Accordingly, the interconnect connector of FIG. 1 can be designed to provide a matched impedance for the circuit to which the interconnect receptacle is attached. Accordingly, the interconnect connector of FIG. 1 provides for the possibility of smooth impedance transition resulting in improved return loss characteristics over prior art interconnects.

In one exemplary embodiment, the pitch between adjacent contacts is a mere 0.3 mm (about (0.012 in.) from contact-to-contact. The overall height of the receptacle 150 is 0.8 mm (about 0.0315 in.). However, it is appreciated that other dimensions and spacing between contacts may be utilized consistent with the principles of the present invention, with the limitations only be driven by the aforementioned LDS process and electrical performance requirements as previously described above.

While providing impedance matched contacts is desirable, it is recognized that in certain situations where the design is constrained (due to size and/or spacing considerations, e.g. hi-pot, etc., for the contacts), additional compensation may be desirable. As the interconnect connector of FIG. 1 comprises an LDS polymer base material, it is further possible to include discrete electronic components within the LDS polymer itself. These electronic components may be embedded during the injection molding process, or alternatively may be post-inserted or otherwise secured to the polymer base material itself such as via an adhesive or other securing means.

An exemplary application for the interconnect connector 100 shown in FIG. 1 is the interconnection of printed circuit boards ("PCBs"). While applications for the aforementioned interconnect connector apparatus are diverse, the following figures will primarily discussed in the context of this exemplary PCB-to-PCB interconnect application, the invention in no way being limited thereto.

Figure 1A:
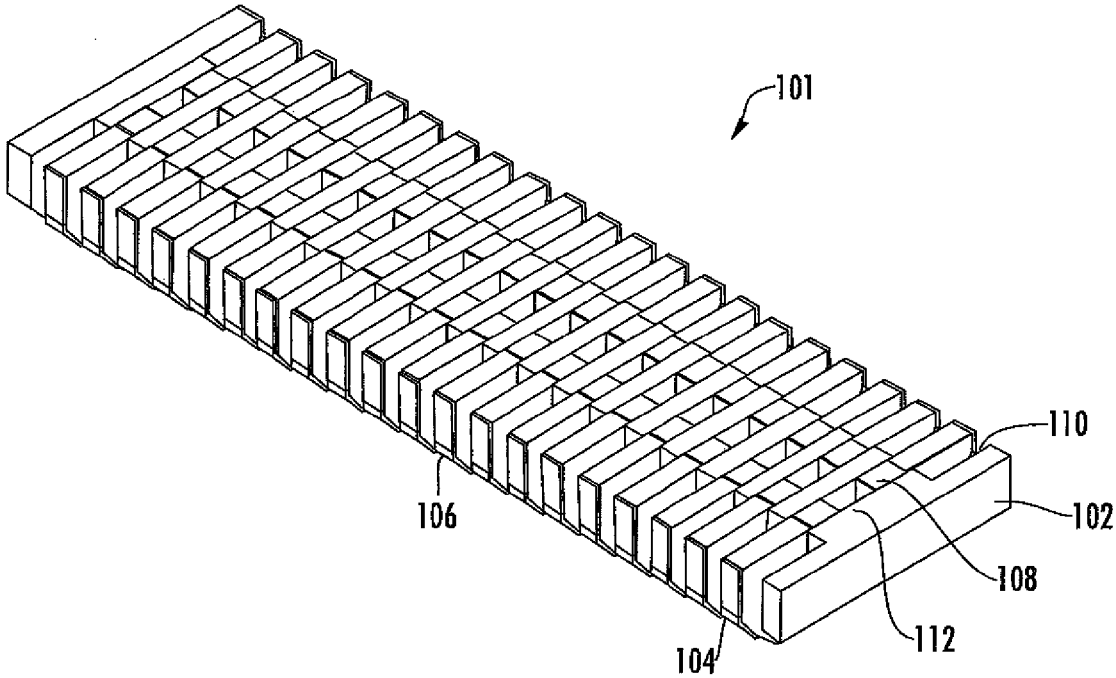
FIG. 1A is a perspective view of the plug portion of the interconnect connector of FIG. 1.

Referring now to FIG. 1A, the plug portion 101 of the interconnect connector shown in FIG. 1 is shown and described in detail. In the exemplary embodiment shown, the plug portion comprises a body portion 102 and a contact portion 104. As mentioned previously, the exemplary plug portion is molded from an LDS polymer. The body portion 102 comprises a generally rectangular shape with a plurality of apertures 110, 112 formed therein. These apertures 110, 112 advantageously provide, inter alia, isolation between adjacent contacts 104; i.e., between the receptacle contact portion 106 and PCB contact portion 108, respectively. In addition to providing isolation, the apertures 110, 112 provide rigidity and other mechanical advantages.

Figure 1B:
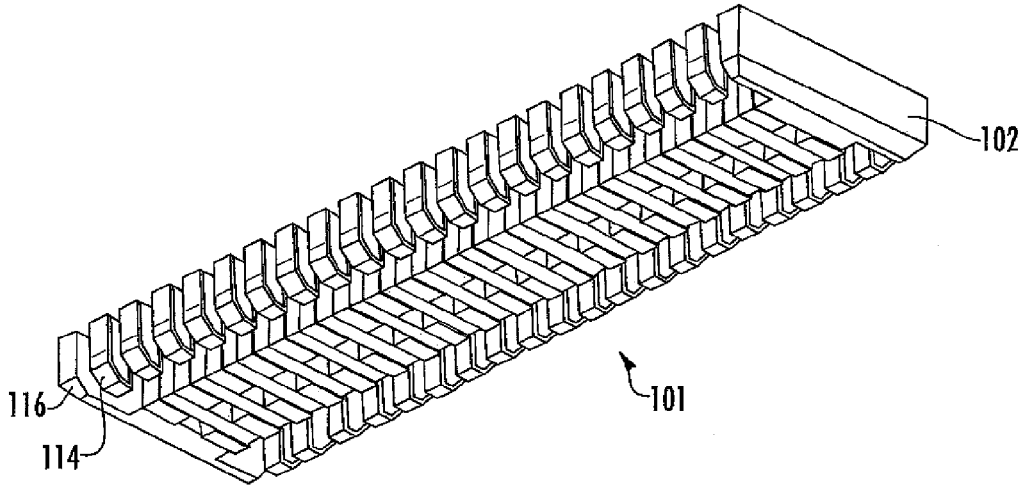
FIG. 1B is a perspective view of the underside of the plug portion of the interconnect connector of FIG. 1A.

FIG. 1B illustrates the underside of the plug portion 101 of the interconnect connector. As can be seen from FIG. 1B, the body portion 102 comprises a chamfered portion 116 which facilitates the insertion of the plug portion 101. In addition, the contact portion also includes a chamfered portion 114.

Figure 1C:
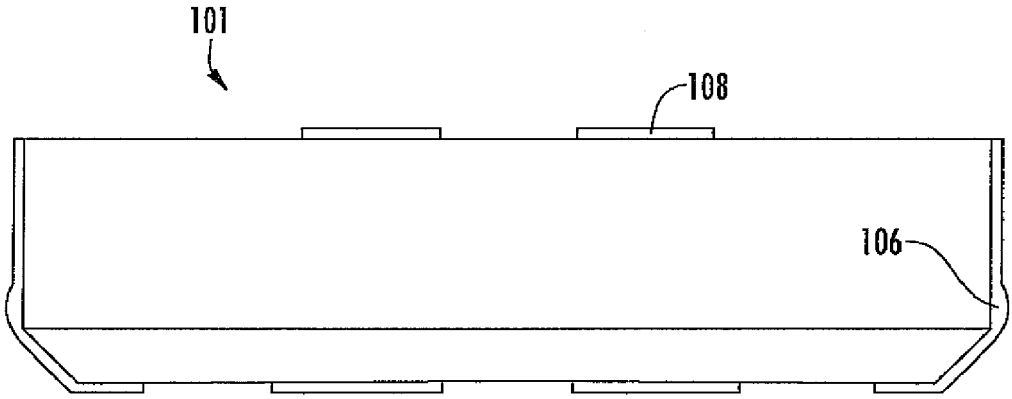
FIG. 1C is a side view of the plug portion of the interconnect connector of FIG. 1A.

FIG. 1C illustrates the contact portions 108, 106 from a different perspective. Specifically, as can be seen, the PCB contact portion 108 is disposed slightly above the top surface of the body portion 102 of the plug 101. The receptacle contact portion 106 also advantageously protrudes out as a "bump", so as to provide improved normal force contact between the plug 101 and receptacle 150 portions of the interconnect connector 100.

Figure 1D:
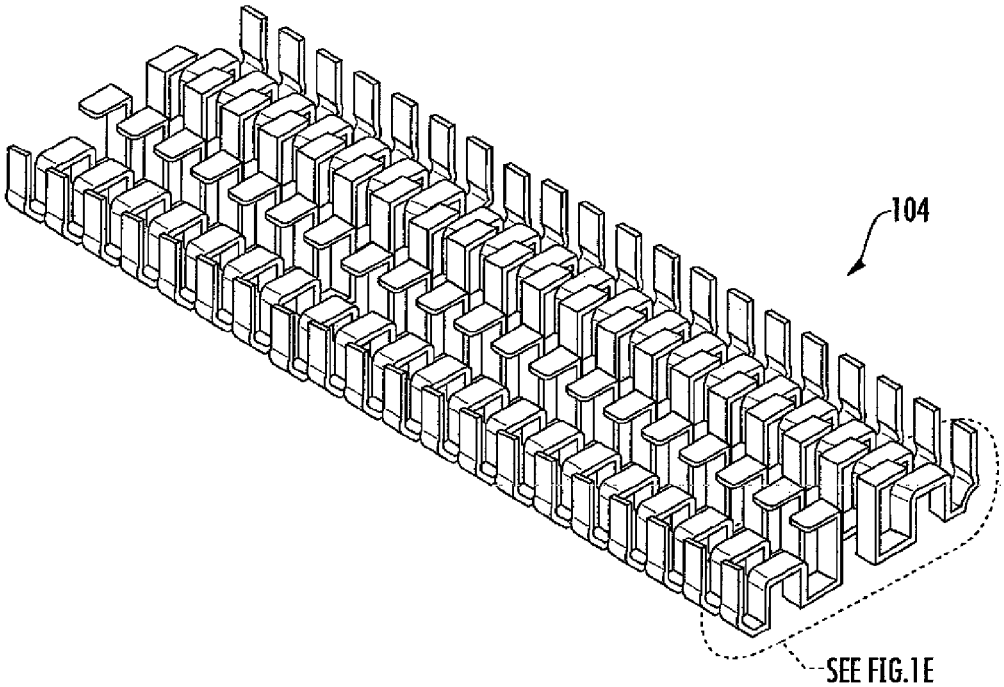
FIG. 1D is a perspective view of the conductors of the plug portion of the interconnect connector of FIG. 1A.
Figure 1E:
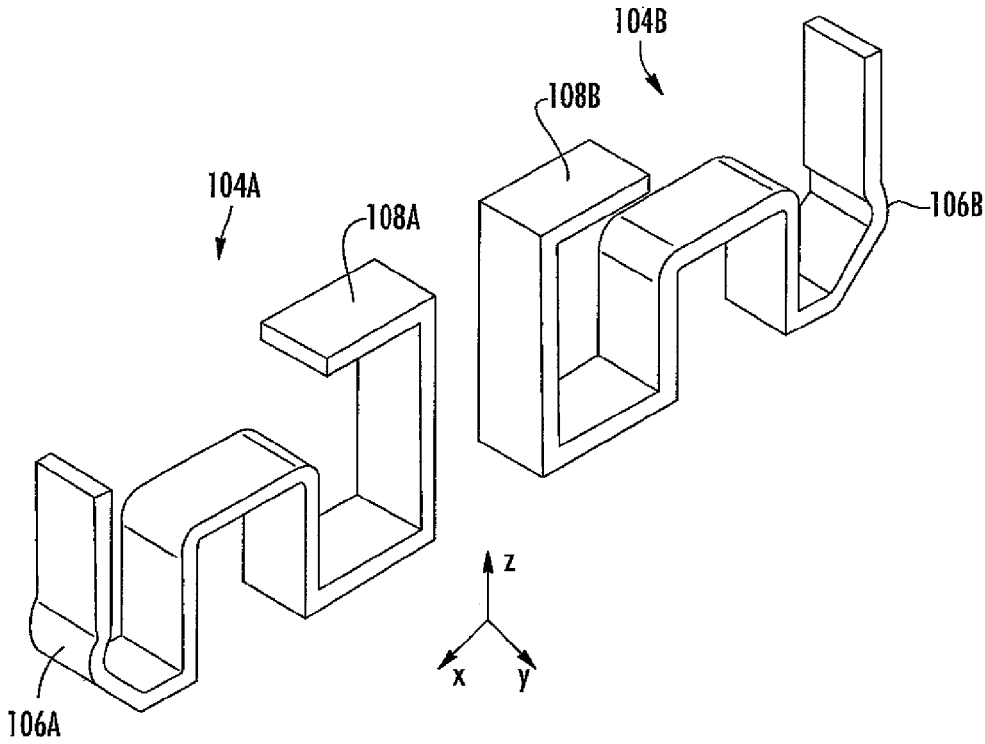
FIG. 1E is a detailed view of the conductors illustrated in FIG. 1D.

Referring now to FIG. 1D, the contact portions 104 of the plug portion of the interconnect connector with the body 102 removed are shown and described in detail. In the context of the aforementioned LDS technique discussed previously herein, the body portion 102 would not be able to be separated from the contact portion (as illustrated); accordingly, the contact portions 104 illustrated in FIG. 1D are merely for illustration of the geometry of the contacts. As perhaps is best seen in FIG. 1E, the contact portions comprise left 104A and right 104B contact portions. Each of these contacts comprises a PCB contacting portion 108 and a receptacle contacting portion 106 as discussed previously above. Also noteworthy is the generally "serpentine" shape that the contact portions take. This serpentine shape generally mimics the profile of the underlying polymer body (FIG. 1A, 102). As previously discussed, the length and dimensions of the contacts 104 can be designed so as to achieve a desired electrical performance. This desired electrical performance may comprise a matched impedance (i.e., with the underlying circuit to which the interconnect connector is attached), or other electrical and/or signal conditioning parameter as desired. In addition to accomplishing a desired electrical performance characteristic, the serpentine shape also advantageously serves a mechanical function. That is, when the contact 104 is compressed along the x-axis (as would be the case when the plug portion is inserted into the receptacle portion), the serpentine shape acts in effect as a spring, thereby inducing an improved mechanical normal force on the side wall of the receptacle portion of the interconnect connector (see FIG. 1F).

Figure 1F:
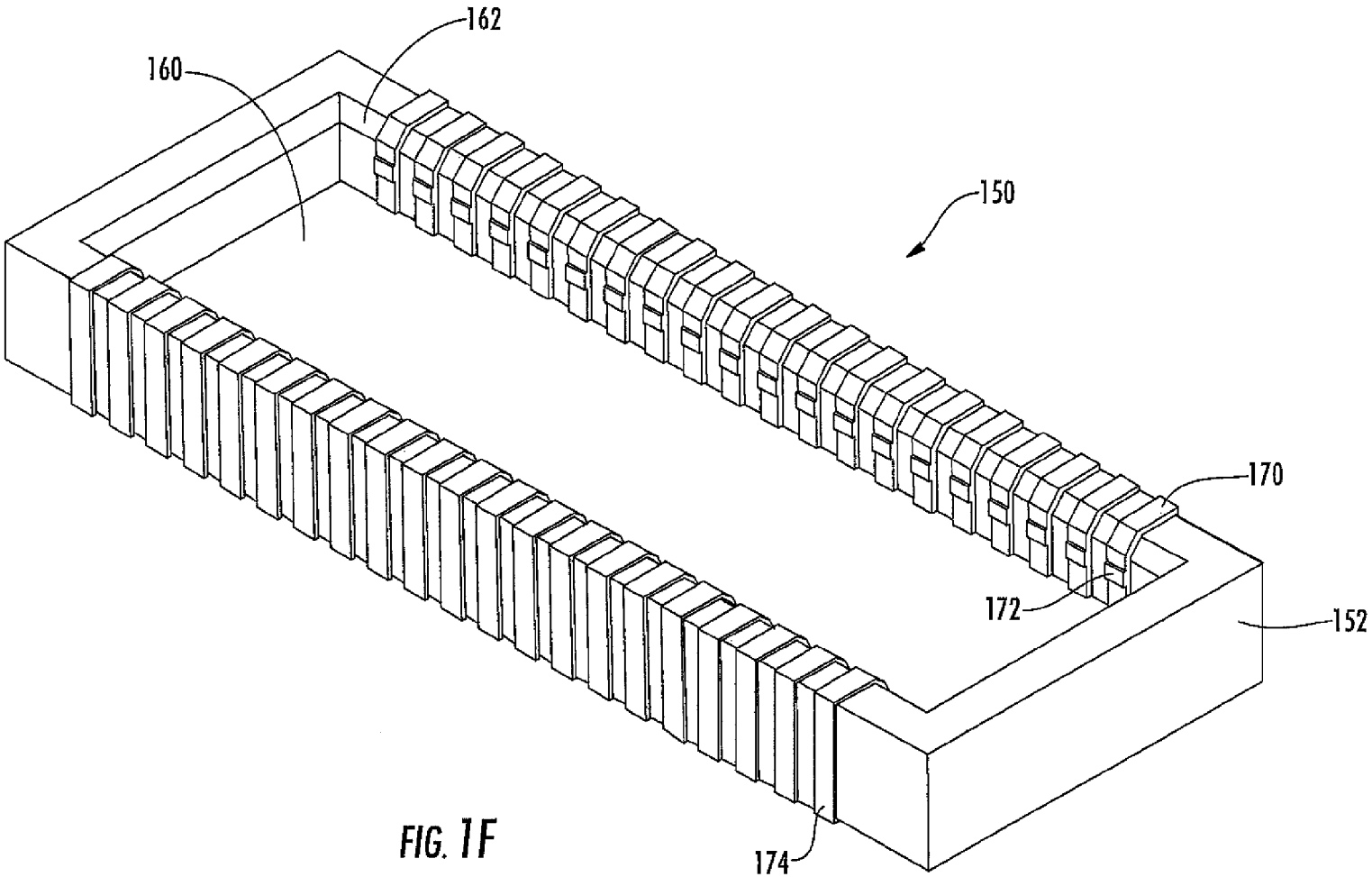
FIG. 1F is a perspective view of the receptacle portion of the interconnect connector of FIG. 1.

Referring now to FIG. 1F, the receptacle portion 150 of the exemplary interconnect connector of FIG. 1 is shown and described in detail. The receptacle portion, similar to the plug portion previously described above, is preferably formed from an LDS polymer material. The receptacle portion generally comprises a polymer base 152 that is generally rectangular in shape (although other shapes are likewise possible as well). Further, the receptacle portion further comprises a cavity 160 generally adapted so as to receive the plug portion of the interconnect connector. This cavity 160 comprises a chamfered inlet 162 so as to facilitate the insertion of the plug (FIG. 1A) into the cavity. Along the sidewalls of the polymer base 152 are disposed a plurality of electrical conductors 170. These conductors are preferably formed using the above-mentioned LDS techniques (although other approaches may be used), and further comprise a plug engaging portion 174 and a wrap-around portion 174.

Figure 1G:
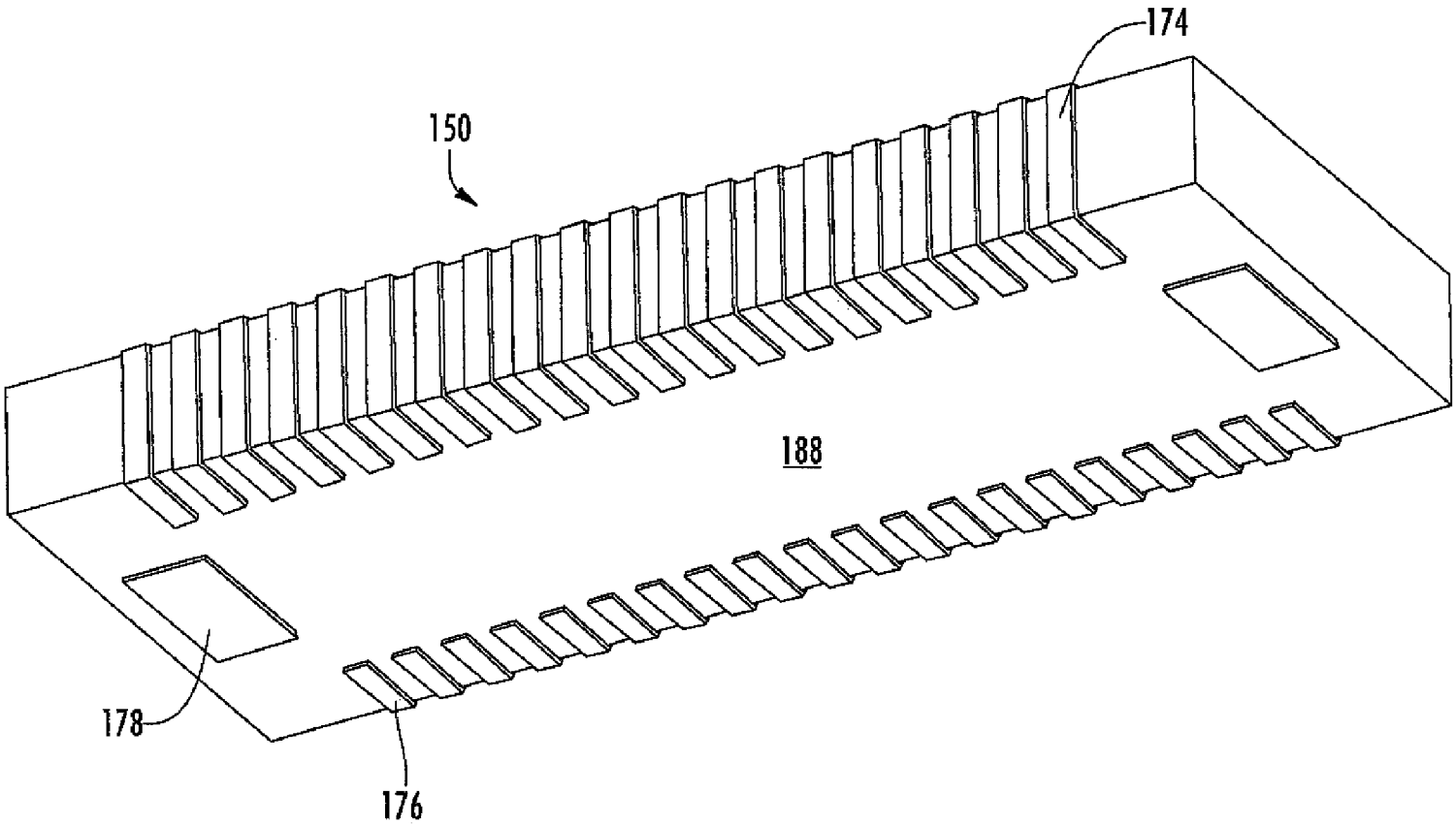
FIG. 1G is a perspective view of the underside of the receptacle portion of the interconnect connector shown in FIG. 1F.

As can be seen in FIG. 1G, the wrap-around portion 174 is coupled to a substrate engaging pad 176 located on the bottom of the receptacle 150. In addition, the bottom surface 188 of the receptacle 150 comprises contact pads 178 which have a larger plated surface area, and are adapted to secure the receptacle to an external substrate. In an alternative embodiment, these bottom contact pads 178 can be substituted with a post or other means readily apparent to those of ordinary skill in the electronics/surface mount arts to mechanically secure the receptacle 150 to a substrate.

Figure 1H:
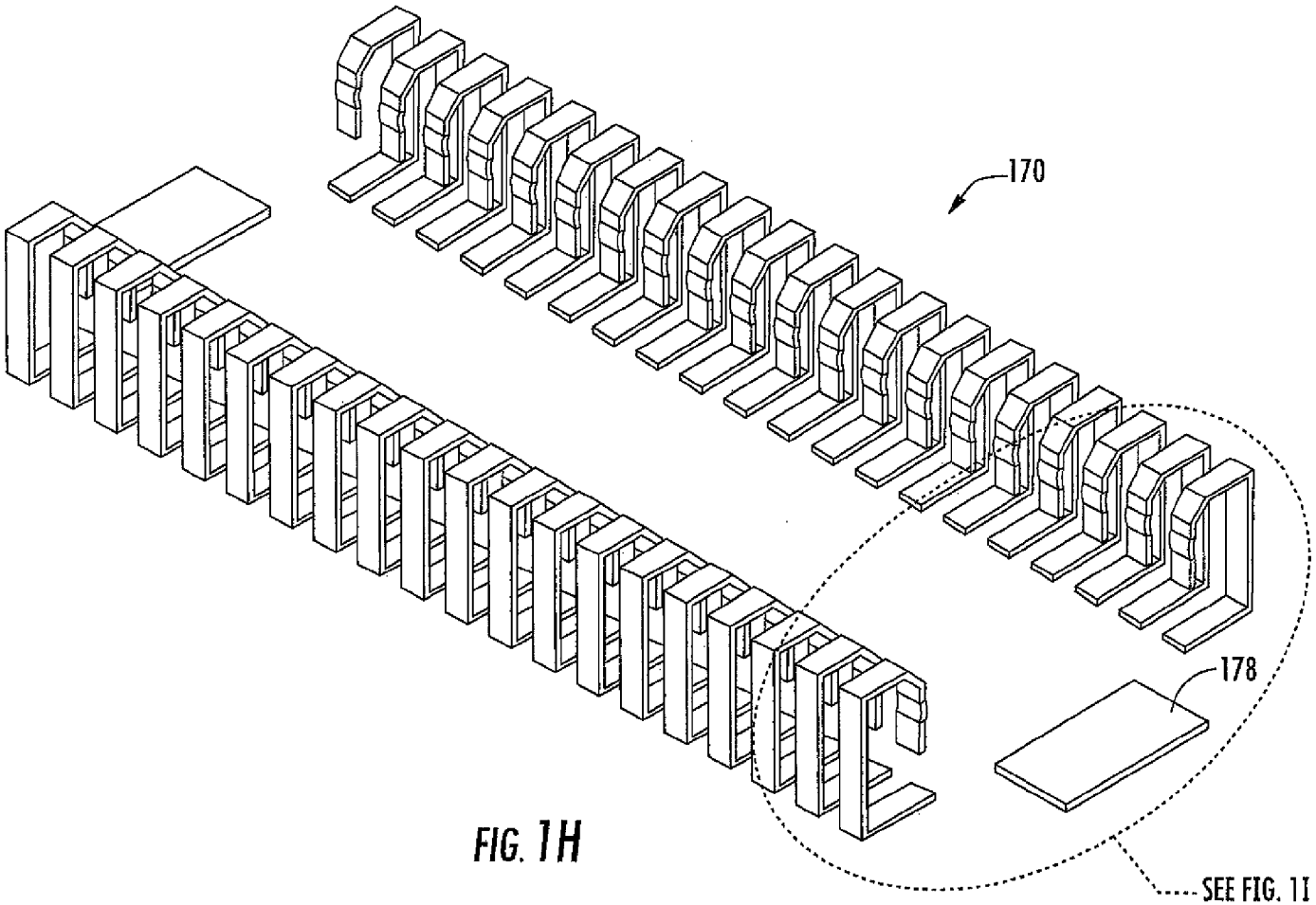
FIG. 1H is a perspective view of the conductors from the receptacle portion of the interconnect connector shown in FIG. 1F.

Referring now to FIGS. 1H and 1I, the details of the contacts 170 on the receptacle are more readily observable. Of particular note is the "bump" 172 adapted to engage the bump 106 located on the plug 101 (See FIG. 1E).

In addition to the embodiment shown in FIGS. 1-1I, the use of an LDS polymer permits the possibility that LDS conductors be placed on multiple layers of the LDS polymer. For example, the receptacle shown in FIG. 1F could be subjected to an additional molding process that could add a side wall around the existing side walls. This newly added side wall can then be subjected to an LDS process, thereby incorporating EMI shielding onto the LDS interconnect receptacle. Alternatively, this added layer may comprise another polymer ubiquitous in the electronic arts, and a conventional metallic noise shield (e.g., tin or alloy-based Faraday shield) may be added thereto, thereby accomplishing the same EMI shielding objective as discussed above.

Also, as previously alluded to, the receptacle may also incorporate any number of discrete electronic components (including integrated circuits and the like) within the overmolded LDS polymer. In this fashion, additional options for the design of the signal conditioning applied to signals of the conductors of the interconnect connector may be readily incorporated into the underlying mechanical design.

Single Interconnect Connector Embodiments—

Figure 2:
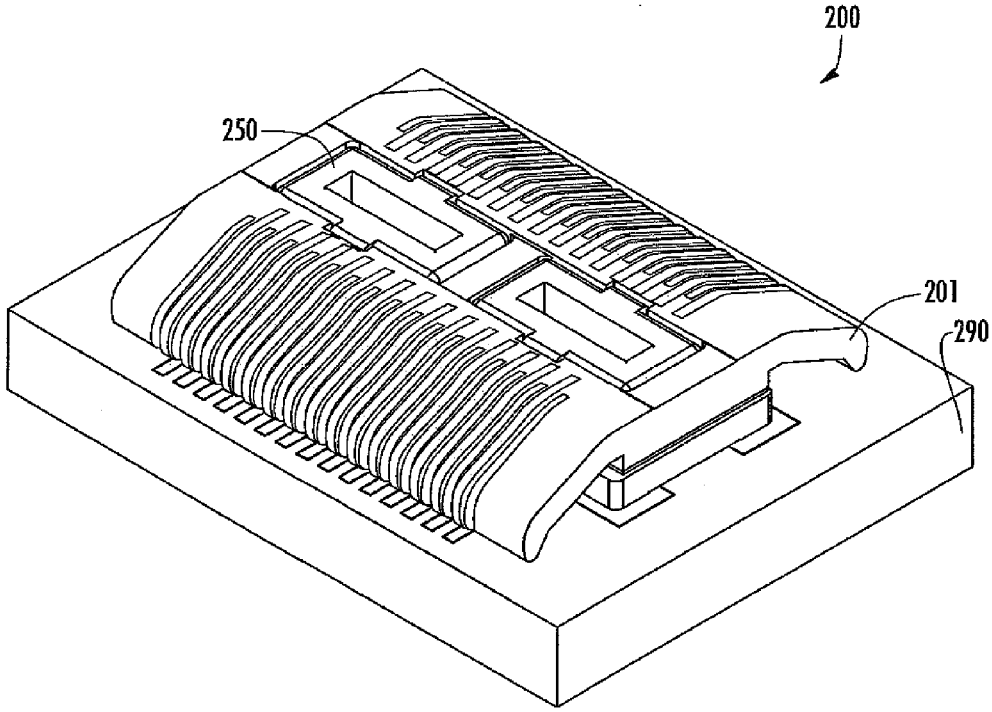
FIG. 2 is a perspective view of a second exemplary interconnect connector assembly disposed on a substrate manufactured in accordance with the principles of the present invention.

Referring now to FIG. 2, a second exemplary interconnect connector 200 manufactured in accordance with the principles of the present invention is shown and described in detail. In contrast with the embodiment illustrated at FIG. 1, the interconnect connector 200 comprises a support structure 250 and an interconnect connector 201 which provides a direct pathway between a device or substrate (not shown) and another substrate 290 or device via terminating pads 292 (FIG. 2B).

Figure 2A:
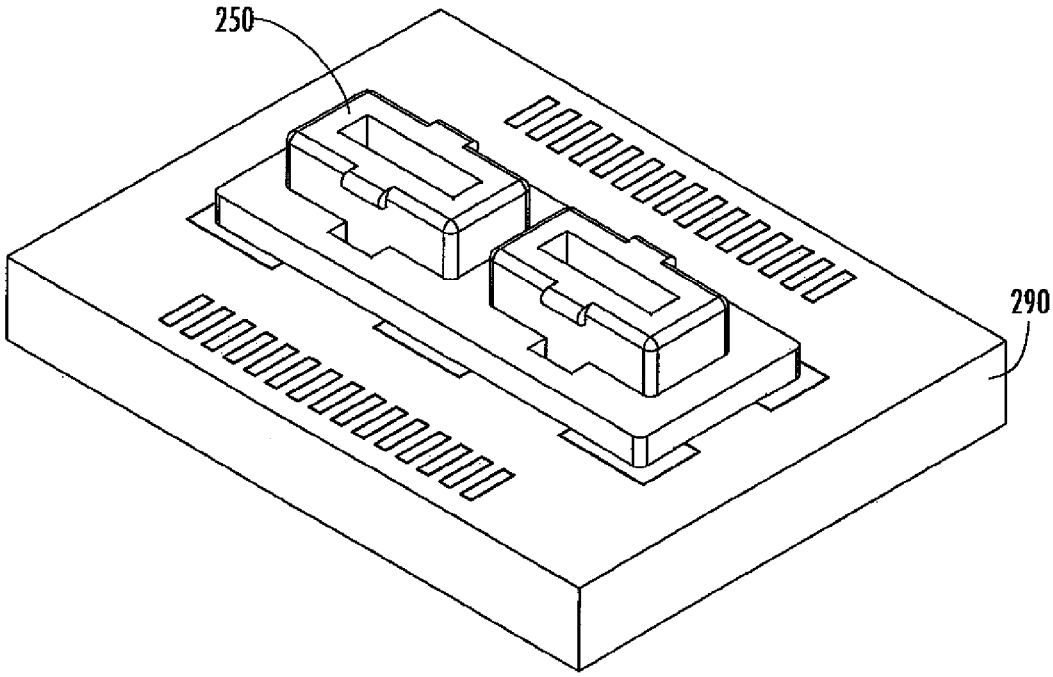
FIG. 2A is a perspective view of the support structure shown in FIG. 2 disposed on a substrate.
Figure 2B:
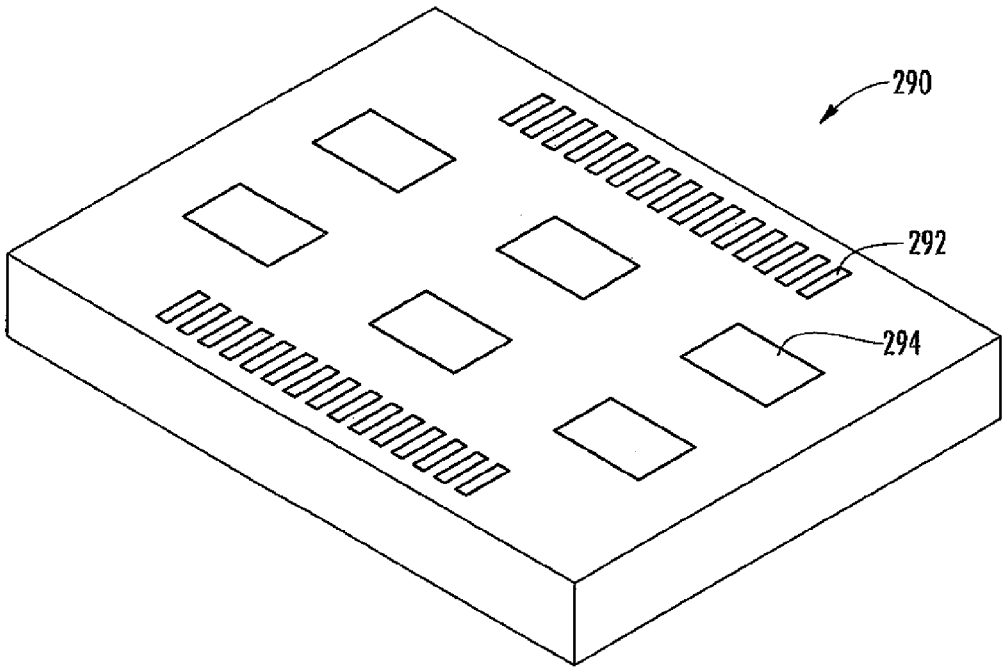
FIG. 2B is a perspective view of the substrate shown in FIG. 2.

As can be seen in FIG. 2A, the support structure 250 only provides in an exemplary embodiment a mechanical support for the interconnect connector. It provides no electrical function, although in some embodiments it may be desirable to provide an electrical function such as grounding, noise suppression, etc. The support structure 250 is mounted directly to the substrate 290 using any number of known techniques. For example, the support structure may be mounted, and soldered or glued to the substrate 290 via termination pads 294 (See FIG. 2B). Alternatively, the support structure could utilize posts or other mechanical means to secure the structure to the substrate.

Figure 2C:
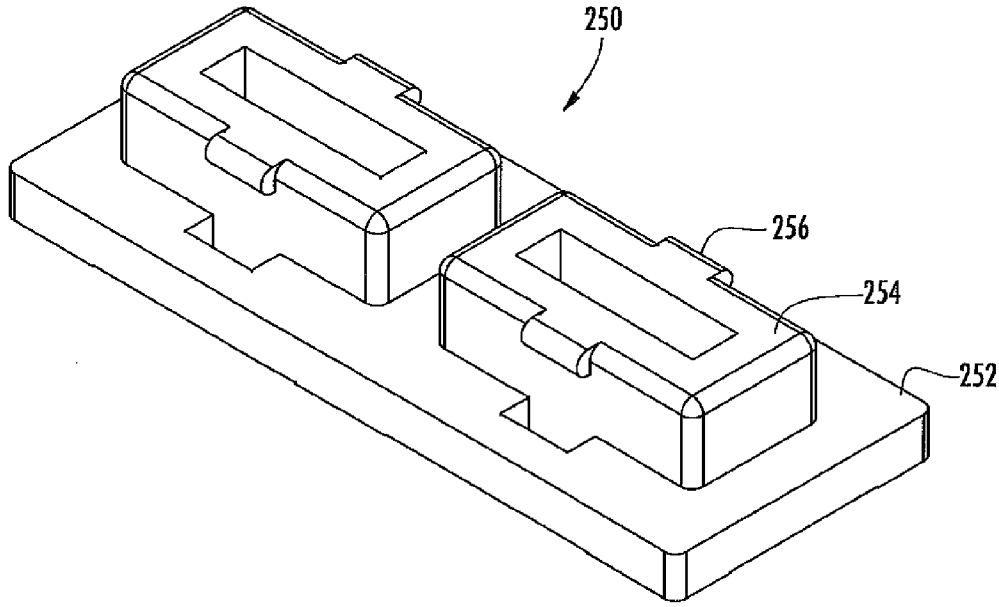
FIG. 2C is a perspective view of the support structure shown in FIG. 2A.

Referring now to FIG. 2C, the illustrated embodiment of the support structure 250 is shown and described in detail. Specifically, the support structure comprises base 252 and two (2) supporting posts 254. While a specific configuration is shown, the size and geometry of the support structure may vary according to the needs of the underlying interconnect connector to which the support structure mates.

Figure 2D:
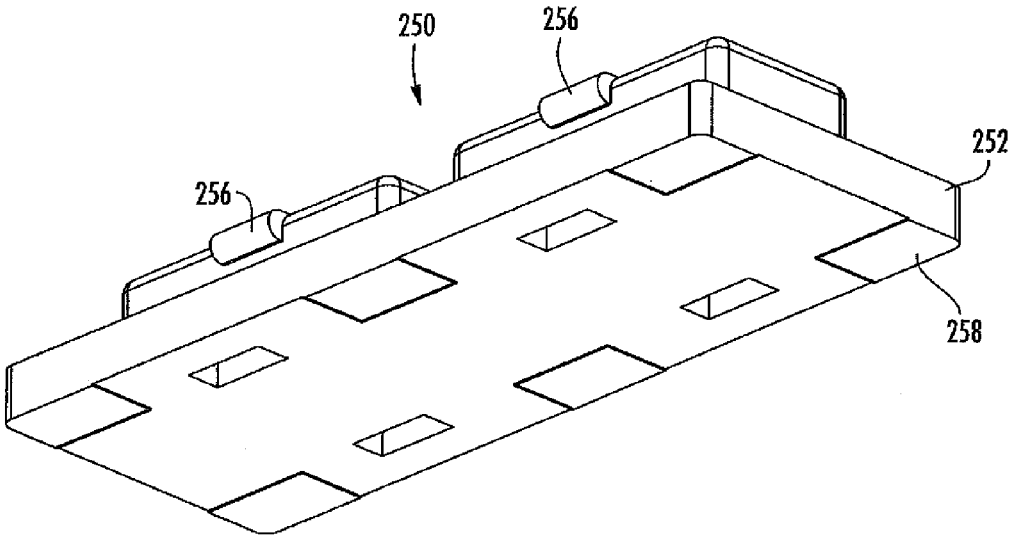
FIG. 2D is a perspective view of the underside of the support structure shown in FIG. 2C.

In addition, the support structure preferably implements retaining features 256 such as cantilever snaps or the like. The configuration and design of these retaining features may be readily adapted for the application (i.e., whether the assembly 200 is intended for one insertion, a limited number of insertions, or a large number of insertions). Accordingly, the embodiment shown is merely illustrative of the broader concepts. The retaining feature acts to maintain a minimum acceptable level of normal force between the interconnect connector 201 and the substrate 290, so as to provide a good electrical connection. FIG. 2D illustrates the underside of the support structure which provides the retaining feature 258 so as to secure the support structure 250 to the substrate 290 as discussed previously herein.

Figure 2E:
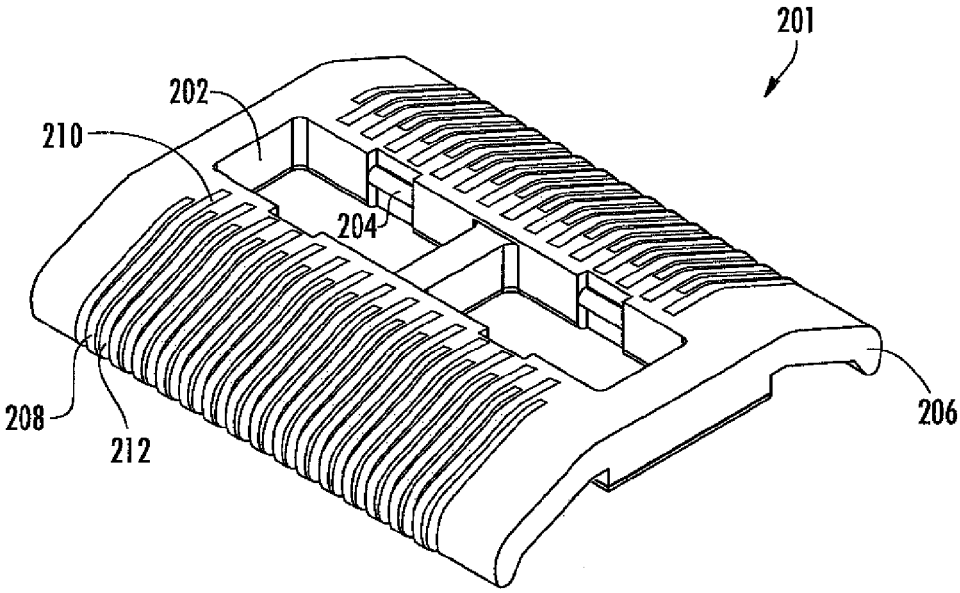
FIG. 2E is a perspective view of the interconnect connector shown in FIG. 2.

Referring now to FIG. 2E, the exemplary interconnect connector 201 of FIG. 2 is shown and described in detail. The exemplary interconnect connector 201 comprises a plurality of cavities 202 which correspond in dimension to the posts 254 on the support structure 250. It is noted that the dimensional fit between the connector 201 and structure 250 needs to be relatively tight (i.e., low tolerance) due to the relative smallness of the contacts 208 and their contact with the contacts 292 on the substrate 290 (FIG. 2B). Within the cavities 202 are disposed retention elements 204 which correspond to the retention features 256 present on the support structure as discussed above. The body 206 of the illustrated interconnect connector 201 advantageously comprises an LDS polymer so as to permit the creation of LDS created contacts 208 as illustrated in FIG. 2E. The body 206 further comprises and arch-like shape which in effect acts as a sort of spring when compressed downward. The contacts 208 comprise a connection pad 210 on the top surface of the connector 201 and are each separated by a cavity 212 which provides additional isolation between contacts 208. In one exemplary embodiment, the pitch spacing between contacts 208 is a mere 0.3 mm (about 0.012 in.) with the overall height of the device at 0.7 mm (about 0.0276 in.). However, it is appreciated that other dimensions and spacing between contacts may be utilized consistent with the principles of the present invention, with the dimensions only be limited by the aforementioned LDS process and electrical performance requirements.

Figure 2F:
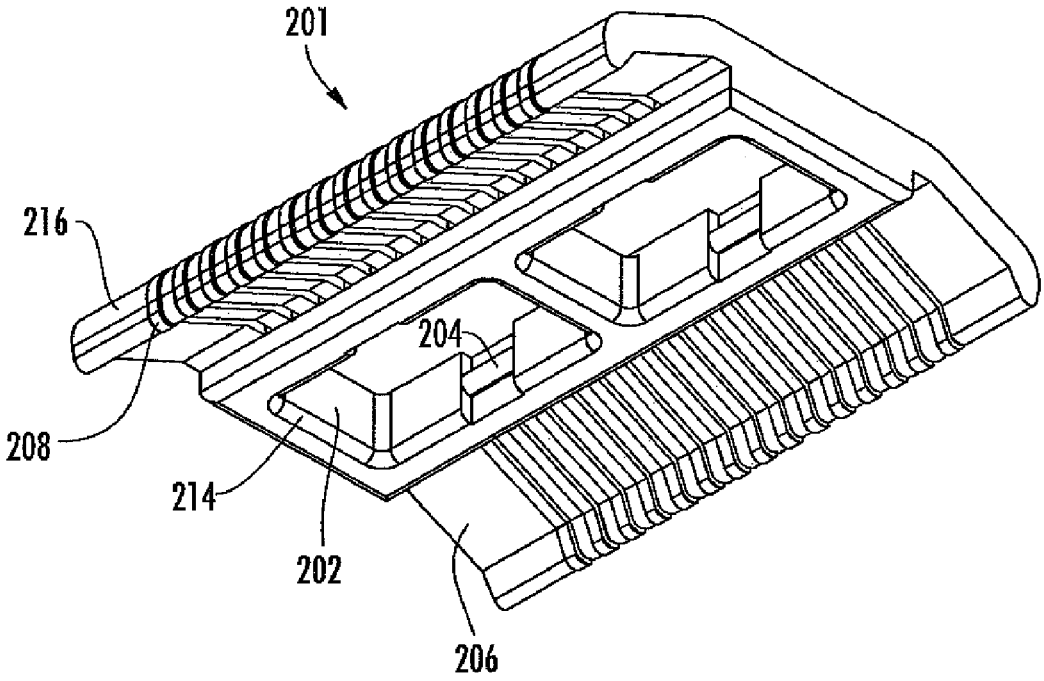
FIG. 2F is a perspective view of the underside of the interconnect connector shown in FIG. 2E.

FIG. 2F illustrates the underside of the interconnect connector 201. As can be seen from this vantage point, the conductors 208 wrap around the edge 216 of the body 206. The edge of the connector generally is shaped so as to come to a defined point in the direction of contact with the substrate to which the connector will ultimately be mated. As can also be seen, the cavities 202 further comprise chamfered or rounded entryways 214 so as to facilitate the insertion of the supporting structure posts 254 into the cavity 202 of the connector 201.

Figure 5:
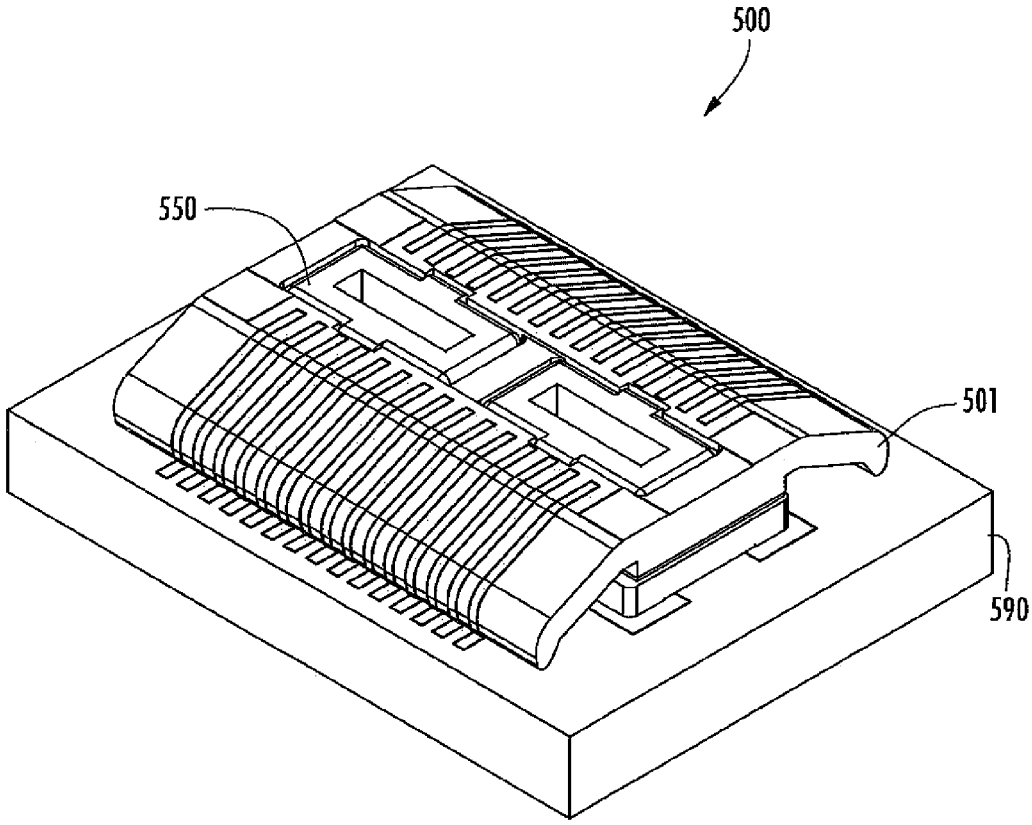
FIG. 5 is a perspective view of a third exemplary interconnect connector assembly disposed on a substrate manufactured in accordance with the principles of the present invention.

Referring now to FIG. 5, a third exemplary embodiment of an interconnect connector assembly 500, similar to that shown in FIG. 2, is shown and described in detail. Similar to FIG. 2, the interconnect connector assembly 500 of FIG. 5 comprises an interconnect connector 501, support structure 550 and a substrate 590 to which the two components are ultimately mounted. The support structure 550 and substrate 590 are essentially the same as that described above with regards to FIGS. 2A-2D and accordingly are not described further herein. However, the interconnect connector 501 itself differs from that embodiment described above in, for example, various features shown in FIGS. 2E and 2F.

Figure 5A:
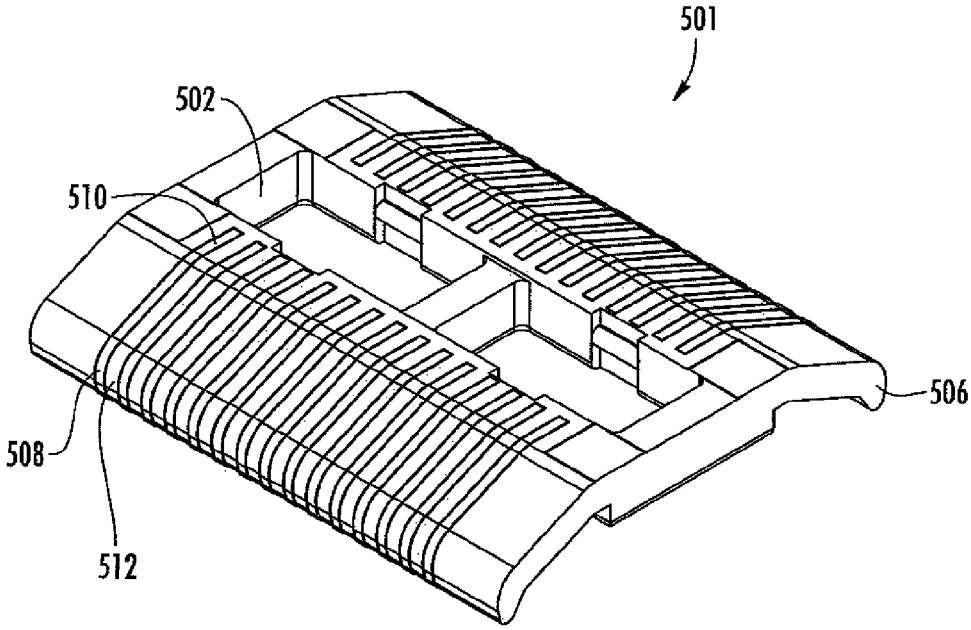
FIG. 5A is a perspective view of the interconnect connector shown in FIG. 5.

Referring now to FIG. 5A, the exemplary interconnect connector 501 of FIG. 5 is shown and described in detail. Similar to the embodiment illustrated in FIG. 2, the interconnect connector 501 of FIG. 5A comprises a plurality of cavities 502 which correspond in dimension to the posts on the support structure. As noted above with respect to FIG. 2, the dimensional fit between the connector 501 and structure 550 needs to be relatively tight due to the relative smallness of the contacts 508 and their contact with the contacts on the substrate 590. Within the cavities 502 are disposed retention elements 504 which correspond to the retention features present on the support structure as discussed previously. The body 506 of the illustrated embodiment of the interconnect connector 501 advantageously comprises an LDS polymer so as to permit the creation of LDS created contacts 508. The body 506 further comprises and arch-like shape which in effect acts as a sort of spring when compressed downward. The contacts 508 comprise a connection pad 510 on the top surface of the connector 501. However, unlike the embodiment illustrated in FIG. 2E, the contacts 508 are not separated by a cavity, but rather are separated by the LDS polymer gap 512 itself. By not separating the contacts with a cavity, the design of the connector 501 has additional flexibility for the configuration of the contacts, due to the increased amount of "real estate" available. This feature can advantageously utilize the extra available space for, inter alia, providing a signal conditioning function such as providing impedance matching for the circuits to which the connector assembly 500 is attached. Other signal conditioning techniques (such as the inclusion of discrete electronic components) can be utilized as well, consistent with other embodiments discussed previously herein.

Figure 5B:
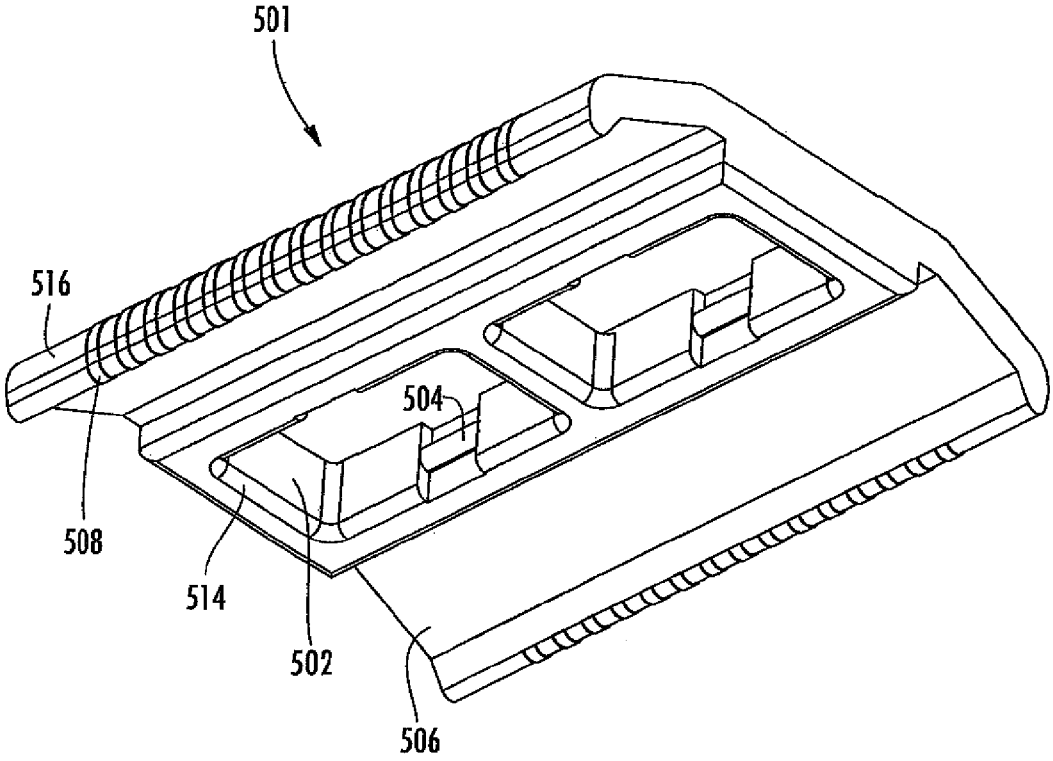
FIG. 5B is a perspective view of the underside of the interconnect connector shown in FIG. 5A.

FIG. 5B illustrates the underside of the interconnect connector 501. As can be seen from this vantage point, the conductors 508, like the embodiment illustrated in FIG. 2, wrap around the edge 516 of the body 506. The edge of the connector generally is shaped so as to come to a defined point in the direction of contact with the substrate to which the connector will ultimately be mated. As can also be seen, the cavities 502 further comprise chamfered or rounded entryways 514 so as to facilitate the insertion of the supporting structure posts into the cavity 502 of the connector 501.

While the interconnect connector embodiments illustrated in FIGS. 2 and 5 have a generally downward orientation with respect to the arch-like shape of the connector body 206, 506, it is appreciated that in some embodiments it may be desirable to reverse the orientation. That is, it may be desirable to have the contacts 210, 510 (FIG. 2E) be the contacts which engage their respective substrates 290, 590. These and other embodiments would be readily implemented by one of ordinary skill given the present disclosure, and hence are not described further herein.

Composite Structure Embodiments—

Figure 3:
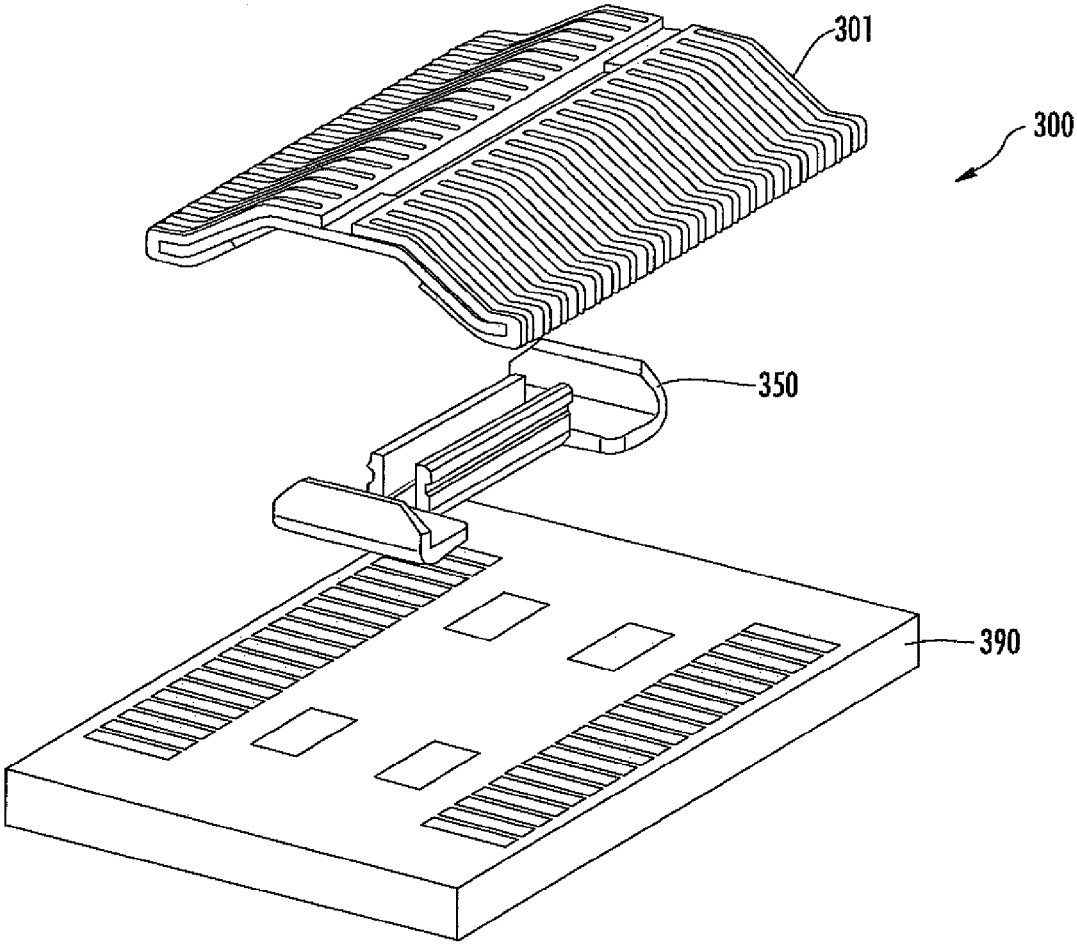
FIG. 3 is a perspective exploded view of a composite interconnect connector assembly including a substrate manufactured in accordance with the principles of the present invention.
Figure 3A:
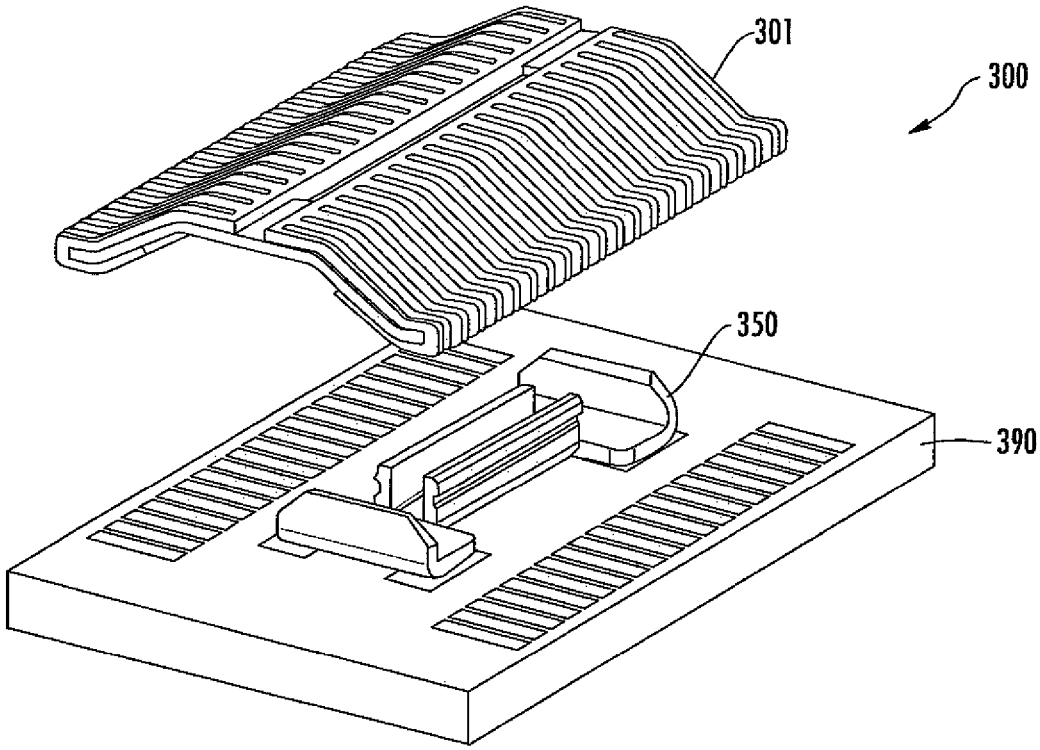
FIG. 3A is a perspective exploded view of the composite interconnect connector assembly shown in FIG. 3 with the support structure disposed on a substrate.

Referring now to FIG. 3, a third exemplary interconnect connector assembly 300 is shown and described in detail. The interconnect connector assembly 300 of FIG. 3 is similar in operation as that shown in FIG. 2; i.e., it comprises a single interconnect connector 301 and a supporting structure 350 mounted on a substrate 390 (FIG. 3A). However, the construction of the interconnect connector assembly 300 differs in some fundamental ways.

Figure 3B:
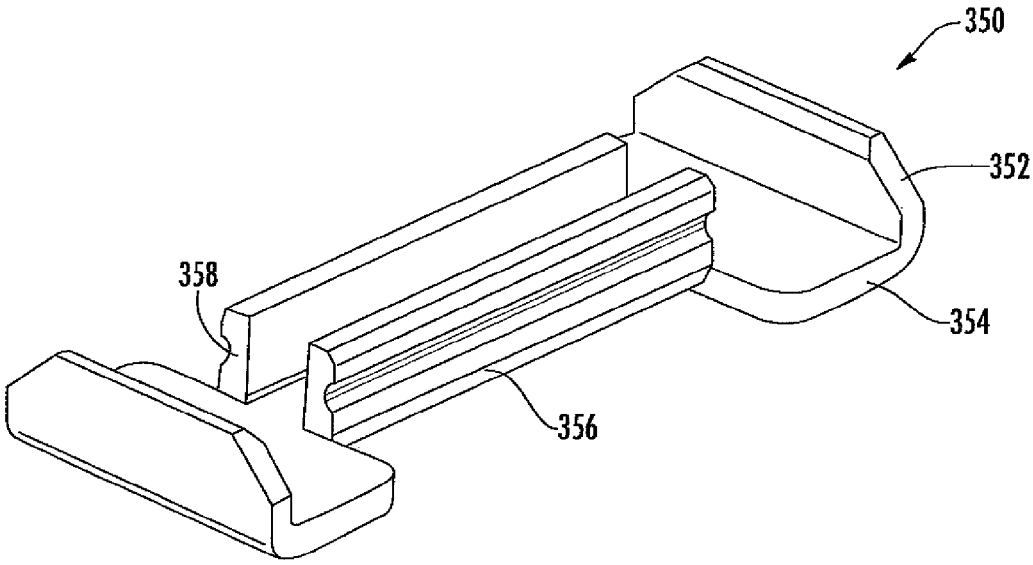
FIG. 3B is a perspective view of the support structure shown in FIG. 3.

In one exemplary configuration, the support structure 350 illustrated in FIG. 3B comprises a stamped and formed metallic structure. The structure comprises a base support 354 adapted to attach the structure 350 to the substrate 390. This can be accomplished via soldering or using adhesives to secure the metallic structure 350 to the substrate 390. Alternatively, the support structure could utilize other features to secure the support structure to a substrates such as the elliptical tines disclosed in co-owned and co-pending U.S. Provisional Patent Application No. 61/010,318 filed Jan. 4, 2008 and entitled "Heterogeneous Connector Apparatus and Methods of Manufacture (SFP over RJ)", the contents of which are incorporated herein by reference in its entirety.

The illustrated support structure 350 further comprises a stopper feature 352 which prevents the interconnect connector 301 from being compressed too far. Retention features 356 are adapted to interface with respective snaps on the interconnect connector 301 by engaging slots 358.

Figure 3C:
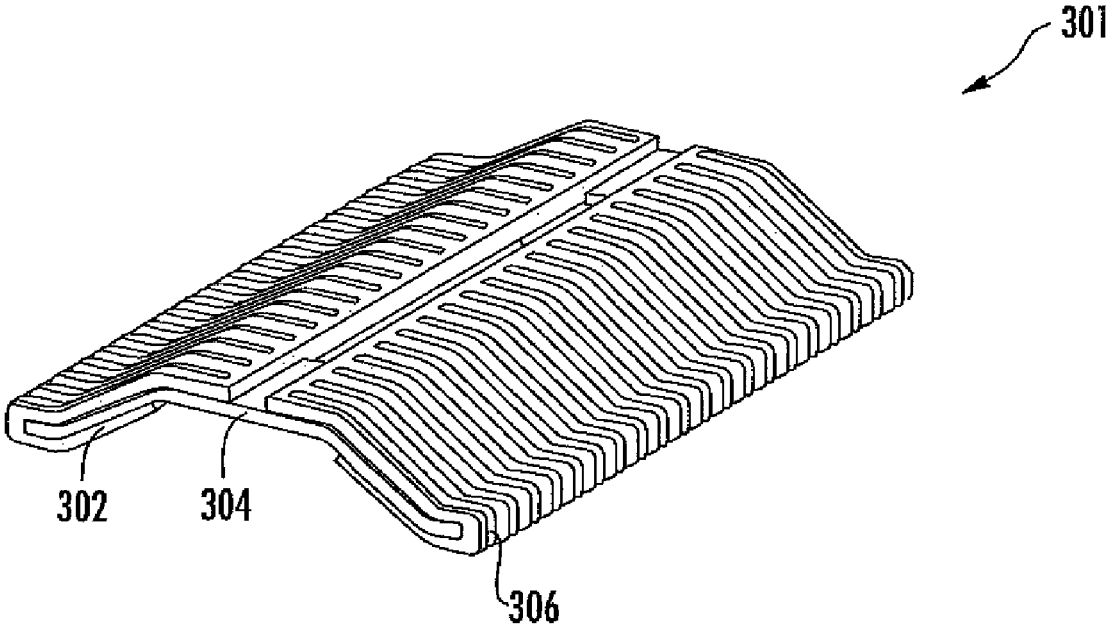
FIG. 3C is a perspective view of the composite interconnect connector shown in FIG. 3.

FIG. 3C further illustrates the exemplary interconnect connector 301 of FIG. 3. The interconnect connector 301 utilizes a composite structure comprising an over-molded metal disk 304 that is covered with an LDS polymer body 302. The metal disk layer 304 provides flexibility that cannot be accomplished with a molded polymer body, and accordingly the composite structure provides metal-like properties while taking advantage of the LDS process for implementing fine pitch contacts 306.

Figure 3D:
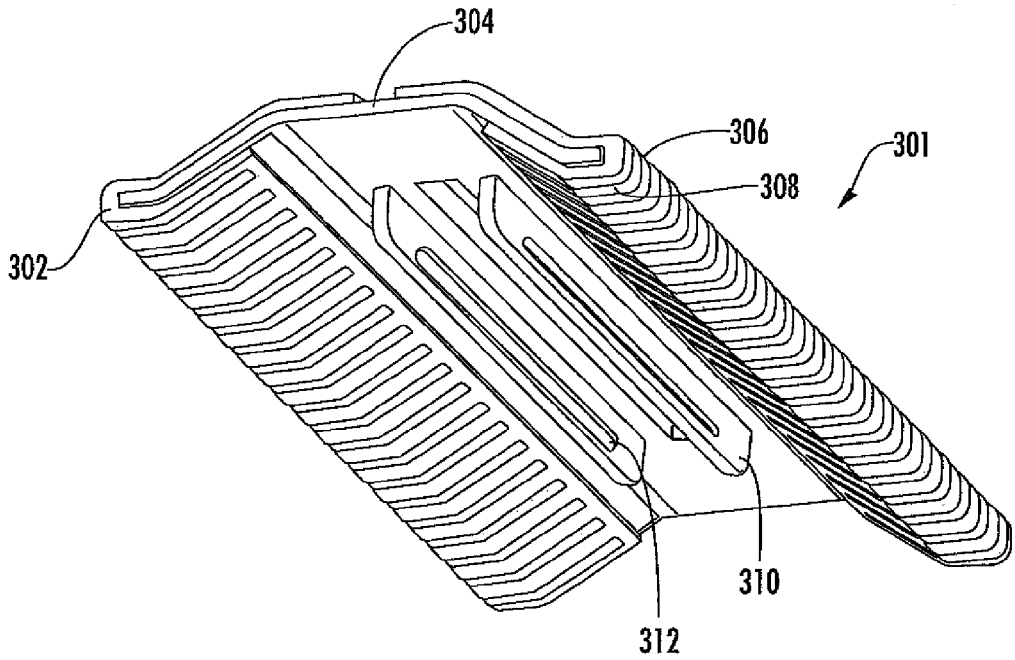
FIG. 3D is a perspective view of the underside of the composite interconnect connector shown in FIG. 3C.

Referring to FIG. 3D, the underside of the interconnect connector 301 is shown and described in detail. As can be seen, the exemplary interconnect connector 301 comprises an attachment feature 310 which attaches the interconnect connector to the support structure 350. Specifically, this function is accomplished via snap features 312 which engage the respective retention features 356 located on the support structure 350. Also visible in FIG. 3D is the underside of the contacts 306, which form contact pads 308 to engage the substrate 390. As previously described herein with regards to other embodiments, the contacts can advantageously be designed and manufactured with any number of complex shapes and configurations so as to improve the electrical characteristics of the connector or provide other desired performance attributes. For instance, the width, length and shape of the individual contacts can be designed so as to provide improved impedance matching over prior art interconnect connectors. In one exemplary embodiment, the pitch spacing between contacts 306 is 0.3 mm (about 0.012 in.) with the overall height of the device at 0.5 mm (about 0.0197 in.). The overall height of the device can, in this exemplary embodiment, be reduced due to the composite structure of the connector. However, it is appreciated that other dimensions and spacing between contacts may be utilized consistent with the principles of the present invention, with the dimensions only being limited by the aforementioned LDS process and electrical performance requirements.

Figure 3E:
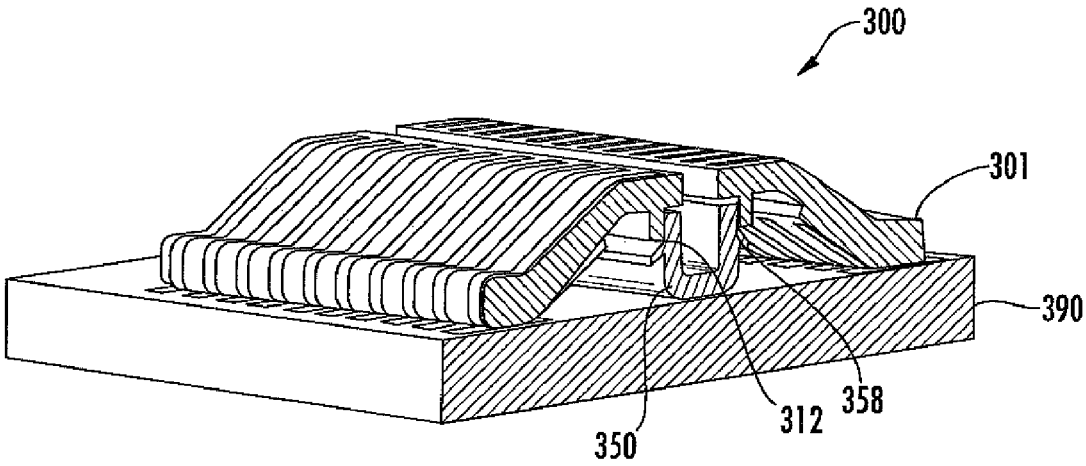
FIG. 3E is a perspective cross-sectional view of the composite interconnect connector shown in FIG. 3 disposed on a substrate.

FIG. 3E illustrates a cross-sectional view showing the interconnect connector 301 engaged with the support structure 350 by inserting the snap features 312 in the engaging slots 358. As is illustrated in FIG. 3E, the interconnect connector contacts are preferably placed in compression with the substrate 390 thereby placing a sufficient amount of normal force between the contacts on the connector and the respective contacts on the substrate. Accordingly, herein lies another salient advantage of the composite structure, i.e. the composite structure allows additional flexibility when designing for this contact force. In addition, the composite structure permits for higher mating cycles over non-composite structures.

Dual Interconnect Composite Embodiments—

Figure 6:
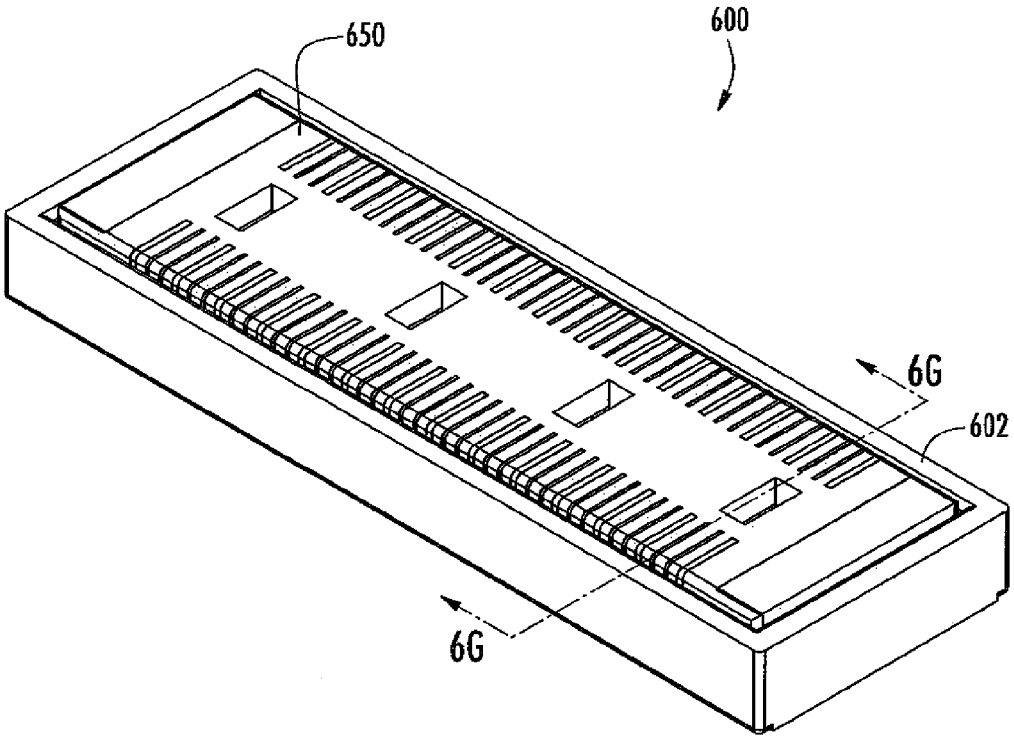
FIG. 6 is a perspective view of a fourth exemplary interconnect connector manufactured in accordance with the principles of the present invention.

Referring now to FIG. 6, an exemplary miniature dual composite interconnect connector 600 is illustrated. The interconnect connector 600 shown comprises a receptacle portion 602 and a plug portion 650 of a plug-receptacle pair. In one embodiment, the receptacle 602 and plug 650 portions comprise an LDS polymer base material having a generally rectangular shape. Within the cavity is a plurality of plated contacts (discussed in further detail below), preferably made from the aforementioned LDS processing techniques in order to minimize the size of the connector.

The interconnect connector 600 illustrated in FIG. 6 possesses many advantages over prior art stamped and plated post or insert-molded interconnects, similar to those discussed previously with regards to FIG. 1. Specifically, the interconnect connector 600 of FIG. 6 is lower in cost due to the obviation of the necessity for separate copper contacts, in addition to providing substantially reduced tooling costs.

An exemplary application for the interconnect connector 600 shown in FIG. 6 is the interconnection of printed circuit boards ("PCBs"). While potential applications for the aforementioned interconnect connector apparatus are readily appreciated by those of ordinary skill to be diverse, the following figures will primarily discussed in the context of this exemplary PCB-to-PCB interconnect application.

Figure 6A:
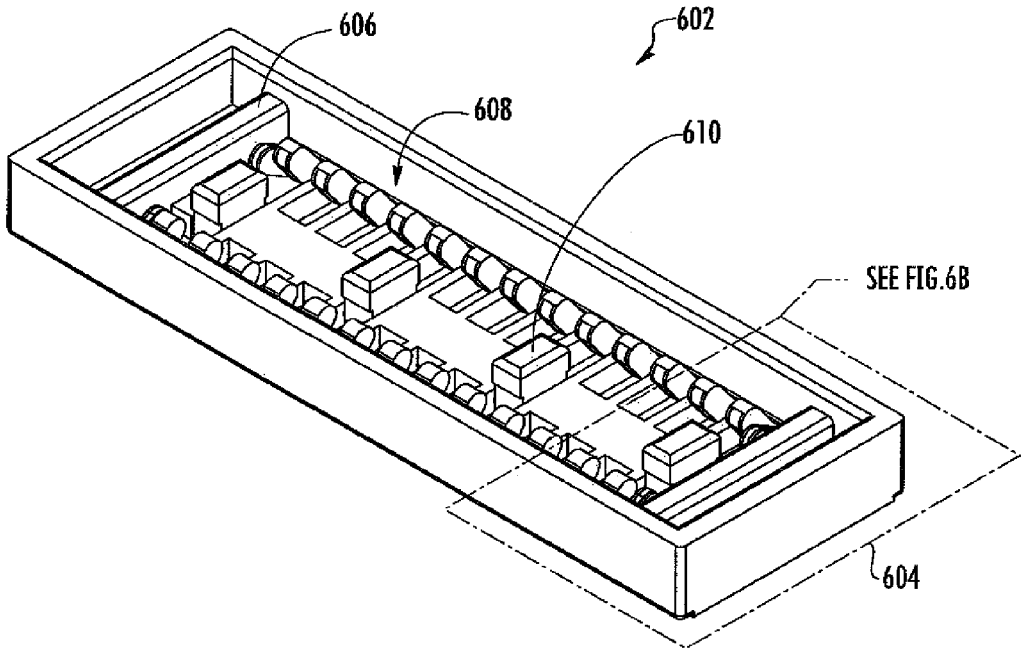
FIG. 6A is a perspective view of the receptacle portion of the interconnect connector of FIG. 6.

Referring now to FIG. 6A, the receptacle portion 602 of the interconnect connector shown in FIG. 6 is shown and described in detail. In the exemplary embodiment shown, the receptacle portion comprises a body portion 604 defining a cavity 608. As mentioned previously, the receptacle portion advantageously is molded from an LDS polymer. Within the cavity of the receptacle portion are disposed pluralities of alignment features 606, 610, which aid in aligning the receptacle portion of the connector 600 with the plug portion. First alignment features 610 generally comprise a post-like structure which is received within respective cavities located on the plug portion of the connector. Second alignment features 606 also provide additional alignment function between the receptacle and plug portions of the connector 600.

In addition, in one exemplary embodiment, the outside periphery of the body portion 604 can be activated and plated so as to provide a shielding layer. This shielding layer isolates the internal contacts, discussed subsequently herein, from affecting or being affected by external electronic circuitry otherwise residing outside of the connector 600.

Figure 6B:
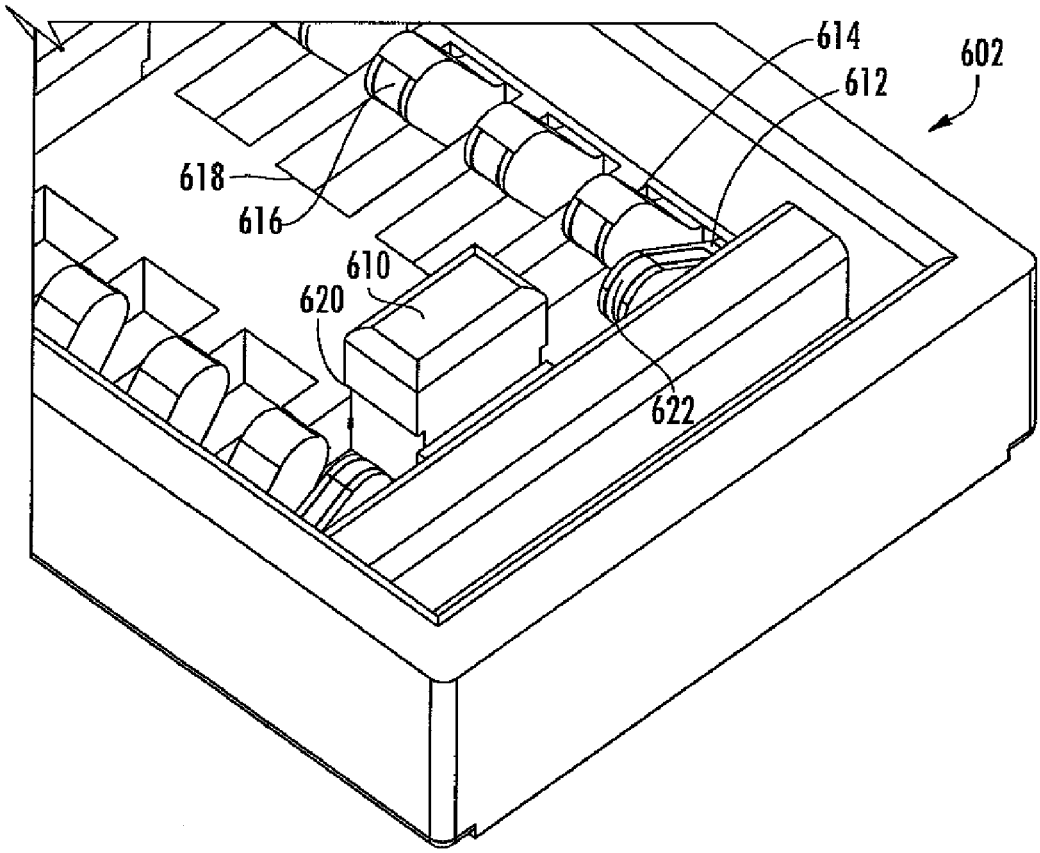
FIG. 6B is a detailed perspective view of the contacts of the receptacle portion of the interconnect connector of FIG. 6A.

FIG. 6B illustrates a detailed view of the exemplary contacts 616, 622 of the receptacle portion of the connector. The contacts 612, 614 as shown protrude upwardly out of respective cavities 618. In addition, the contacts 612, 614 are separated into distinct functions for the interconnect connector 600. The contacts 612 are adapted to provide grounding between the plug and receptacle portions of the connector, so that both portions comprise the same ground potential for the connector circuit. In the embodiment shown, the receptacle portion comprises four (4) grounding contacts 612, although it is appreciated that more or less could be used if desired.

Each of signal contacts 614 comprises, in one exemplary embodiment, a differential pair 616 of electrical contacts. The use of differential signal contacts provides electrical advantages well known in the electronic arts such as improved resistance to electromagnetic interference. However, while the effect is known, limitations in connector design and manufacture of prior art connectors have made implementation of differential transmission pairs within a miniaturized connector difficult, if not impossible. Also, while shown only with regards to FIGS. 6-6G, it is recognized that the use of differential transmission pairs may readily be adaptable to other embodiments described herein. The connection end 622 of the grounding contacts 612 can be implemented either as a differential or single contact design (or even three or more contact design), depending on the electrical performance characteristics of the connector desired.

Figure 6C:
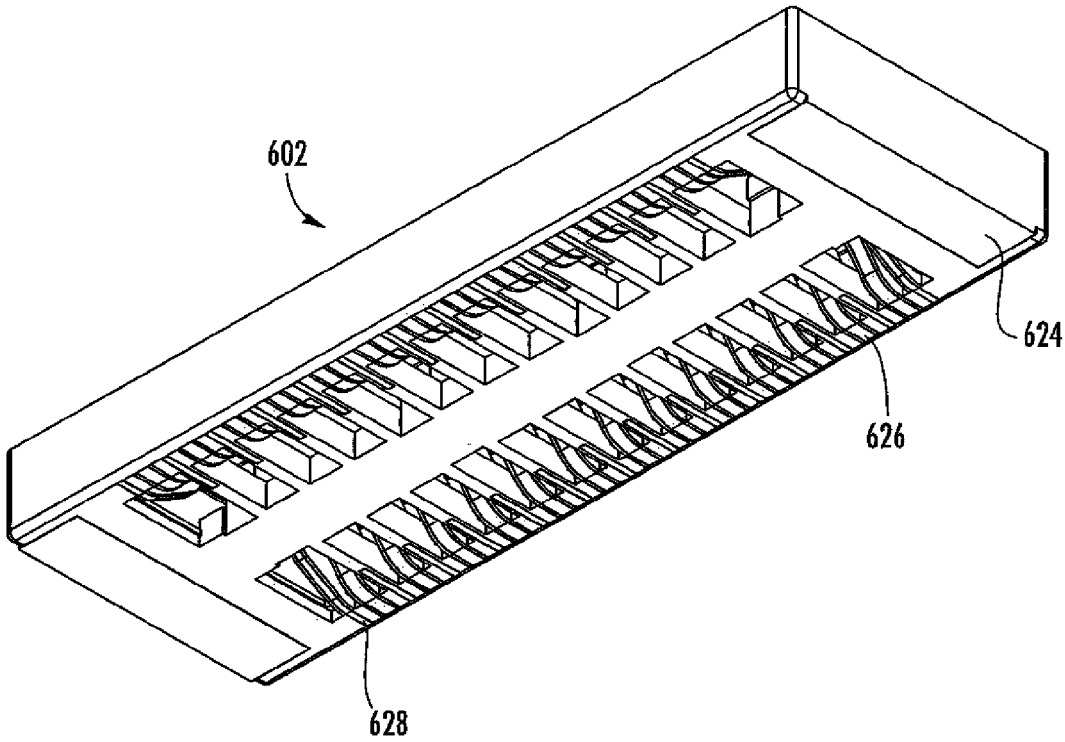
FIG. 6C is a perspective view of the underside of the receptacle portion of the interconnect connector of FIG. 6A.

FIG. 6C illustrates the underside of the receptacle portion of the interconnect connector 600. From this vantage point, the receptacle contacts for the substrate to which the receptacle is attached can be seen. Specifically, ground substrate contact portions 628 and signal substrate contact portions 626 are shown. In addition, the shielding contact portion 624, which provides a ground connection for the peripheral shielding layer of the receptacle portion to the underlying substrate, is also shown.

Figure 6D:
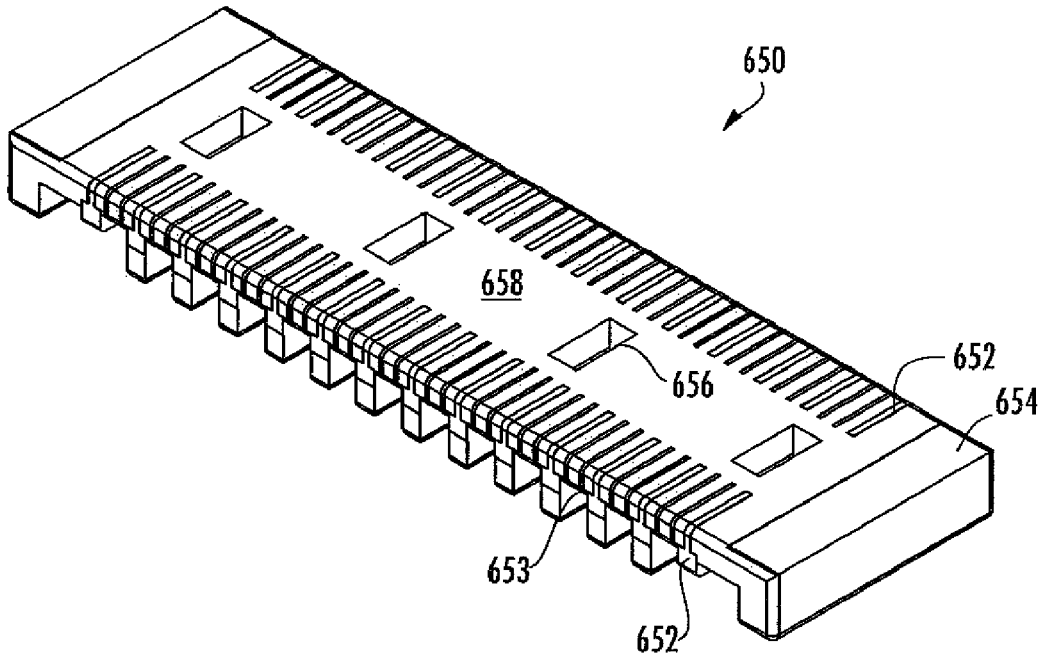
FIG. 6D is a perspective view of the plug portion of the interconnect connector of FIG. 6.

FIG. 6D illustrates the plug portion 650 of the interconnect connector 600. Specifically, FIG. 6D shows the substrate contacting surface 658 of the plug portion. The substrate surface 658 comprises, in one exemplary embodiment, a plurality of contact pads manufactured using the aforementioned LDS manufacturing process. These contacts include differential signal contacts 653, as well as ground contacts 652 which are adapted to isolate the differential signal pairs from one another (see FIG. 6E). In addition, the ground contacts 654 provide an additional ground connection for the plug portion. The alignment cavities 656 are also visible from this vantage point and are adapted to receive posts 610 from the receptacle portion.

Figure 6E:
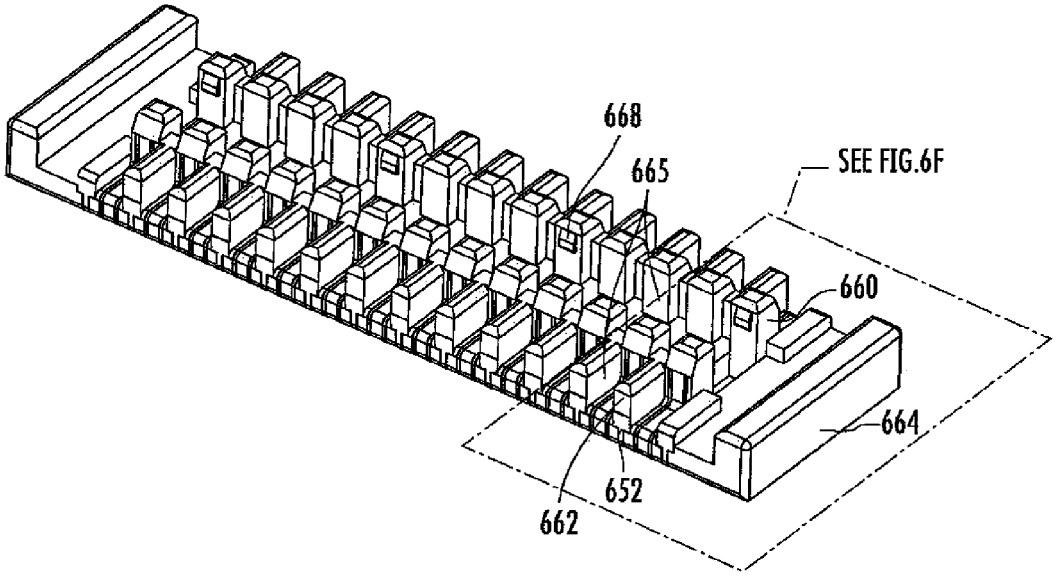
FIG. 6E is a perspective view of the underside of the plug portion illustrated in FIG. 6D.

Referring now to FIG. 6E, the connection side of the plug portion 650 is illustrated. As can be seen, the plug portion of FIG. 6E comprises end portions 664 which are optionally plated so as to provide additional grounding isolation for the differential transmission signal pairs. Additional shielding is also optionally provided on plug surfaces 662, 663, 665, which aid in isolating the differential signal pairs from one another. Portions of the differential signal posts 660 also include latching features 668, which are adapted to engage with respective features on the receptacle portion of the connector to help fixedly secure the plug and receptacle portions during mating.

Figure 6F:
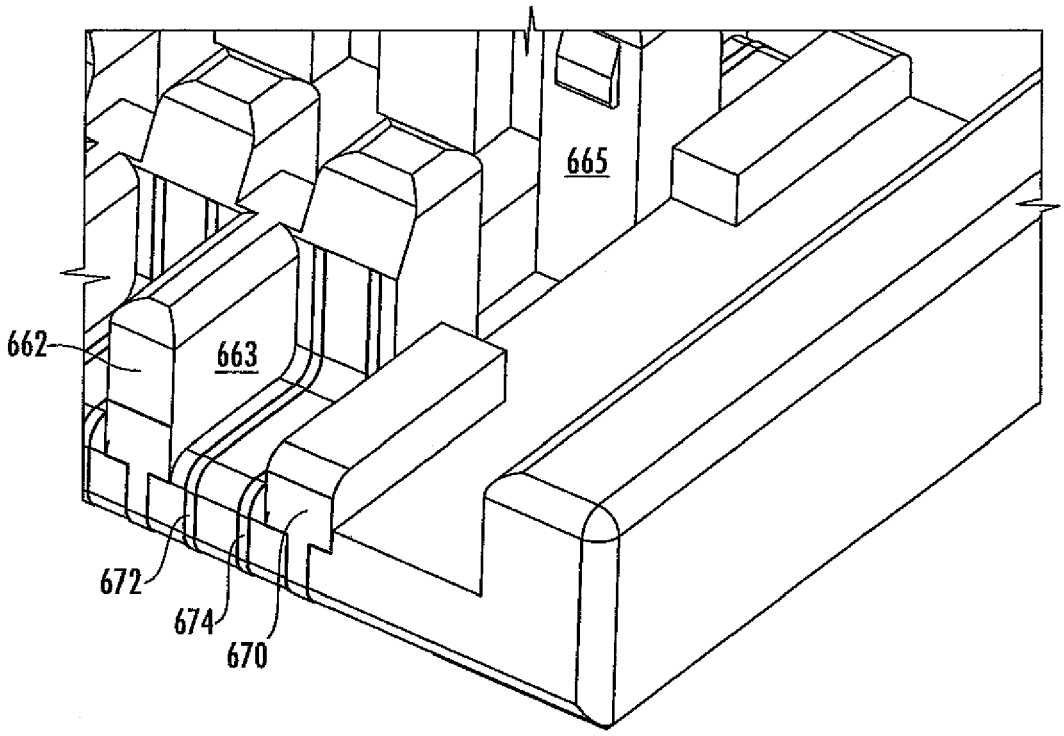
FIG. 6F is a perspective detailed view of the plug portion of the interconnect connector of FIG. 6E.

FIG. 6F illustrates a detailed view of the aforementioned features located on the plug portion of the connector. The differential signal pairs 672, 674 are readily seen in this detailed view in addition the grounded surfaces 662, 663, 665 which isolate these signal pairs from adjacent ones of signal pairs. Connector ground posts 670, of which there are four (4) in this embodiment, are adapted to contact with the ground contacts 612 located on the receptacle portion of the connector. As previously mentioned, this feature ensures that plug and receptacle portions of the connector remain at approximately the same ground potential with respect to one another.

Figure 6G:
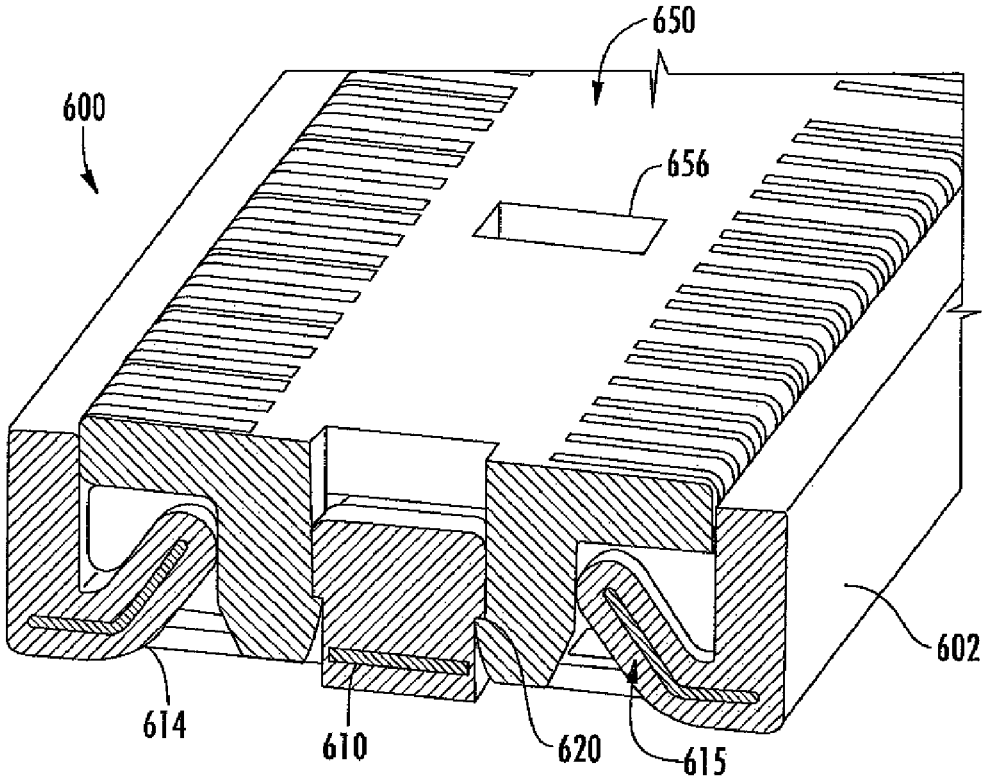
FIG. 6G is a perspective sectional view of the interconnect connector shown in FIG. 6 taken along line 6G-6G.

Referring now to FIG. 6G, a cross sectional view of the connector 600 is shown (FIG. 6), which illustrates the composite nature of the connector design. While shown as a composite structure, it is recognized that other embodiments may readily be implemented without necessarily requiring the composite structure, such as in applications where multiple plug, receptacle insertions are not necessary. As can be seen in FIG. 6G, each of the receptacle contacts 614 (and ground contacts 612) advantageously incorporate an over-molded metal alloy insert 615 which provides, inter alia, increased spring contact force during plug insertion into the receptacle thereby improving the electrical contact between the plug and receptacle portions of the connector. As is also more readily visible in FIG. 6G is the connection between posts 610 at interface 620 of the receptacle portion with the latching features 668 of the plug portion of the connector.

Also, as previously discussed, the receptacle may also advantageously incorporate any number of discrete electronic components (including integrated circuits and the like) within the over-molded LDS polymer. In this fashion, additional options for the design of the signal conditioning nature of the conductors of the interconnect connector may be readily incorporated into the underlying mechanical (and electrical) design.

Figure 6H:
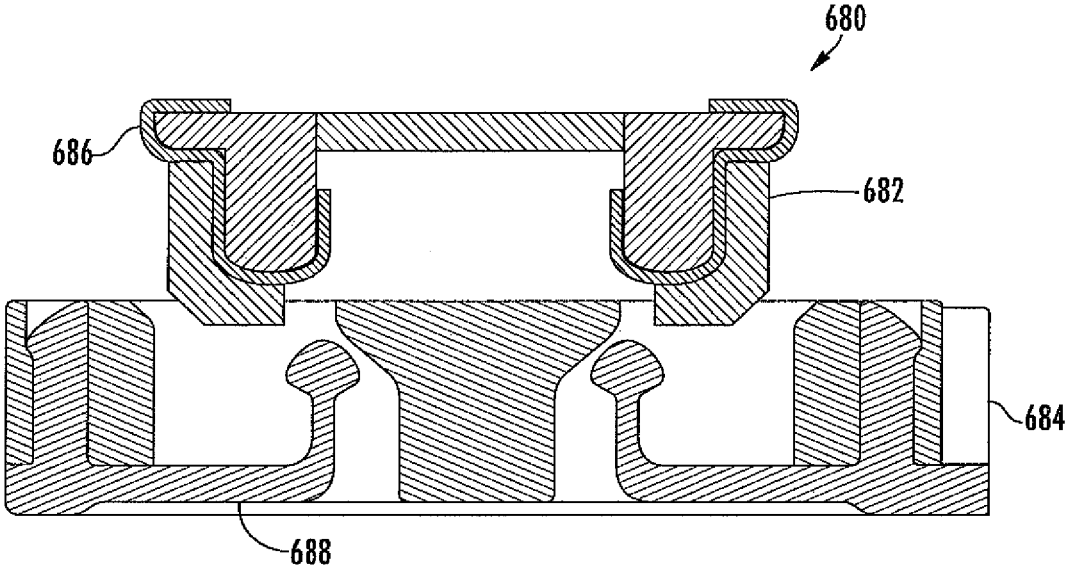
FIG. 6H is a sectional view of an alternative composite interconnect connector manufactured in accordance with the principles of the present invention.

Referring now to FIG. 6H, an alternative composite interconnect connector 680 cross sectional view is illustrated. Similar to the embodiment illustrated with regards to FIGS. 6-6G, the interconnect connector 680 of FIG. 6H comprises a plug 682 and a receptacle 684 pair. However, in this embodiment, the receptacle portion 684 of the interconnect connector utilizes traditional contacts 688 (e.g., stamped and plated); while the plug portion utilizes a printed contact 686, such as an LDS polymer material with metallized surfaces. Accordingly, the "composite" nature of this interconnect connector embodiment is a result of the plug and receptacle portions of the connector utilizing different contact manufacturing processes in its construction.

Flexible Printed Circuit (FPC) Connector Embodiments—

Figure 4:
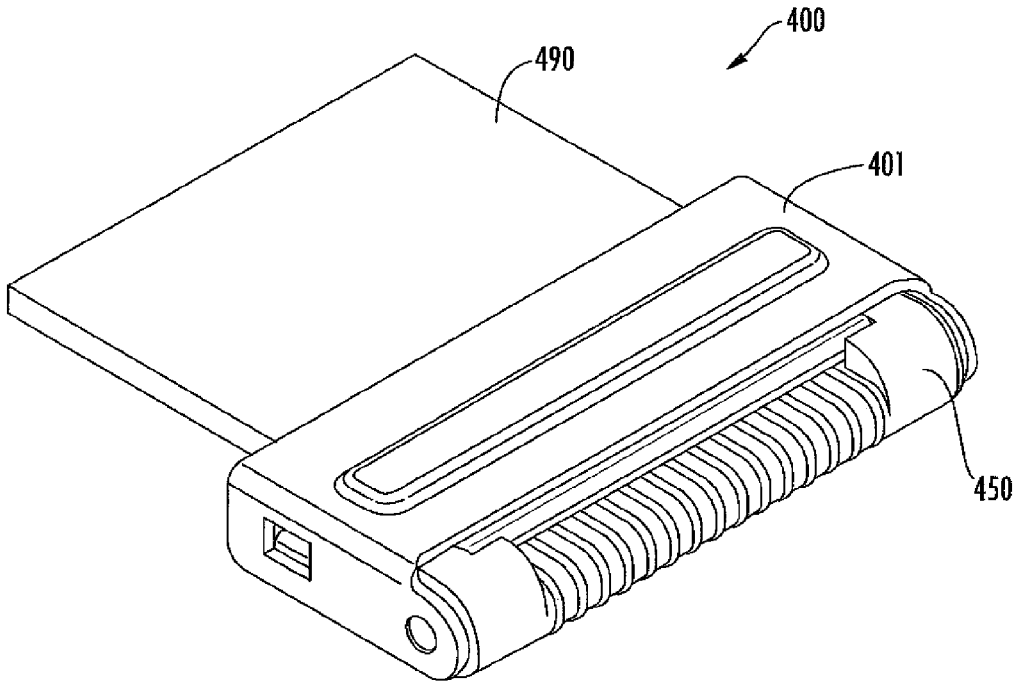
FIG. 4 is a perspective view of a first Flexible Printed Circuit (FPC) connector manufactured in accordance with the principles of the present invention.

Referring now to FIG. 4, an exemplary FPC connector 400 is shown and described in detail. As illustrated, the FPC connector 400 comprises an FPC plug 450, FPC latch 401 attached to the plug and a FPC substrate 490 inserted between the latch and the plug. The FPC substrate 490 comprises a flexible printed circuit board of the type ubiquitous in the electronic arts and accordingly not described further herein.

Figure 4A:
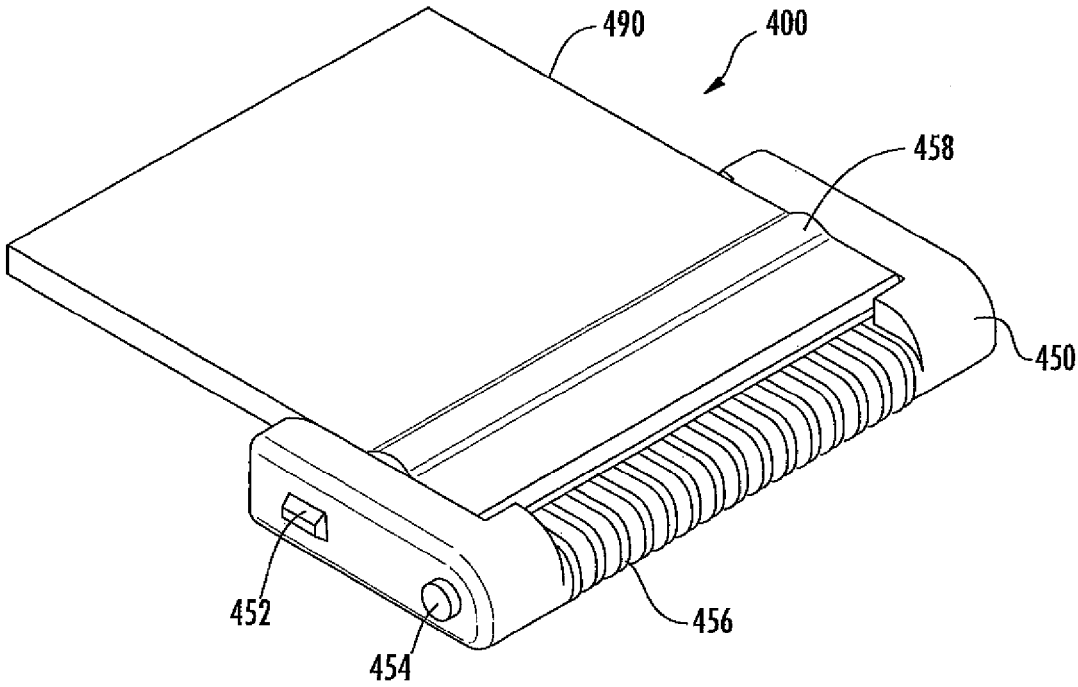
FIG. 4A is a perspective view of the FPC connector shown in FIG. 4 with the latching cover removed.

FIG. 4A illustrates the aforementioned FPC connector 400 with the latch removed. As can be seen, the FPC plug of this embodiment comprises an LDS polymer which permits the addition of accurately placed contacts 456. In one exemplary variant, the pitch spacing between contacts 456 is a mere 0.3 mm (about 0.012 in.) with the overall height of the device at 0.6 mm (about 0.0236 in.). It is however appreciated that other dimensions and spacing between contacts may be utilized consistent with the principles of the present invention, with the dimensions only limited by the aforementioned LDS process and electrical performance requirements.

In addition, the FPC plug comprises two posts 454 on which the latch can rotate, as well as a snap 452 which retains the latch in the locked position. While primarily contemplated as a single LDS polymer body, it is recognized that it may be desirable to manufacture the plug 450 from two or more separate components. For instance, in one exemplary embodiment, the portion of the plug that includes the contacts 456 may comprise an LDS polymer base material, while the portion of the plug that includes the post 454 and snap 452 comprises an ordinary (non-LDS) material. In this manner, the cost of the plug 450 can be reduced, as the cost of an LDS polymer base material typically is higher than non-LDS materials. In one exemplary implementation, this can be accomplished by over-molding the non-LDS material onto the LDS polymer, or otherwise mechanically securing the non-LDS material onto the LDS polymer material such as via adhesives, heat staking or a friction/interference fit.

Also worthy of note is the "bump" 458 seen with the FPC substrate 490 placed on the plug 450. This feature will be discussed in further detail subsequently herein below.

Figure 4B:
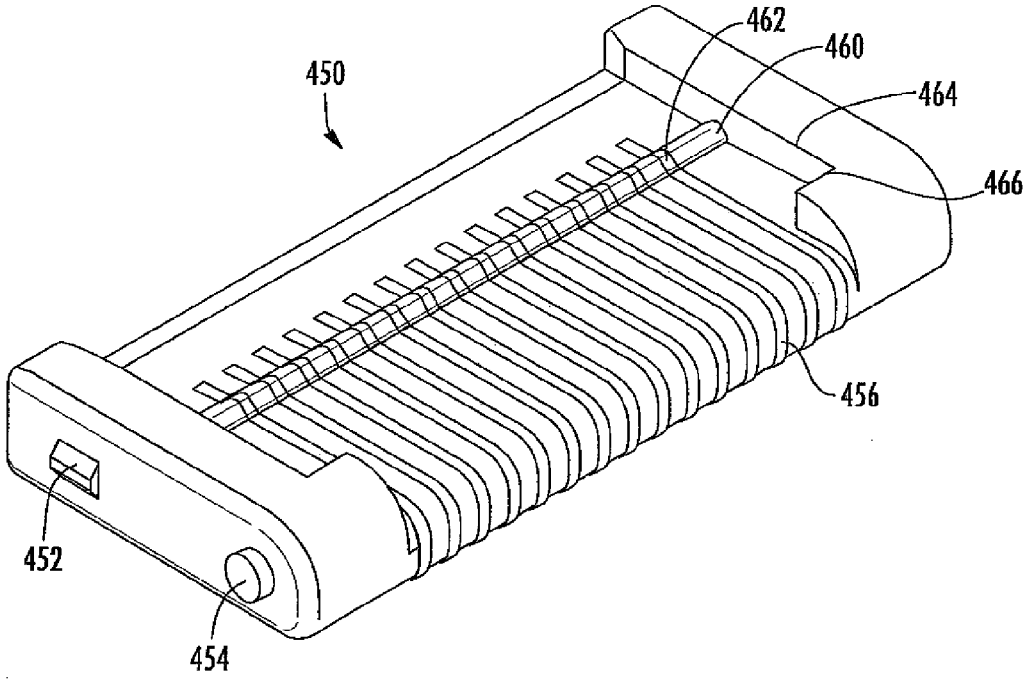
FIG. 4B is a perspective view of the interconnect connector of the FPC connector shown in FIG. 4.

Referring now to FIG. 4B, the FPC plug 450 is shown with the FPC substrate removed. The bump previously seen in FIG. 4A is now readily apparent as to its origins. Specifically, the FPC plug 450 comprises a ridge 460 in the cavity 464 that receives the FPC substrate. On this ridge 460 are the contact portions 462 of the contacts 456, which are adapted to engage respective ones of contacts located on the substrate. At the end of the cavity 464 are stops 466 which prevent the FPC substrate from being inserted too far.

Referring back to FIG. 4, it is can be seen that the ridge illustrated in FIG. 4B pushes upward on the substrate 490 so as to create the bump 458 seen in FIG. 4A. When the latch 401 is closed and locked onto the FPC plug 450, the FPC substrate 490 is compressed thereby making contact with the contact portions 462 located on the ridge 460. As discussed previously with regards to other embodiments above, the shape, length and width of the individual contacts 456 may readily be designed and manufactured in order to provide improved electrical performance such as impedance matching and the like.

Figure 4C:
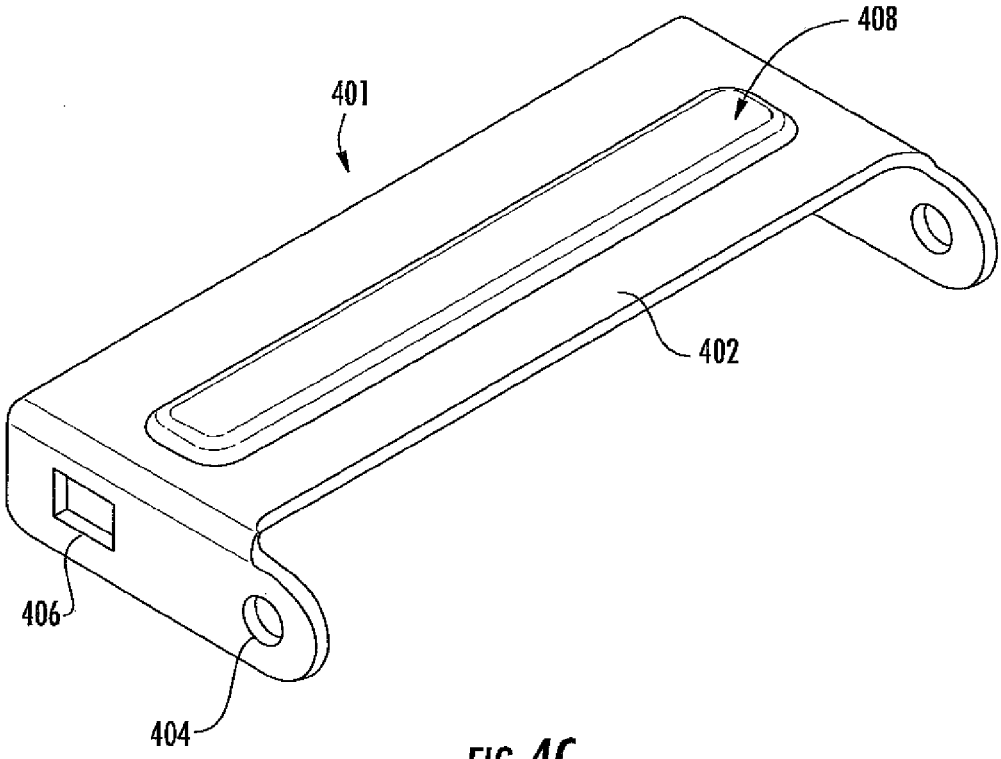
FIG. 4C is a perspective view of the latching cover of the FPC connector shown in FIG. 4.

FIG. 4C illustrates the latch 401 shown in FIG. 4. The latch preferably comprises a stamped metallic structure 402, but may also be made from an injection molded or other polymer or material if desired. The design considerations to be taken into account when choosing a suitable material for the latch 401 would be well understood by one of ordinary skill given the present disclosure, and accordingly are not discussed further herein. The latch further comprises a receptacle 404 adapted to rotate freely about the post 454 on the FPC plug 450. The latch also includes a receptacle 406 adapted to mate with the snap feature 452 on the FPC plug, thereby securing the latch in the closed position when closed fully. The latch also preferably includes clearance 408 to accommodate the bump 458 (FIG. 4A), so as to avoid damage the FPC substrate 490 while applying an appropriate amount of normal force to ensure a good electrical connection.

Figure 8:
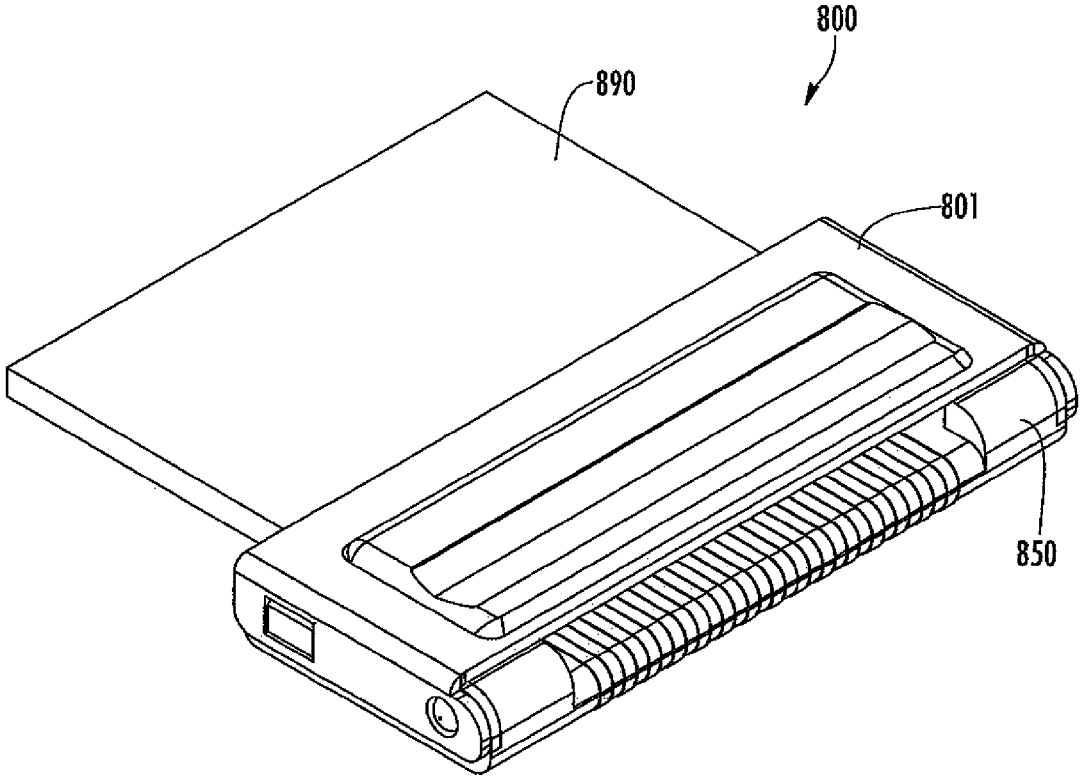
FIG. 8 is a perspective view of a second exemplary FPC connector manufactured in accordance with the principles of the present invention.

Referring now to FIG. 8, another exemplary FPC connector 800 embodiment is shown and described in detail. Similar to the embodiment described with regards to FIG. 4, the FPC connector 800 comprises an FPC plug 850, FPC latch 801 attached to the plug, and a FPC substrate 890 inserted between the latch and the plug. The FPC substrate 890 comprises a flexible printed circuit board of the type ubiquitous in the electronic arts and accordingly is not described further herein.

Figure 8A:
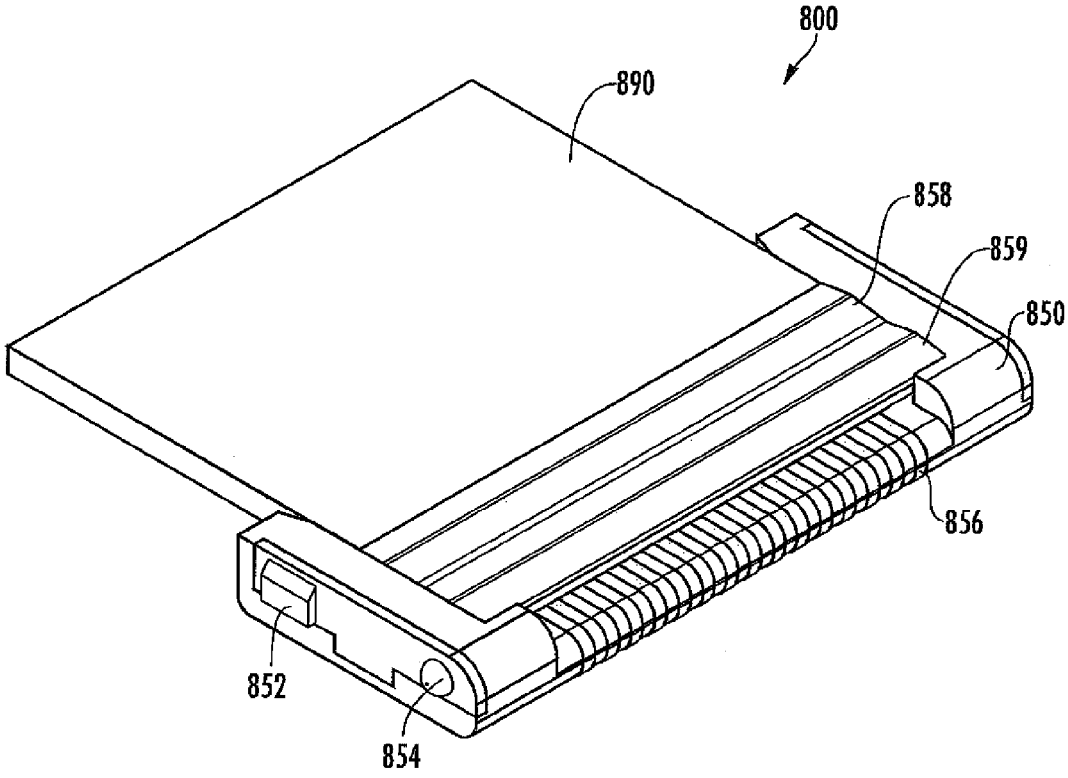
FIG. 8A is a perspective view of the FPC connector shown in FIG. 8 with the latching cover removed.

FIG. 8A illustrates the aforementioned FPC connector 800 with the latch removed. As can be seen, the FPC plug comprises an LDS polymer which permits the addition of accurately placed contacts 856. Similar to the configuration of FIG. 4, the FPC plug comprises two bumps 854 on which the latch can rotate, as well as a snap 852 which retains the latch in the locked position. In one exemplary embodiment, the portion of the plug that includes the contacts 856 may comprise an LDS polymer base material, while the portion of the plug that includes the post 854 and snap 852 comprises an ordinary non-LDS material. In this manner, the cost of the plug 850 can be reduced as the cost of an LDS polymer base material is typically higher than a non-LDS material. Also worthy of note are the bumps 858, 859 seen with the FPC substrate 890 placed on the plug 850. These features are similar in function to that illustrated in FIG. 4A (bump 458).

Figure 8B:
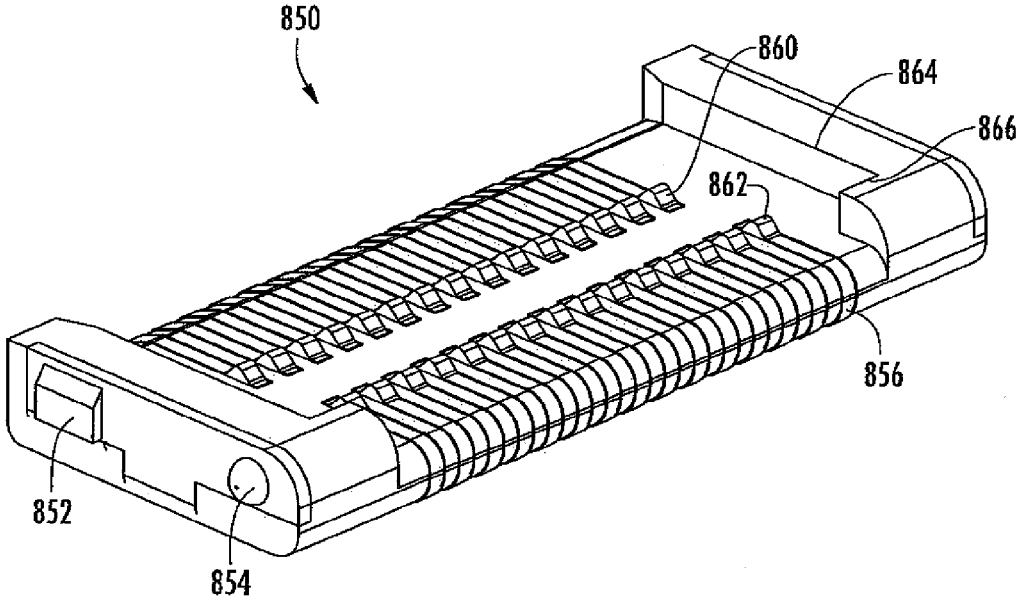
FIG. 8B is a perspective view of the interconnect connector of the FPC connector shown in FIG. 8.

Referring now to FIG. 8B, the FPC plug 850 is shown with the FPC substrate removed. The bump previously seen in FIG. 8A is now readily apparent as to its placement and origins. Specifically, the FPC plug 850 comprises a plurality of protrusions 860, 862 in the cavity 864 that receives the FPC substrate. On these protrusions 860, 862 are contact portions adapted to engage respective ones of contacts located on the substrate. At the end of the cavity 864 are stops 866 which prevent the FPC substrate from being inserted to far.

Referring back to FIG. 8, it is can be seen that the ridge illustrated in FIG. 8B pushes upward on the substrate 890 so as to create the bumps 858, 859 seen in FIG. 8A. When the latch 801 is closed and locked onto the FPC plug 850, the FPC substrate 890 is compressed, thereby making contact with the contact portions located on the protrusions 860, 862. As discussed previously with regards to other exemplary LDS embodiments above, the shape, length and width of the individual contacts may readily be designed and manufactured in order to provide desired properties and/or electrical performance, such as impedance matching and the like.

Figure 8C:
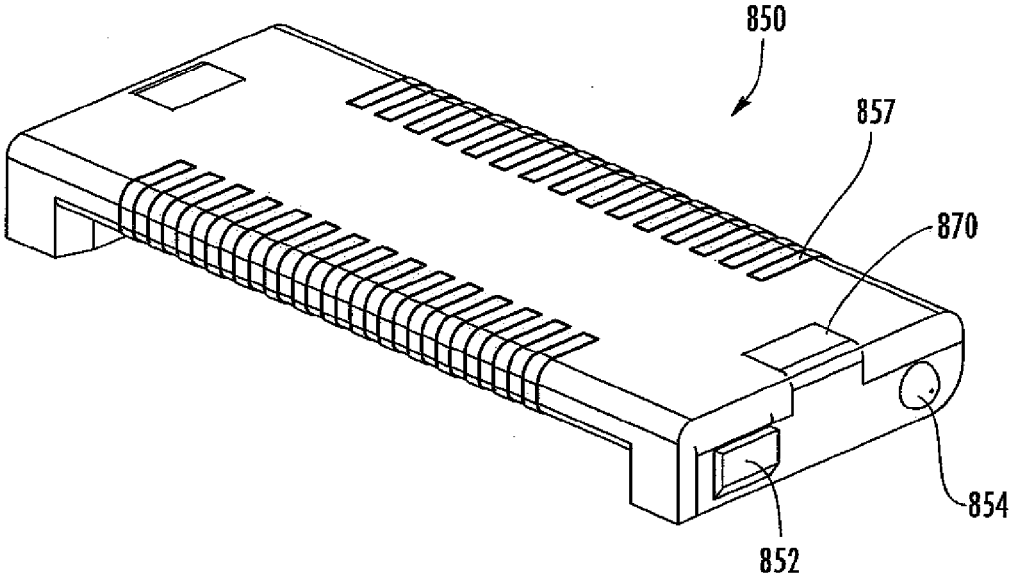
FIG. 8C is a perspective view of the underside of the interconnect connector of the FPC connector shown in FIG. 8B.

FIG. 8C illustrates the underside of the FPC plug 850 shown in FIG. 8B. The underside includes a plurality of contacts 857 as well as grounding connections 870. These grounding connections or contacts 870 are optional, but can improve electrical performance in certain applications such as high-speed data applications. Also of note is the fact that the contacts 857 reside on both ends of the FPC plug 850. This approach can improve the number of contacts per unit area for the FPC plug, providing increased electrical connection density for the connector.

Figure 8D:
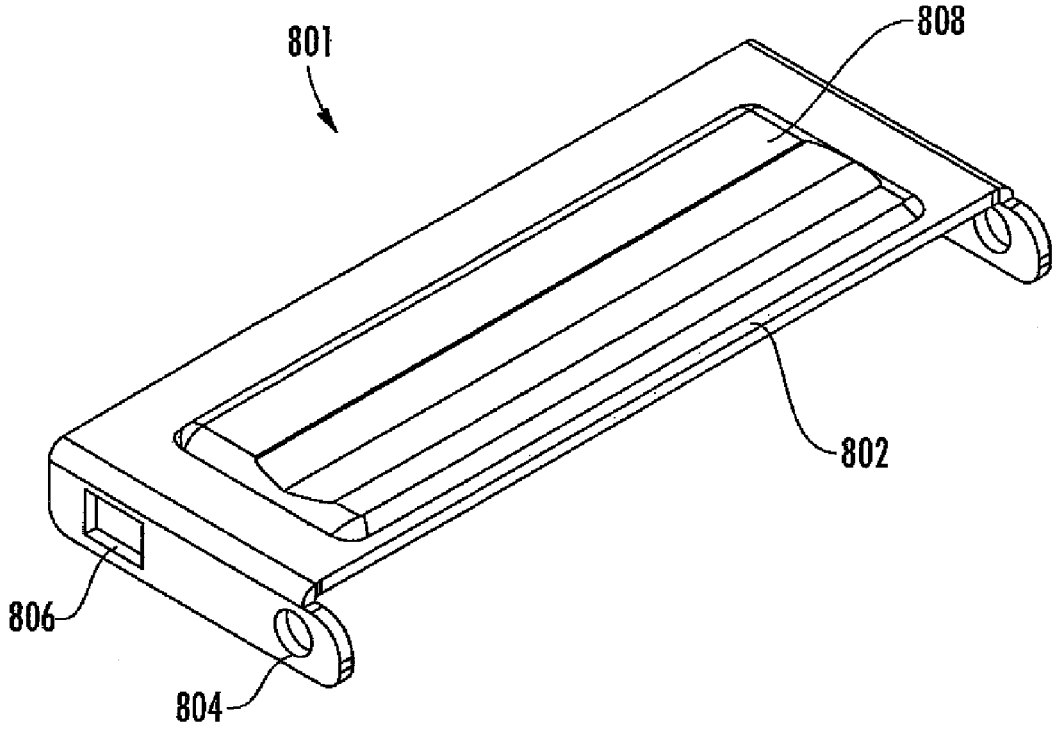
FIG. 8D is a perspective view of the latching cover of the FPC connector shown in FIG. 4.

FIG. 8D illustrates the latch 801 shown in FIG. 8. The latch preferably comprises a stamped metallic structure 802, similar to that described with reference to the latch 401 described in FIG. 4C, but may also be made from an injection-molded polymer or other material if desired. The design considerations to be taken into account when choosing a suitable material for the latch 801 would be well understood by one of ordinary skill given the present disclosure, and accordingly are not discussed further herein. The latch further comprises a receptacle 804 adapted to rotate freely about the bump 854 on the FPC plug 850. The latch also includes a receptacle 806 adapted to mate with the snap feature 852 on the FPC plug, thereby securing the latch in the closed position when closed fully. The latch also preferably includes sufficient clearance 808 to accommodate the bumps 858, 859 (FIG. 8A) so as to not damage the FPC substrate 890 while applying an appropriate amount of normal force to ensure a good electrical connector.

Figure 13:
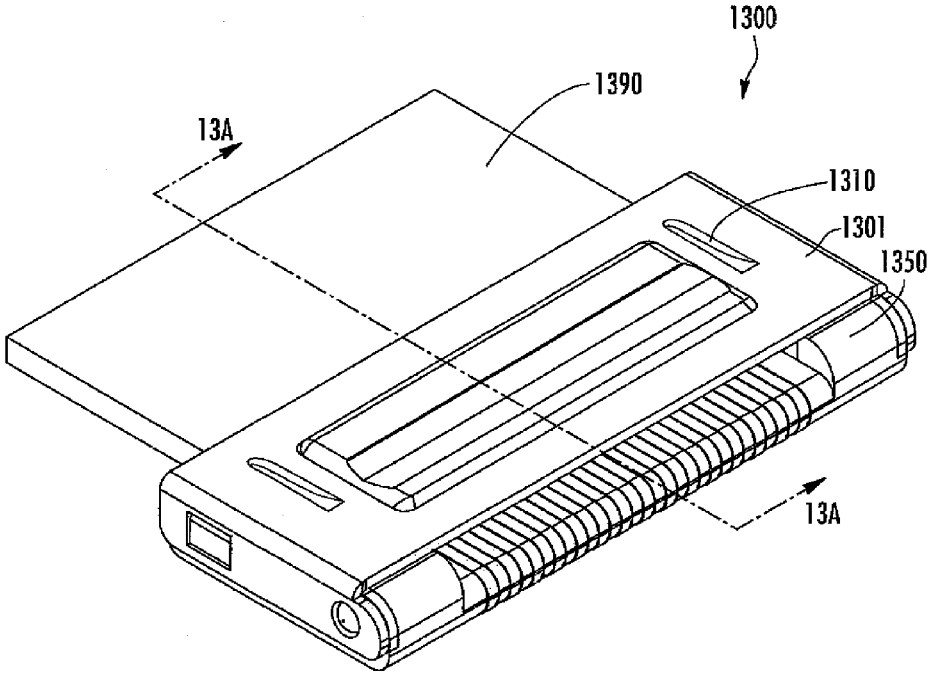
FIG. 13 is a perspective view of a third exemplary FPC connector manufactured in accordance with the principles of the present invention.

Referring now to FIG. 13, yet another exemplary FPC connector assembly 1300 embodiment is illustrated. Similar to the embodiments discussed above with respect to FIGS. 4 and 8, the FPC connector 1300 generally comprises an FPC plug 1350, a latch 1301 attached to the plug 1350 and a shielded substrate 1390. The shielded substrate 1390 is inserted between the latch 1301 and the plug 1350. Similar to the embodiments of FIGS. 4 and 8, the latch 1301 may comprise a stamped metallic structure, injection-molded polymer, or other suitable material.

However, unlike the latch 1301 embodiments previously described, the present embodiment comprises one or more grounding contacts 1310 incorporated into the latch itself. It is however recognized that the latch illustrated in FIG. 13 could readily be incorporated into other embodiments contemplated herein. The grounding contacts 1310 are formed in the latch 1301 as cut-outs which extend inward toward the plug portion 1350 when the latch 1301 is snapped thereon. The grounding contacts 1310 are used to ground to the shielded substrate 1390.

Figure 13A:
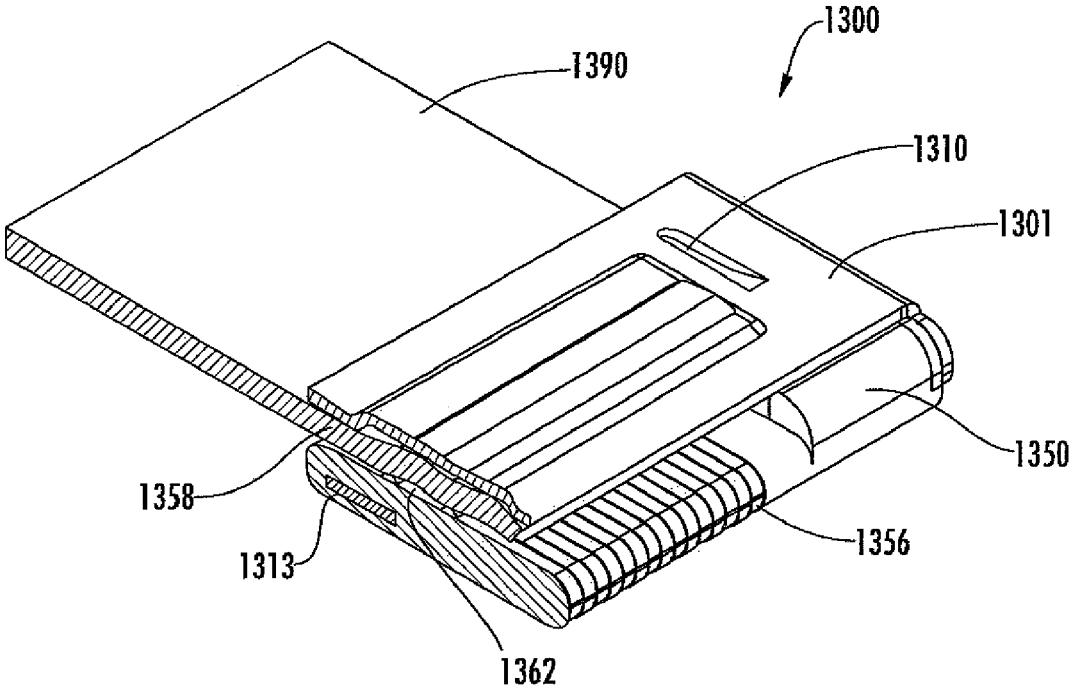
FIG. 13A is a cross-sectional view of the exemplary FPC connector of FIG. 13 taken along line 13A-13A.

FIG. 13A comprises a cross sectional view of the connector assembly 1300 of FIG. 13 taken along line 13A-13A. In an exemplary embodiment, the FPC plug 1350 comprises an LDS polymer having contacts 1356 disposed thereon using exemplary LDS processing techniques. As noted above, the dimensions and spacing between contacts 1356 as well as the shape, length and width of the individual contacts 1356 may be varied in order to provide improved electrical performance such as impedance matching and the like, across a variety of desired electrical performance characteristics.

As illustrated in FIG. 13A, and similar to the discussion of previous embodiments, the substrate 1390 is placed into electrical and mechanical contact with the FPC plug 1350 by virtue of the raised contact portions 1362 displacing the FPC substrate at 1358. The cross-sectional view of FIG. 13A also illustrates the grounding bar 1313 which will be described in greater detail below.

In another embodiment (not shown), the FPC plug 1350 further comprises a ferrite core integrated into the body of the plug 1350. The ferrite core acts as a filter with respect to electromagnetic noise that could otherwise affect the FPC connector. In another alternative embodiment (not shown), metal shielding is integrated into the body of the plug 1350 in a substantially more widespread manner than the embodiment shown with respect to FIG. 13A. This metal shielding is utilized to isolate electromagnetic noise to and/or from the FPC connector assembly 1300.

Figure 13B:
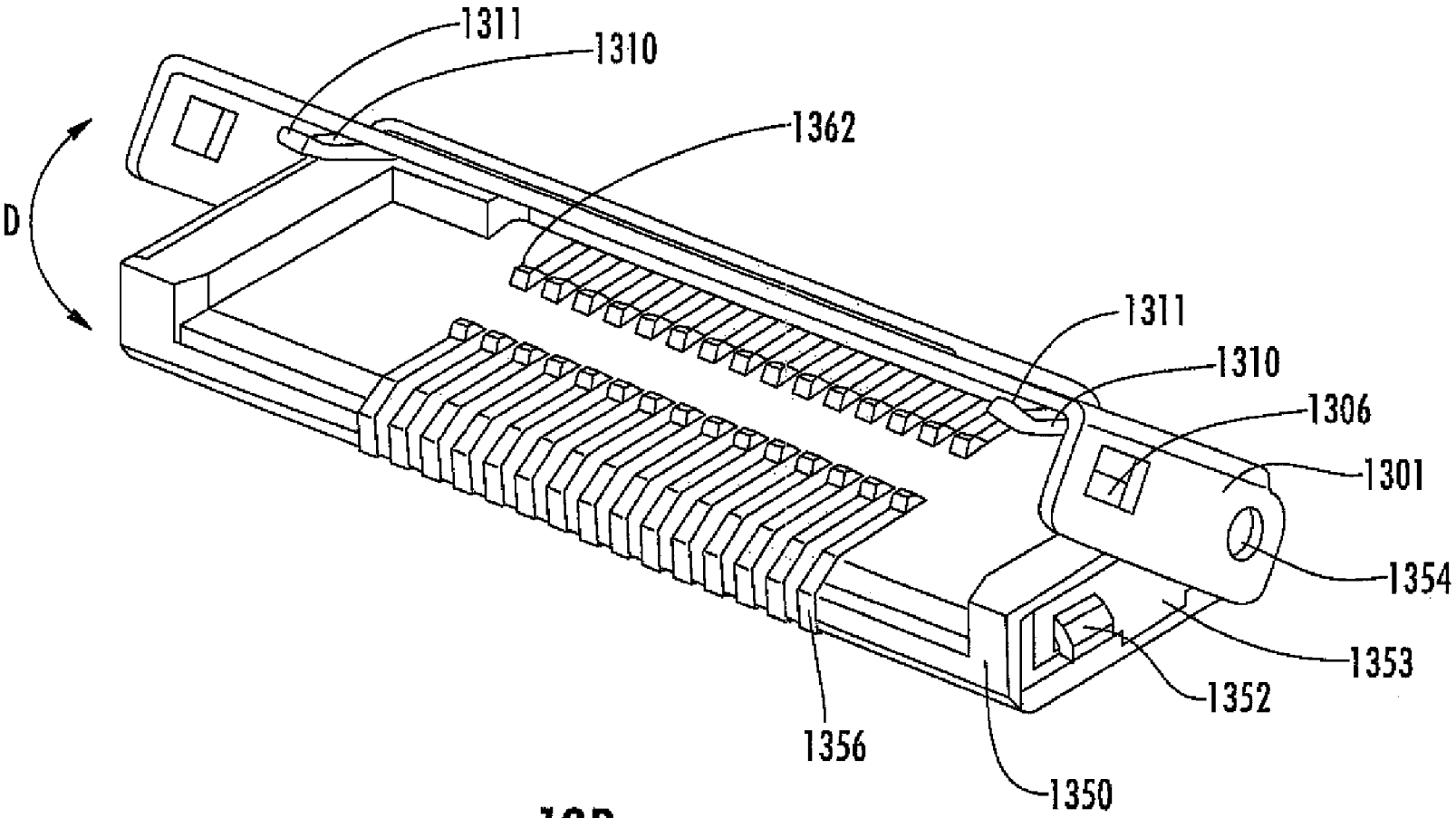
FIG. 13B is a perspective view of the FPC connector of FIG. 13 having the latch opened away from the plug portion.

FIG. 13B illustrates the connector assembly 1300 with the FPC substrate 1390 removed. Specifically, FIG. 13B illustrates the ability of the latch 1301 to rotate about the post 1354 in the direction (given by arrow "D"). The latch 1350 also includes a receptacle 1306 adapted to mate with the snap feature 1352 on the grounding bar (FIG. 13C) attached to the FPC plug 1350, thereby securing the latch in the closed position when closed fully. Also better illustrated in FIG. 13B are the underside of grounding contacts 1310 that comprise one or more legs which extend below the surface of the latch 1301. When the latch 1350 is in the closed position, the foot 1311 of each grounding contact 1310 comes into contact with the body of a shielded substrate received within the plug 1350. Thus, when the latch 1301 is securely closed against the plug 1350, the assembly 1300 is grounded. A grounding bar 1353 is also shown in FIG. 13B. The grounding bar 1353 is adapted to be integrated within a portion of the plug 1350.

Figure 13C:
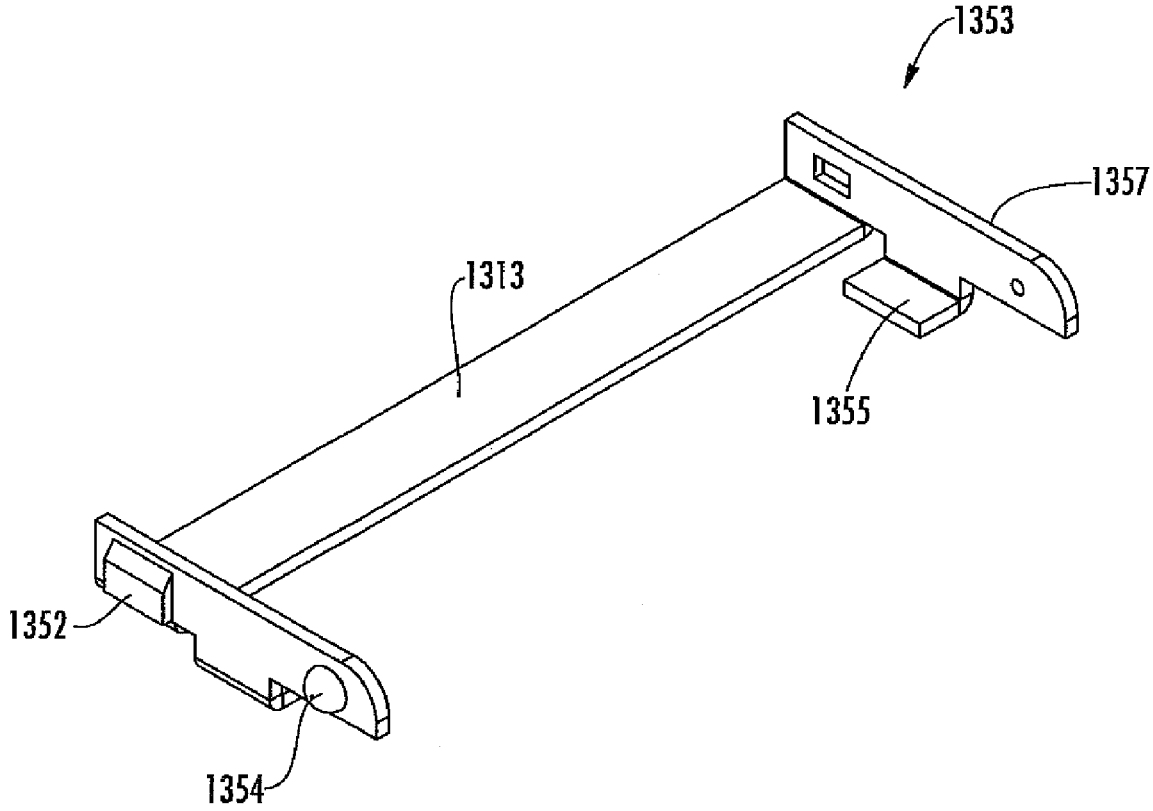
FIG. 13C is a perspective view of an exemplary grounding bar for use with the plug portion of the exemplary FPC connector of FIG. 13.
Figure 13D:
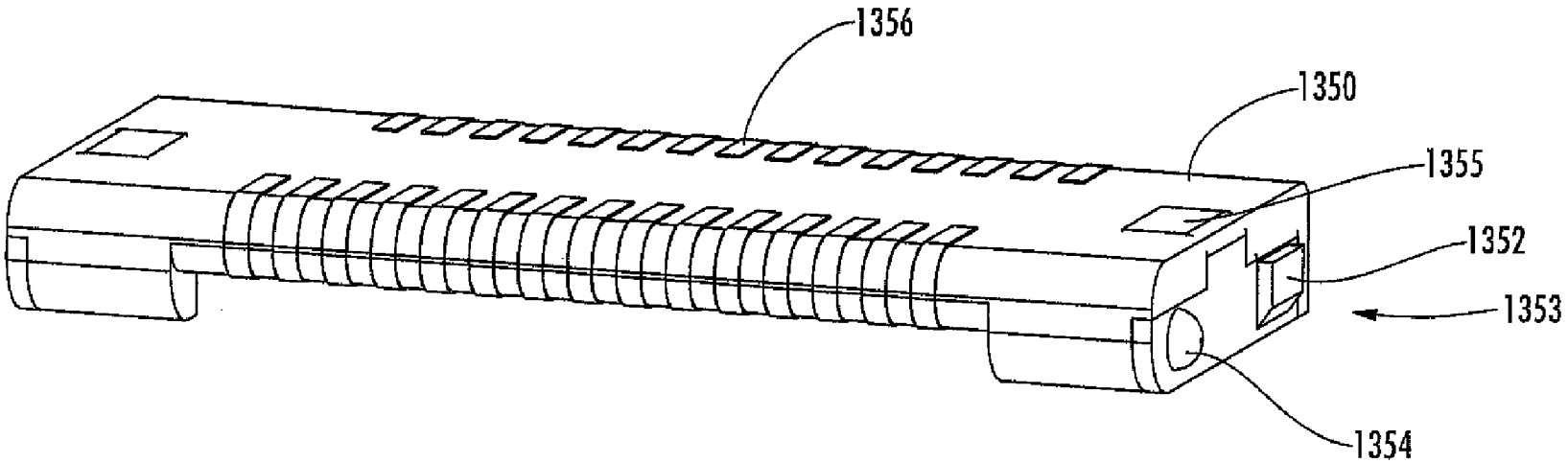
FIG. 13D is a perspective view of the underside of the exemplary grounding bar disposed on the plug of the exemplary FPC connector of FIG. 13.

As illustrated in FIG. 13C, the grounding bar 1353 comprises in an exemplary embodiment two arms 1357, each arm 1357 disposed on one side of the plug 1350 body. In addition, the snap features 1352 and posts 1354 with which the latch 1301 associates are formed on the grounding bar arms 1357, which facilitates grounding between the grounding bar 1353 and the latch 1301. The grounding bar arms 1357 illustrated also further comprise grounding tabs 1355 for connection to an external ground. These grounding tabs are illustrated integrated into the plug portion 1350 of the FPC connector in FIG. 13D. As shown in FIG. 13D, when the grounding bar 1353 is integrated into the plug 1350 body, the tabs 1355 form at least a portion of the bottom surface of the plug 1350. In other words, the tabs 1355 are exposed on the bottom surface of the plug 1350 to be grounded to an external entity with which the assembly 1300 connects.

Referring again to FIG. 13C, the grounding bar 1353 further comprises a feature 1313 which links the two arms 1357 by passing through the interior of the body of the plug 1350. This connecting feature 1313 advantageously provides additional EMI shielding for the assembly 1300.

Figure 13E:
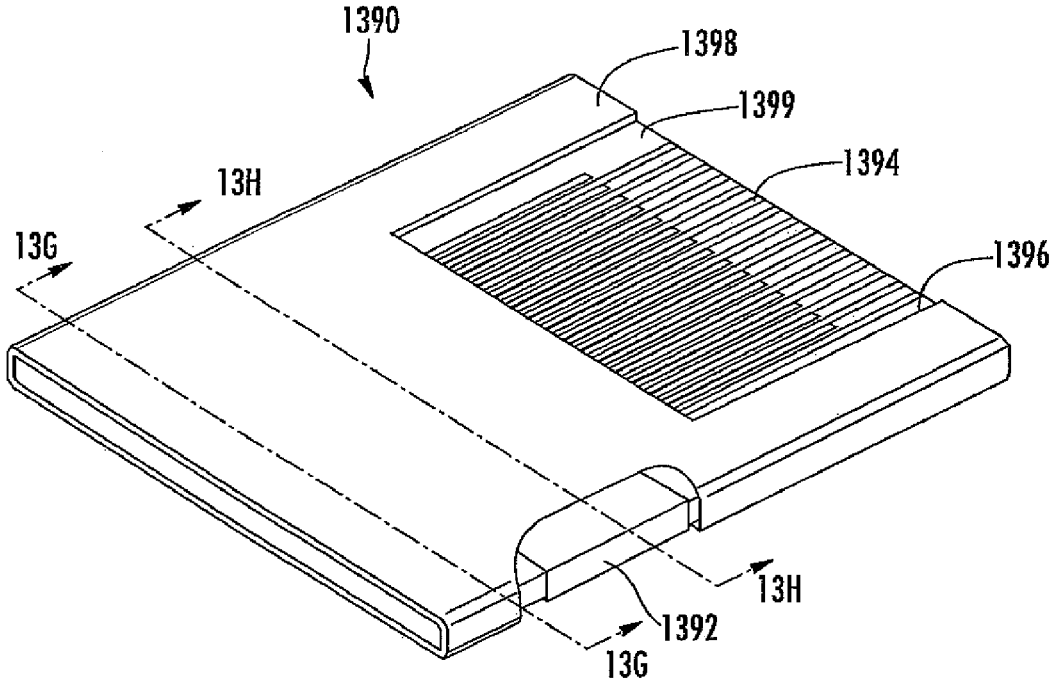
FIG. 13E is a perspective view of the underside of an exemplary shielded substrate for use with the exemplary FPC connector of FIG. 13.

Referring now to FIG. 13E, a perspective view of the shielded substrate 1390 is shown. As illustrated, the shielded substrate 1390 generally comprises an EMI or Faraday shield 1398 which encases a substantial portion of a flexible PCB substrate 1399. The flexible PCB substrate 1399 illustrated in FIG. 13E comprises a plurality of electrical traces 1394 disposed thereon. In addition, an open portion 1396 of the shielded substrate 1390 is not encased by the shield 1398, so as to enable that portion to be inserted into the plug 1350 and to enable the electrical traces 1394 to electrically contact the contacts 1356 of the plug 1350. FIG. 13E also illustrates a portion of the shield 1398 of the exemplary substrate 1390, cut away to reveal the ferrite "ring" 1392 which, in the illustrated embodiment, substantially encircles or surrounds a section of the substrate 1399 to further assist in reducing the effects of EMI. It will be appreciated however that the shield 1398 is not intended, in the embodiment illustrated, to leave any portion of the ferrite ring 1392 exposed, and rather the cutaway view is merely shown to illustrate the manufacture of the shielded substrate. It will also be recognized that materials other than ferrite (e.g., tin- or copper-based alloys, etc.) may feasibly be used for forming the ring 1392, such materials being readily identified and implemented by those of ordinary skill in the electronic arts.

Figure 13F:
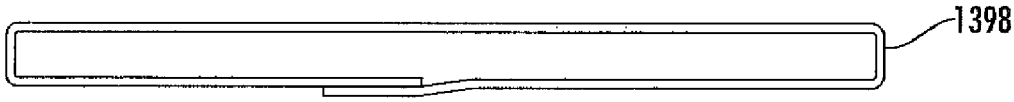
FIG. 13F is a cross-sectional view of the shielded substrate of FIG. 13E taken along line 13G-13G.
Figure 13G:
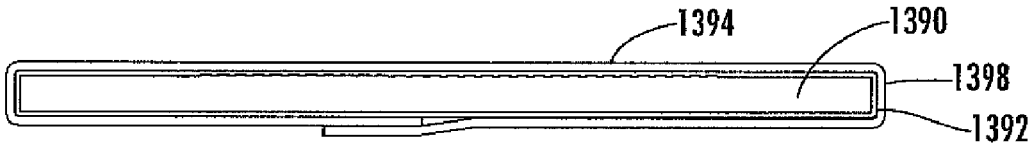
FIG. 13G is a cross-sectional view of the shielded substrate of FIG. 13E taken along line 13H-13H.

FIGS. 13F and 13G detail cross sectional views of the shielded substrate taken along line 13G-13G and line 13H-13H, respectively, as illustrated in FIG. 13E. A cross sectional view of the shield 1398 utilized to encase the substrate 1399 is given in FIG. 13F. For purposes of clarity, the FPC substrate 1399 has been removed from the view illustrated in FIG. 13E. In one exemplary embodiment, the shield 1398 comprises a flexible conductive material, such as an aluminum- or alloy-based foil, that is suitable for reducing interference.

A cross section of the substrate 1390 surrounded by the ferrite ring 1392 and the EMI shield 1398 is illustrated in FIG. 13G. In one embodiment, the ferrite ring 1392 does not completely encircle the substrate 1390, but rather covers only that portion of the substrate which does not have electrical traces 1394 thereon (i.e., does not cover over the electrical traces 1394). As is further illustrated in the cross sectional views of FIGS. 13E and 13F, the EMI shield 1398 is, in one embodiment, adapted to overlap itself by a specified amount. This overlap ensures that there will be no gaps or seams in the coverage of the shield 1398. In one embodiment, the overlapped section may extend along the entire length of the substrate. Alternatively, the overlap may only extend along a portion of the length of the substrate 1390.

Alternate Connector Embodiments—

While the above-mentioned embodiments were primarily discussed in the context of the exemplary LDS manufacturing technique, other alternate techniques consistent with the principles discussed above are contemplated as well.

For example, an exemplary alternative processing technique known as "laser flashing" may be utilized in certain embodiments. While the aforementioned LDS technique scans along a programmed path in order to activate specified regions providing a flexible and precise process, the equipment tends to be expensive and the processing times needed are not suitable for all products and end applications. Accordingly, by using the laser flashing process, the LDS polymer can be injection molded into a predefined shape, this predefined shape mimicking the outline of the final conductive paths desired. This may be accomplished by, inter alia, a two-shot injection molding process which takes a pre-formed base material (non-LDS) and over-molding the LDS polymer on top of that non-LDS base material. This non-LDS base material may comprise any number of materials including, without limitation, metals, composites, and polymers. Subsequently, a broad area light source (having the same or similar light wavelength of the LDS laser) is flashed onto the product, thereby activating all the exposed surfaces of the LDS material simultaneously. This broad area approach provides simultaneous exposure of larger areas as compared to the more "pinpoint" nature of the LDS laser exposure (somewhat akin to UV or "optical" wavelength exposures versus electron beam lithography, respectively, used in IC lithography processes). Subsequent chemical deposition processes can then be utilized to plate the activated LDS material. This "broad area" process has the advantage in that it can be performed quicker, in many embodiments, than a traditional LDS scanning processing technique; however, there are limitations and other considerations well known to those of ordinary skill in the adherence of the over-molded LDS material onto the non-LDS base material, as well as the size and shapes of the resultant products. However, it will also be recognized that the two processes can be used in complimentary fashion as well; e.g., one process optimized for certain portions of the device, and the other process for others.

Another alternate processing technique that can be utilized is the so-called 3 dimensional molded plated substrate (3DMPS™) process utilized by APEX Technologies, Inc. of Morrisville, N.C. (see http://www.3dcircuits.com, incorporated herein by reference in its entirety) that patterns conductive pathways onto mineral-based plastics. The 3DMPS process requires masking, and a subsequent chemical deposition process that plates conductive structures directly onto the plastic base material. This process can be utilized in both composite and non-composite structures as described previously herein.

In other embodiments (particularly desirable in large volume applications), the utilization of a "spray" process may be utilized. The spray process comprises dissolving a polymer (plastic) material in a solvent so that it exists in a liquid state at first. The dissolved plastic material is then sprayed onto a metal sheet (such as the above described composite structure) and allowed to cure, thereby completing the connector design.

Board-to-Board Alternate Embodiments—

Figure 7:
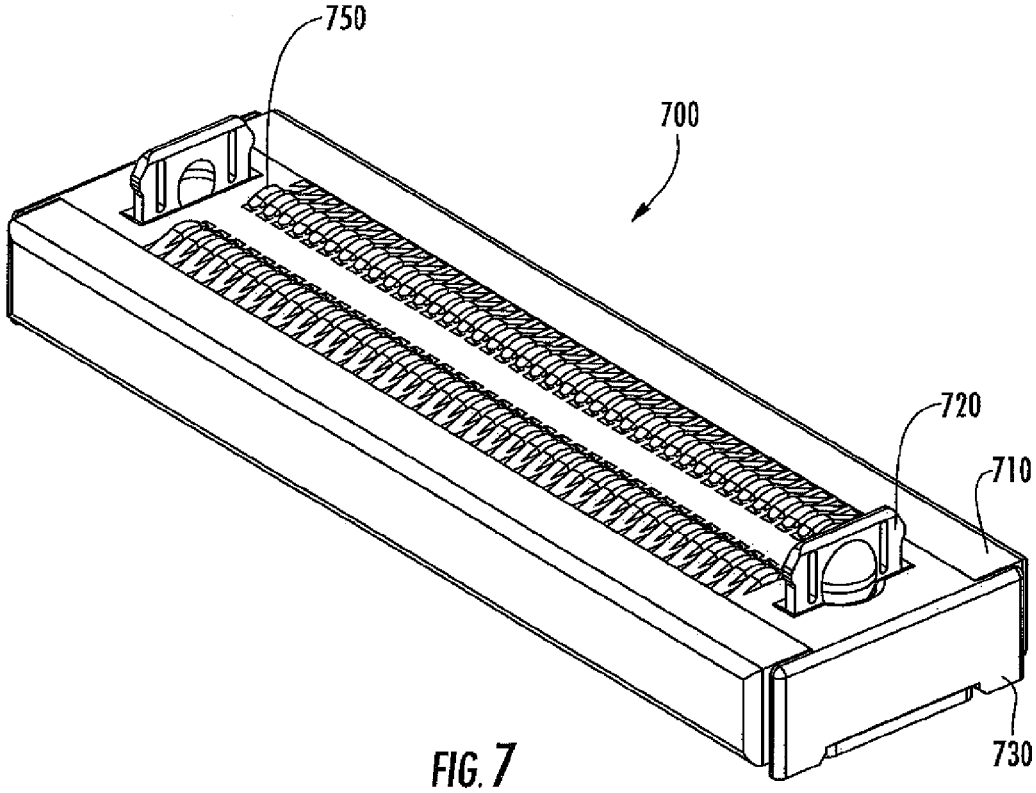
FIG. 7 is a perspective view of a fifth exemplary interconnect connector manufactured in accordance with the principles of the present invention.
Figure 7A:
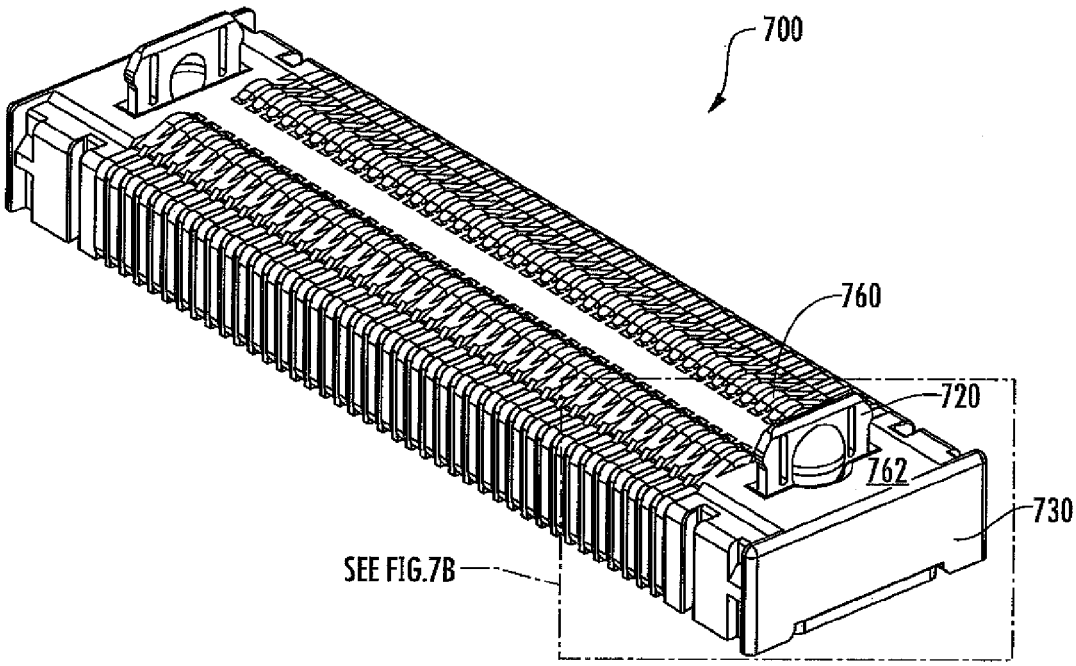
FIG. 7A is a perspective view of the interconnect connector of FIG. 7 with the fasteners removed.

Referring now to FIG. 7, an exemplary alternate board-to-board connector 700 is illustrated which does not require the use of the aforementioned LDS manufacturing process for the contacts as previously described herein. The connector comprises a base housing 730 preferably made from a non-conductive polymer base, a plurality of contacts 760, a pair of hold-down elements 720 and a pair of fasteners 710. The base housing 730 is adapted to, among other things, support the contacts 760 as well as provide electrical isolation between adjacent contacts. The hold-down elements 720 are preferably made from a metallic base material and are utilized to engage opposing substrates in the exemplary board-to-board connector application. The fasteners 710 are adapted to support the contacts within the housing as well as provide isolation to external electronic circuitry. FIG. 7A illustrates the board-to-board connector 700 with the fasteners removed and also showing the top surface 762 of which an adjacent substrate (not shown) is to be mounted.

Figure 7B:
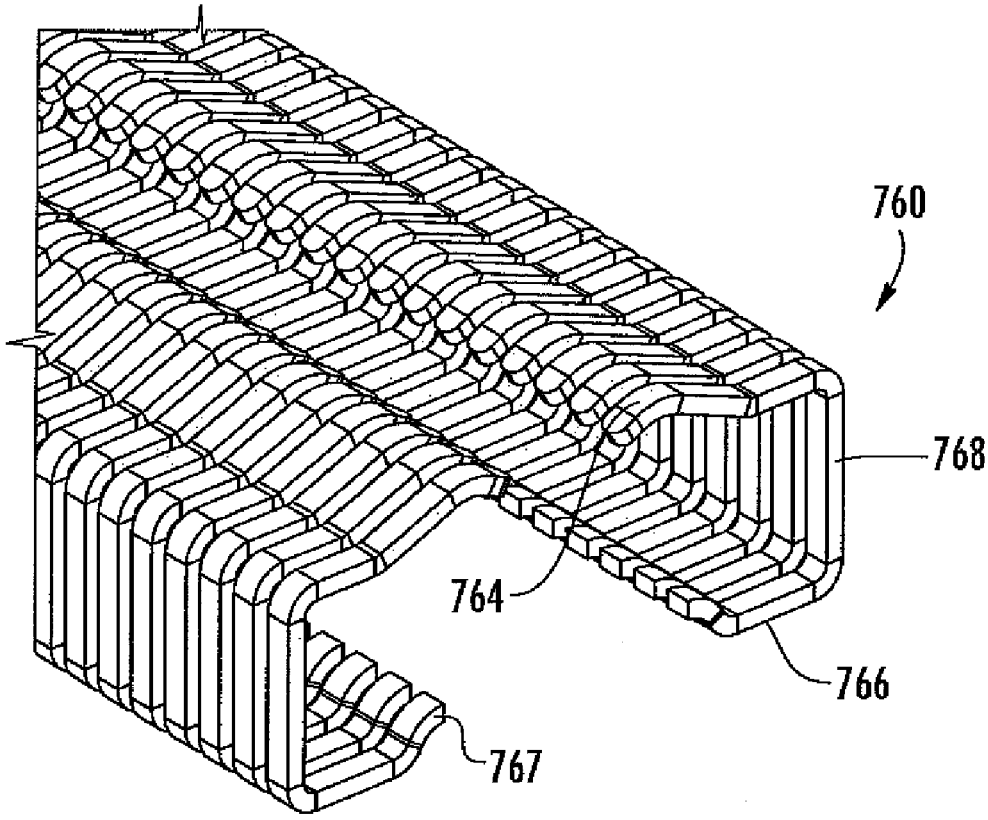
FIG. 7B is a detailed perspective view of the contacts of the interconnect connector of FIG. 7.

FIG. 7B illustrates a detailed view of the contacts 760 with the housing removed for purposes of clarity. As can be seen in FIG. 7B, the contacts 760 generally comprise an alloy base material that have been formed into a "C" shape with a top contact portion 764 and a bottom contact portion 766 and a portion 768 connecting the two contact portions. The top contact portion 764, in one exemplary embodiment, bows upward in order to provide increased normal force when an adjacent substrate is placed into contact therewith. The bottom contact portion 766 comprises a curved portion 767 at an end thereof which facilitates the retention of the contacts within the housing. In one exemplary embodiment, these contacts 760 are stamped and formed from flat metal stock using techniques well understood in the metal contact forming arts.

Figure 7C:
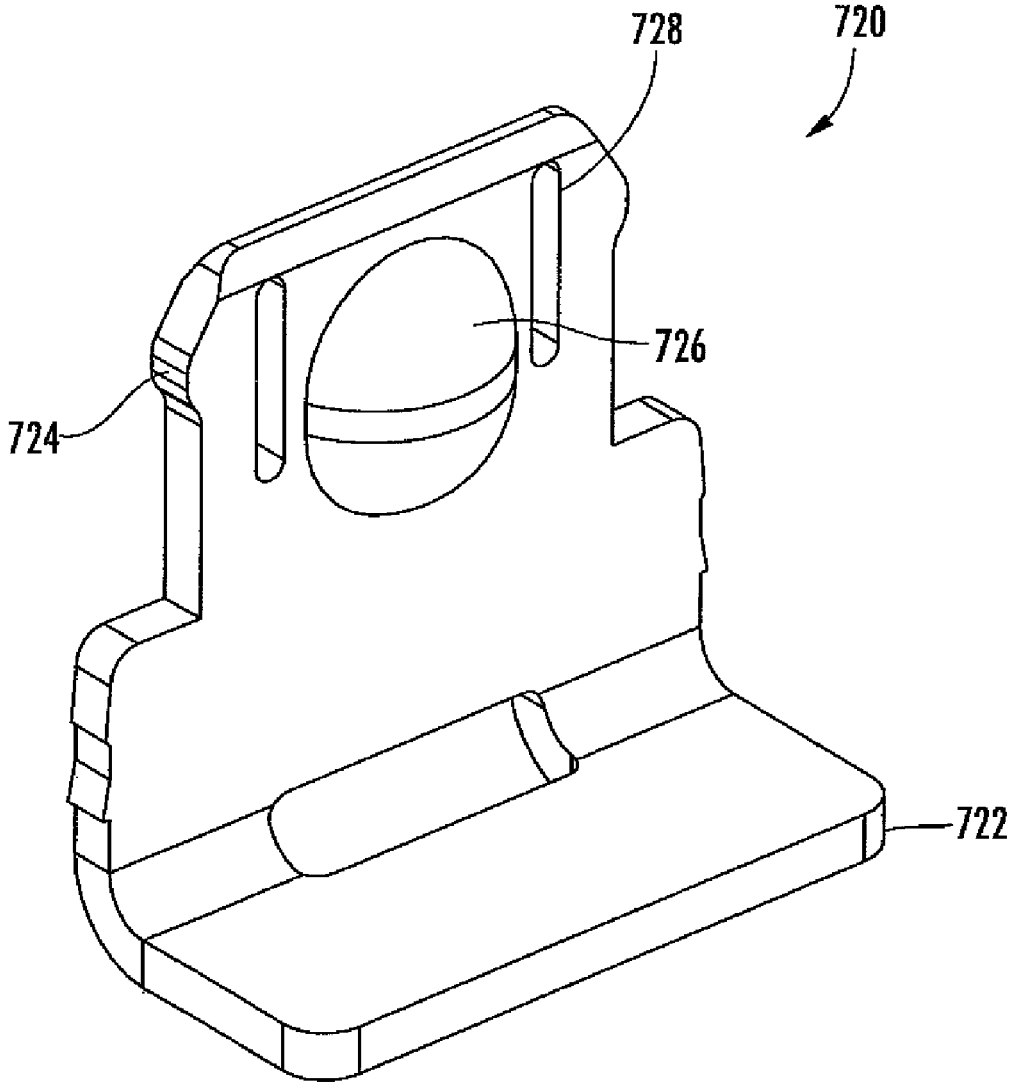
FIG. 7C is a perspective view of the hold down clips of the interconnect connector of FIG. 7.
Figure 7D:
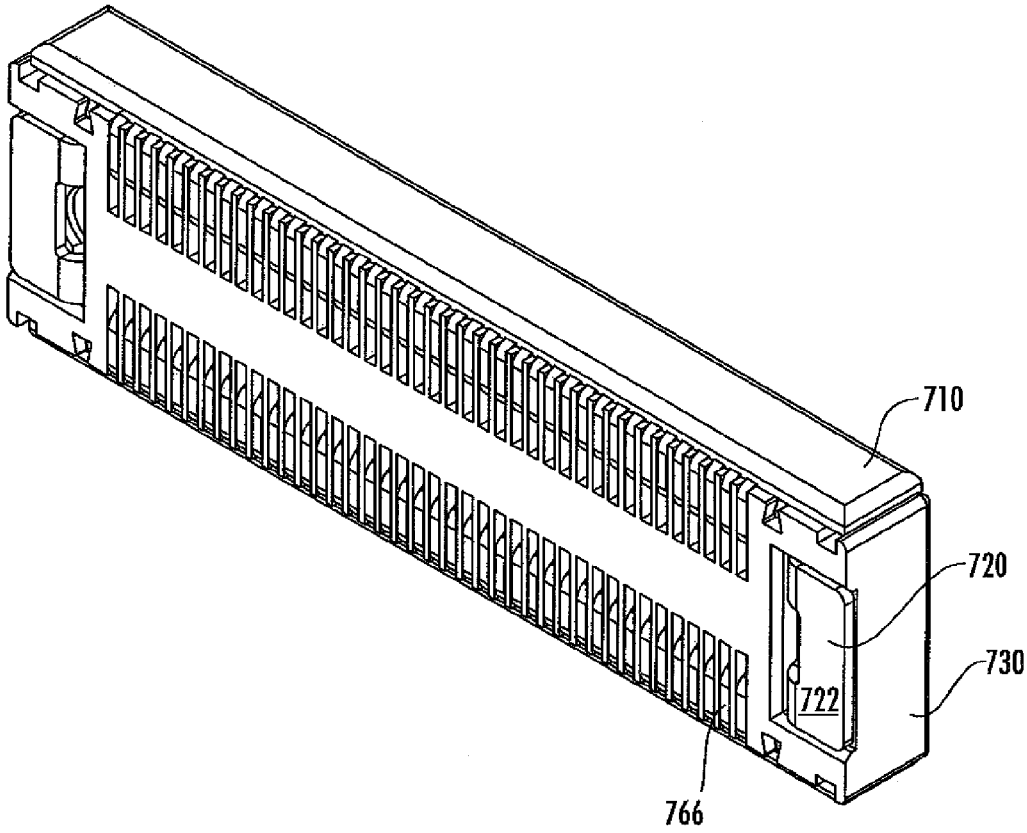
FIG. 7D is a perspective view of the underside of the interconnect connector of FIG. 7.

FIG. 7C illustrates an exemplary hold-down element 720 useful for the present board-to-board connector. In an exemplary embodiment, the hold-down element comprises a stamped and formed metallic base material which can also be utilized not only for retention, but for grounding as well. It is however recognized that some embodiments can be readily adapted for other manufacturing processes, such as injection molding, transfer molding, and the like. The illustrated embodiment of the hold-down elements comprise a plurality of tapered features 724 for guiding inserted substrates in the transverse direction, while the ball features 726 provide guidance in the longitudinal direction. Slots 725 are inserted to adjust the amount of locking force that is applied when a substrate is inserted over the hold-down element, while the base surface 722 of the hold-down element is utilized for soldering to an adjacent substrate surface. FIG. 7D illustrates all of the contact portions located on the underside of the connector (including signal contacts 766) and base surface 722.

Figure 7E:
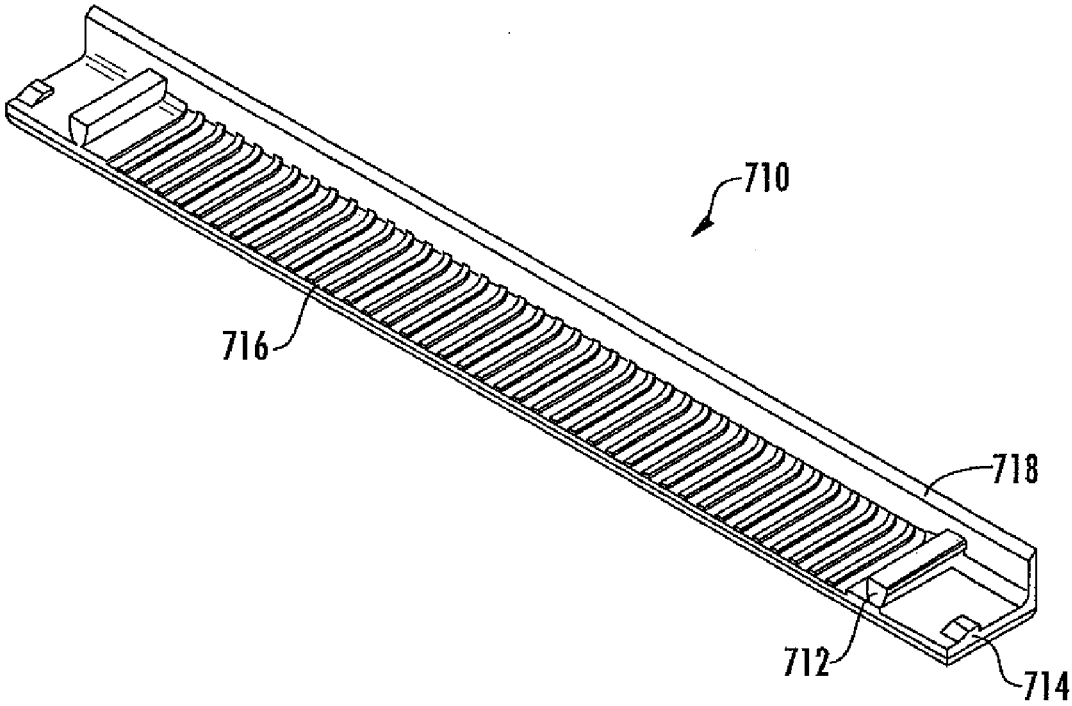
FIG. 7E is a perspective view of the fasteners of the interconnect connector of FIG. 7.
Figure 7F:
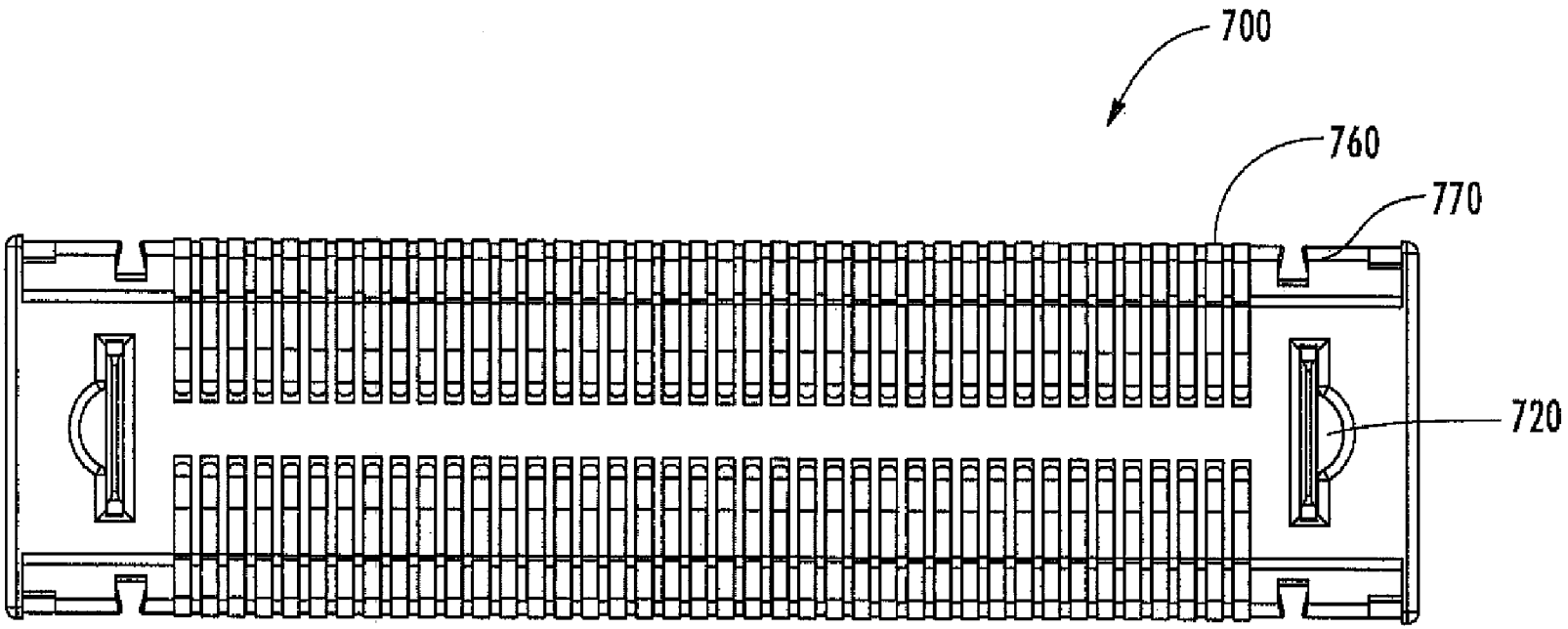
FIG. 7F is a top plan view of the interconnect connector of FIG. 7A with the fasteners removed.

Referring now to FIG. 7E, one embodiment of a fastener 710 useful with the connector is illustrated. The fastener comprises a generally L-shaped polymer base 718 manufactured using well known injection molding techniques (although other approaches may be used with success). The fastener further comprises a plurality of indentations 716 which generally guide and support the contacts 760 inserted in the housing. Dovetail features 712 are adapted to be received within respective cavities 770 (FIG. 7F), while snap features 714 engage with respective features on the housing thereby retaining the fasteners onto the housing.

Method of Manufacturing

Figure 9:
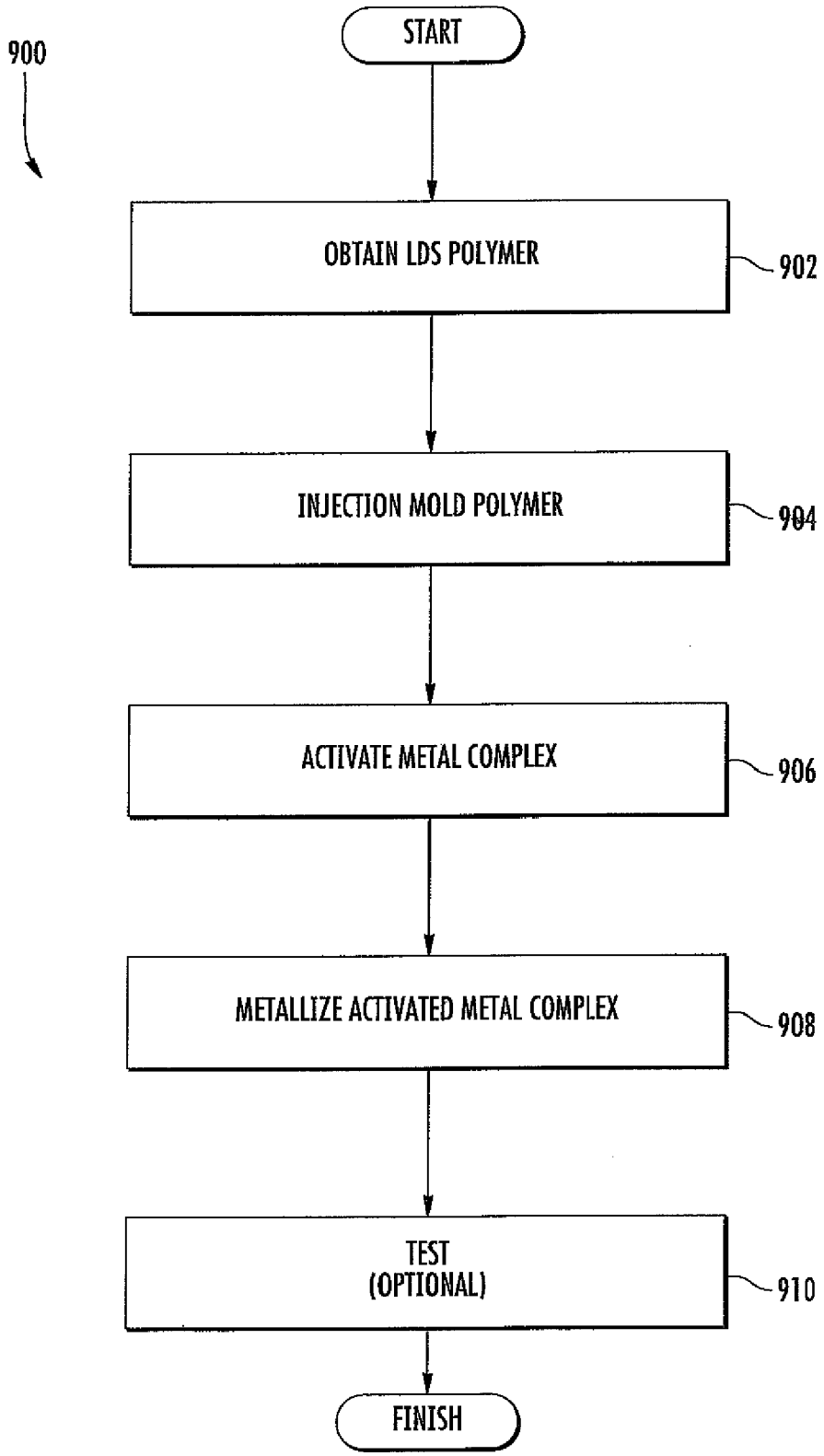
FIG. 9 is a process flow diagram illustrating a first exemplary embodiment of the method of manufacturing the interconnect connector shown in, for example, FIG. 1.

Referring to FIG. 9, one embodiment of the generalized method 900 for manufacturing an LDS interconnect connector is illustrated and described.

At step 902, an LDS polymer is selected. Selection criteria for LDS polymer, as previously discussed, may comprise any number of different design considerations including without limitation physical characteristics like strength, hardness, fatigue properties or resistance to heat, electrical characteristics such as withstand voltage or impedance, or any combination thereof. The LDS polymer is embedded with an organic metal complex (typically iron, referred to as ferro-organic), and doped in a manner commonly known to those skilled in the art.

At step 904, the LDS polymer is injection molded into the shape of the desired interconnect connector. In one previously described exemplary embodiment (FIG. 1, which illustrates a plug-receptacle construction of the interconnect connector), both the plug 101 and receptacle 150 of the interconnect connector are injection molded from the selected LDS polymer. In another previously described exemplary embodiment (FIG. 2, which illustrates an interconnect connector 201 mating to a support structure 250 of FIG. 2C), only the interconnect connector need be constructed from the LDS polymer. The support structure, as described, is not designed for electrical contact; therefore, the support structure may also be constructed of the same LDS polymer, but is not required.

At step 906, the injection-molded components are processed to activate the embedded metal organic complex. The metal organic complex is lased with a focused laser beam (e.g., a diode-pumped IR laser with a wavelength of 1,064 nm operating at a pulse repetition rate between 1 kHz and 100 kHz with a minimum beam diameter of forty (40) microns). The laser energy frees the metal ions from their organic ligands, preparing the metal organic complex for the electro-less plating process and subsequent plating steps.

At step 908, the activated metal organic complex is metallized to provide circuit tracks in the etched pattern. While copper is typically used to create tracks and paths, in many cases other additives (e.g. nickel and gold) are used for additional physical properties. While electro-less plating is commonly used, it is recognized that many other plating technologies, known to one with ordinary skill in the arts, could be used as well consistent with the present invention.

At step 910, the finished product is optionally tested for one or more electrical functions or properties such as e.g., shorts or discontinuities ("opens") or similar manufacturing problems.

Figure 10:
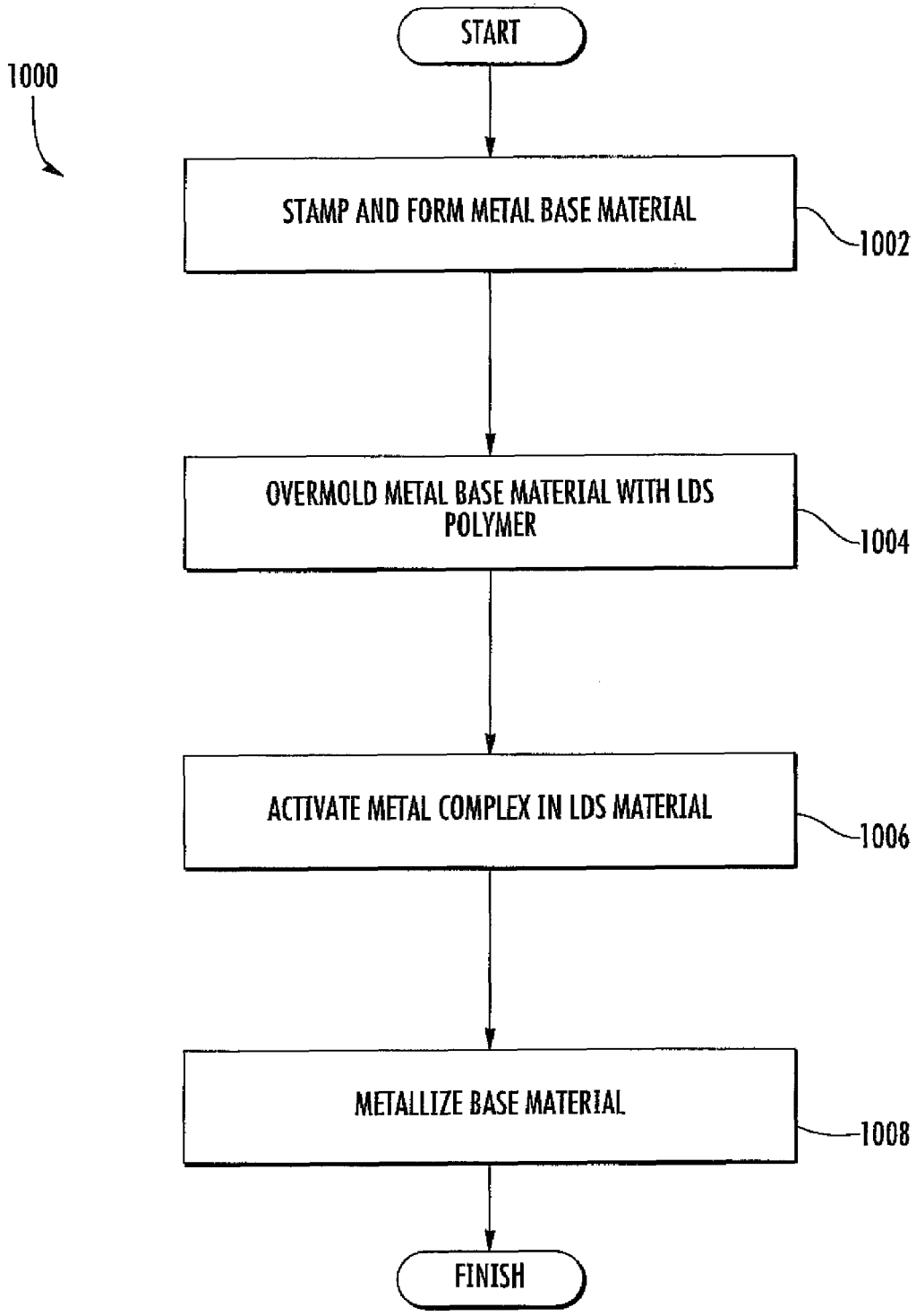
FIG. 10 is a process flow diagram illustrating a first exemplary embodiment of the method of manufacturing the composite interconnect connector shown in FIG. 3.
Figure 11:
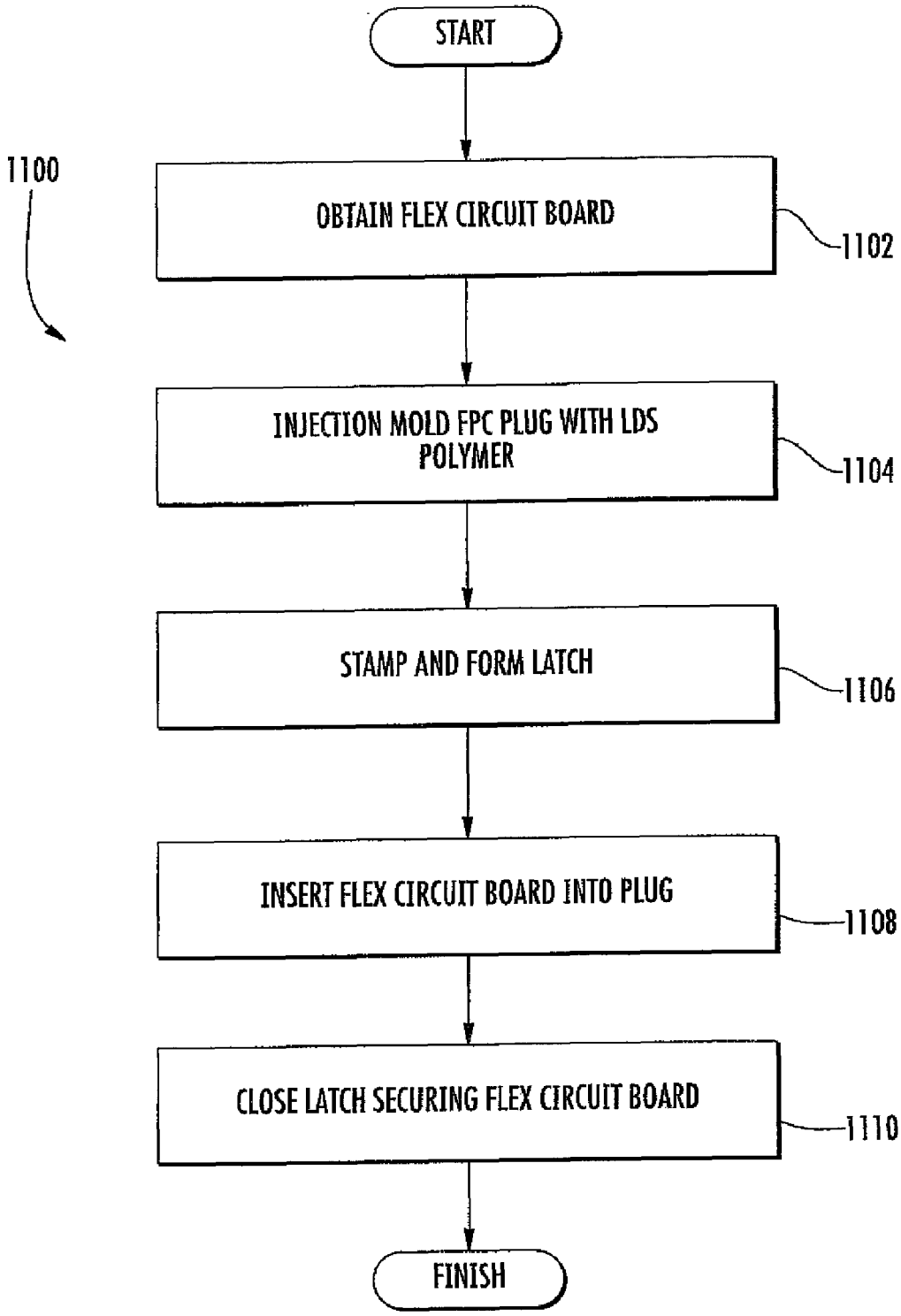

Referring now to FIG. 10, one embodiment of the generalized method for manufacturing the special case composite LDS interconnect connector 1000 is illustrated.

At step 1002, a metal disk substructure is constructed. Referring to the exemplary construction of FIG. 3C, the metal base 304 is stamped and formed, although other known construction techniques (such as drawing, forging, etc.) may be utilized if desired. Selection criteria for the metal disk substructure may include for example physical attributes of the metal (e.g. strength, flexibility, etc.).

At step 1004, the metal base substructure is over-molded with a selected LDS polymer 302 (selection of LDS materials requires similar considerations and constraints as step 502 previously described).

At step 1006, the injection molded components are processed to activate the metal complex embedded similar to that described with regards to step 908 at FIG. 9. At step 1008, the activated metal organic complex is metallized to provide circuit tracks in the lased pattern; as known to those of ordinary skill, special processing considerations may be necessary for immersive processes (e.g. electro-less plating, etc.) in consideration of the composite material assembly.

Figure 11:
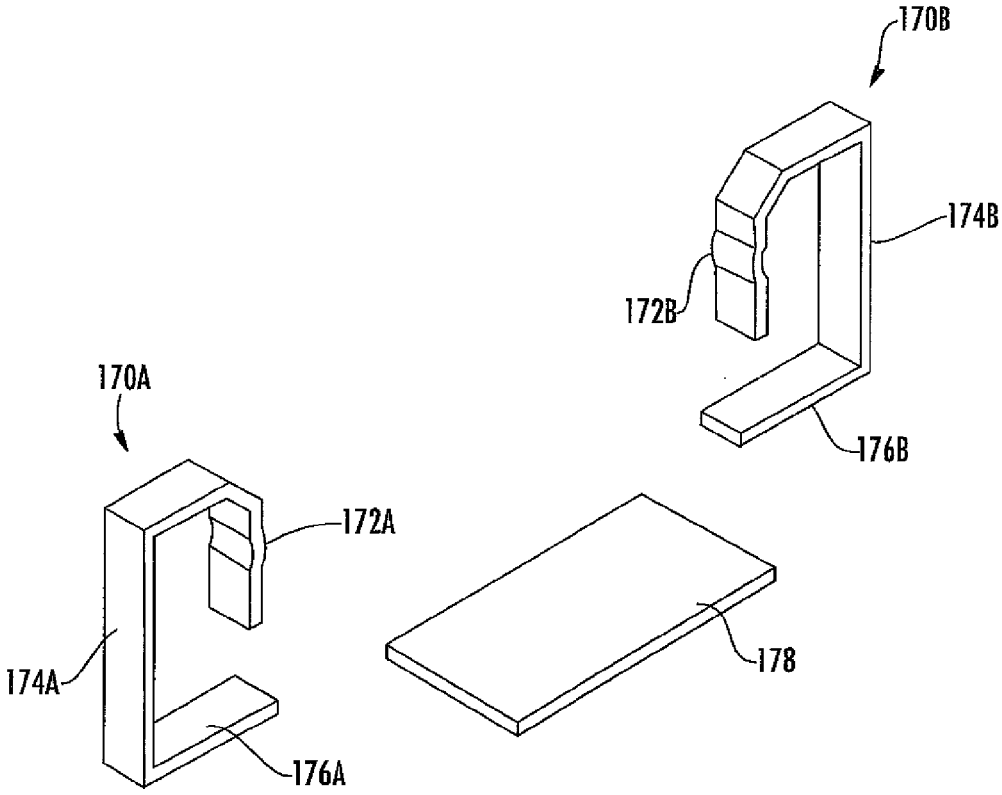
FIG. 11 is a process flow diagram illustrating a first exemplary embodiment of the method of manufacturing the FPC connector shown in FIG. 4.

Referring now to FIG. 11, one embodiment of the generalized method for manufacturing an LDS Flexible Printed Circuit (FPC) connector 1100 is illustrated.

A flexible circuit board is first constructed in step 1102. Flexible circuit board construction is well known to the arts, and generally comprises printing or etching copper traces between two or more flexible substrate layers.

At step 1104, an LDS polymer is selected and injection molded into an FPC plug. Selection criteria for LDS polymer, as aforementioned, may comprise any number of different design considerations including physical characteristics like strength, and resistance to heat. In one previously described exemplary embodiment, FIG. 4 illustrates the FPC plug construction of the FPC connector which comprises the plug 450 and a latching component 401. The plug is injection molded from the selected LDS polymer. The LDS polymer plug is lased with the laser beam, and subsequently metallized (identical to previously discussed steps 906, 1006).

At step 1106, a latching component is constructed. The latching component 401 is typically not composed of the same material as the LDS plug for economic reasons; the latch is simple and inexpensive to manufacture. In the exemplary construction embodied in FIG. 4, the latching component is stamped, and formed into the appropriate dimensions. If the latching component is manufactured from a conductive material, the material may be treated or impregnated, so as to prevent unintentional conducting paths.

The latching component is affixed to the FPC connector. In the exemplary embodiment 400, the latching component is anchored to the FPC connector via a pair of posts 454, which form a hinge. Furthermore, a locking mechanism 452 firmly "latches" the assembly together when engaged.

Steps 1108 and 1110 complete construction of the FPC connector. The FPC is sandwiched between the LDS connector plug, and the latching component. When the latching component engages the plug and locks into place, the contacts (i.e. the pads which were etched and metallized in the FPC), and the plug are held securely in place.

Figure 12:
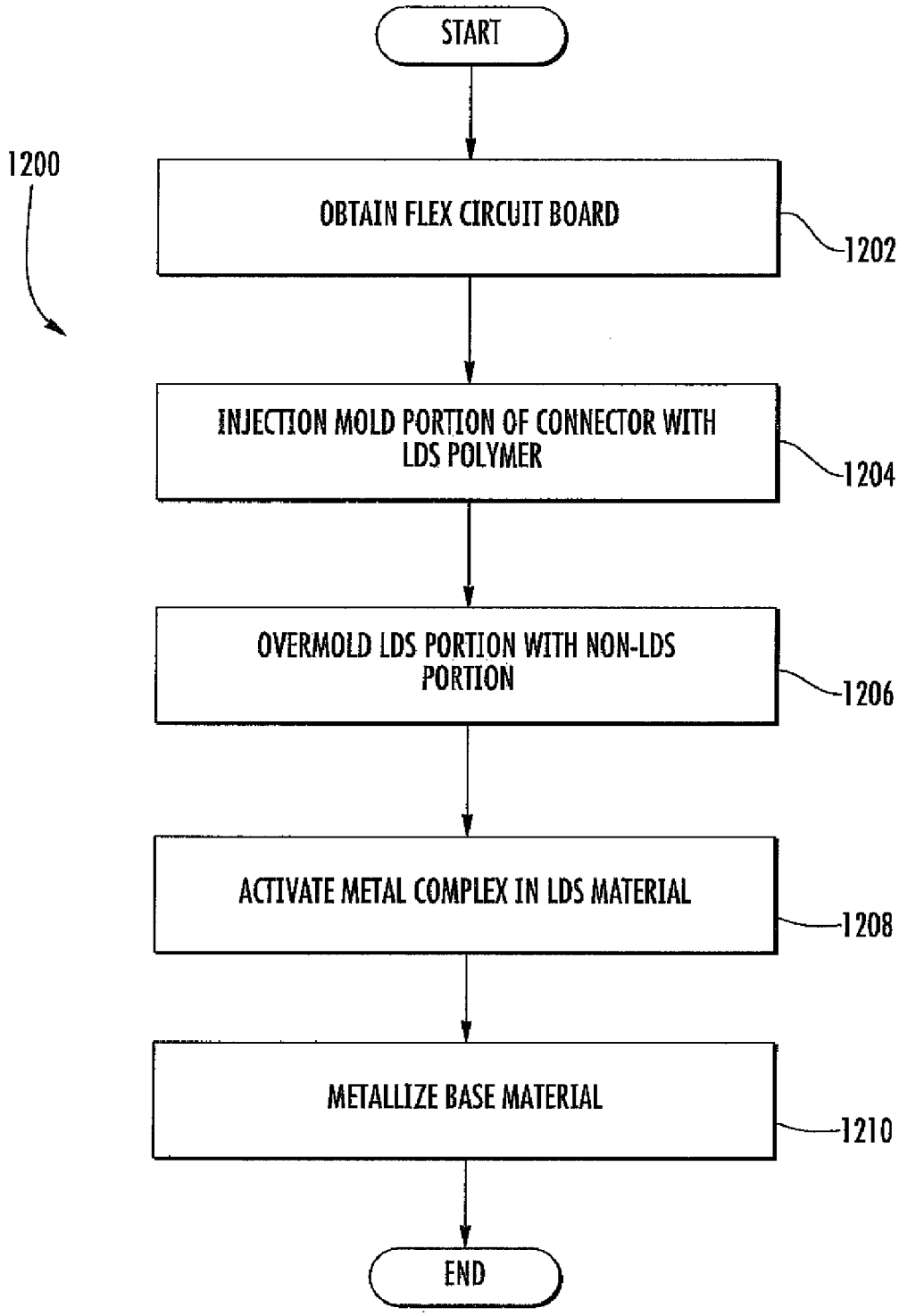
FIG. 12 is a process flow diagram illustrating a second exemplary embodiment of the method of manufacturing the FPC connector shown in FIG. 4.

Referring now to FIG. 12, one embodiment of the generalized method for manufacturing the composite LDS FPC connector 1200 is illustrated and described in detail.

At step 1202, a flexible circuit board is constructed; as in step 1102, flexible circuit board construction is well known to those of ordinary skill in the arts and not further described herein. The construction of the latching component is also performed as previously discussed.

In step 1204, a base sub-layer of the FPC connector plug, typically using injection molding techniques. In step 1206, the LDS layer of the FPC connector plug is over-molded onto the base sub-layer of the FPC connector plug. The over-mold layer consists of a more expensive LDS polymer compound, than the base sub-layer. In steps 1208 and 1210, the LDS layer is activated and metallized, using a focused laser beam and electro-less plating, as previously discussed.

Final construction of the composite LDS FPC connector plug is identical to the sandwiching mechanism of the FPC connector plug disclosed in system 400. Specifically, the FPC is sandwiched between the plug and the latching mechanism; the latching mechanism once engaged ensures reliable contact between the FPC connector plug and the corresponding FPC cable.

Figure 14:
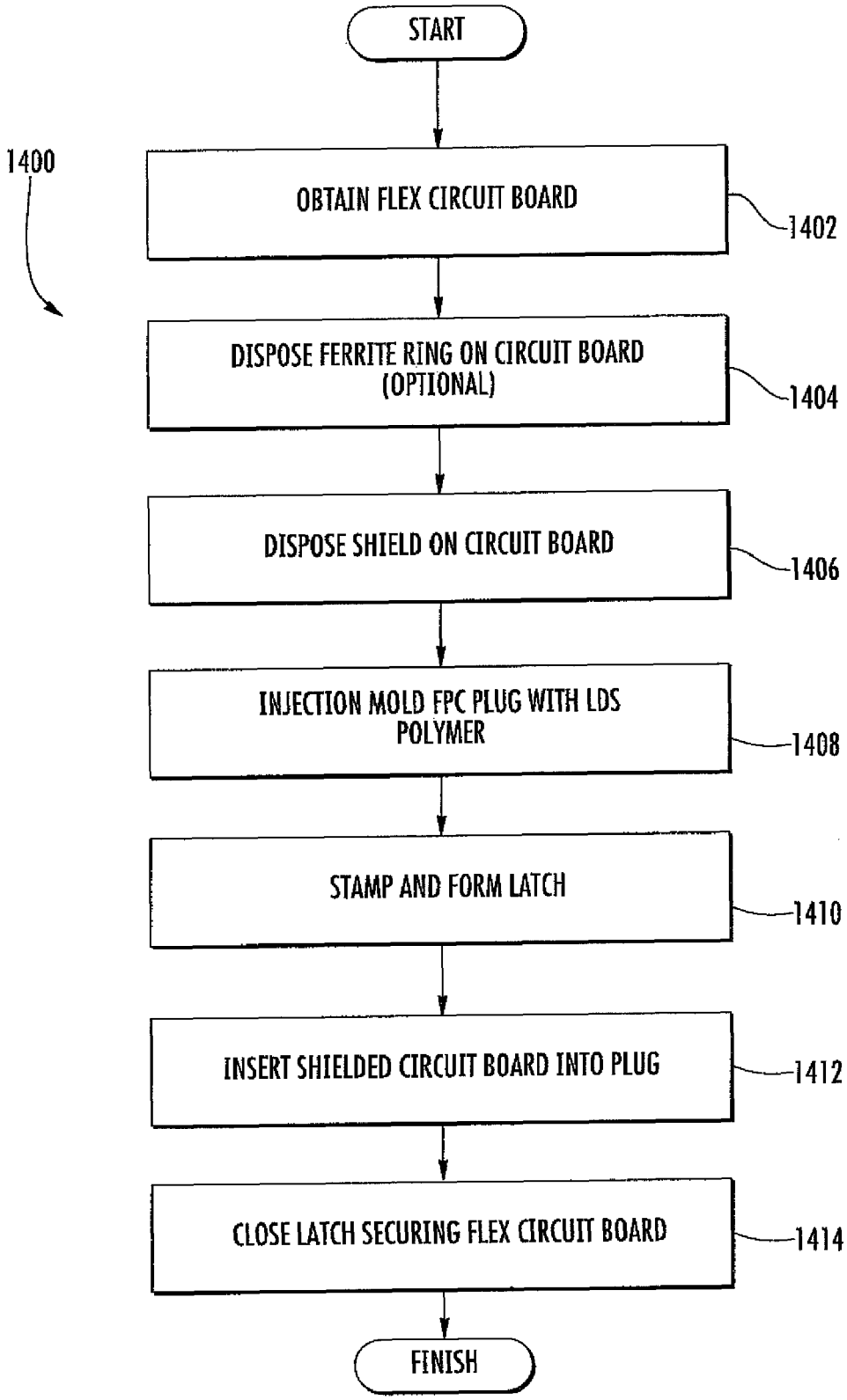
FIG. 14 is a process flow diagram illustrating a first exemplary embodiment of the method of manufacturing the FPC connector shown in FIG. 13.

Referring now to FIG. 14, one embodiment of the generalized method 1400 for manufacturing an FPC connector having one or more grounding features (such as that illustrated in FIGS. 13-13G) is shown and described in detail.

At step 1402, a flexible circuit board 1399 is obtained. The flexible circuit board 1399 is constructed using manufacturing techniques such as by printing or etching copper traces between two flexible substrate layers as is well known in the art.

Next, at step 1404, a ferrite ring 1392 is optionally disposed around at least a portion of the circuit board 1399.

At step 1406, an EMI shield 1398 is disposed about the circuit board 1399 and the optionally installed ferrite ring 1392.

At step 1408, an LDS polymer is selected and injection molded to form an FPC plug. As noted previously, different design considerations (including physical characteristics like strength, and resistance to heat) are preferably taken into account when selecting a suitable LDS polymer. As illustrated in the exemplary connector 1300 of FIG. 13, a grounding bar 1353 is preferably integrated into the plug 1350. The LDS polymer plug is activated and metallized using a similar process as previously discussed steps 906, 1006 of FIGS. 9 and 10, respectively.

At step 1410, the latching component 1301 is constructed. In an exemplary embodiment, the latch 1301 comprises a stamped and formed metallic base material such as a copper alloy and the like.

At step 1412, the shielded substrate 1390 is inserted into the FPC plug. Lastly, at step 1414, the latch 1301 is closed, thereby securing the shielded substrate 1390 into the FPC plug 1350 and completing the assembly 1300.

It will be recognized that while certain aspects of the invention are described in terms of a specific sequence of steps of a method, these descriptions are only illustrative of the broader methods of the invention, and may be modified as required by the particular application. Certain steps may be rendered unnecessary or optional under certain circumstances. Additionally, certain steps or functionality may be added to the disclosed embodiments, or the order of performance of two or more steps permuted. All such variations are encompassed within the invention disclosed and claimed herein.

While the above detailed description has shown, described, and pointed out novel features of the invention as applied to various embodiments, it will be understood that various omissions, substitutions, and changes in the form and details of the device or process illustrated may be made by those skilled in the art without departing from the invention. The foregoing description is of the best mode presently contemplated of carrying out the invention. This description is in no way meant to be limiting, but rather should be taken as illustrative of the general principles of the invention. The scope of the invention should be determined with reference to the claims.

What is claimed is:

1. A miniaturized connector, comprising:

a polymer plug connector comprising a plurality of electrical contact portions associated therewith, said plurality of electrical contact portions being disposed entirely onto a polymer associated with said polymer plug connector; and a latch element adapted for disposal onto said polymer plug connector, said latch element comprising a second material, said second material being different from said polymer;

wherein said polymer plug connector further comprises one or more protrusions, said one or more protrusions comprising a ridge element, said ridge element configured to extend outward from said polymer plug and disposed across said plurality of electrical contact portions, said ridge element in combination with said latch element configured to place a plurality of conductive pathways associated with a flexible printed circuit board in electrical communication with said plurality of electrical contact portions, said electrical communication facilitated by physical pressure generated by said ridge element in combination with said latch element; and wherein said polymer plug connector comprises one or more posts configured to facilitate attachment of said latch to said polymer plug.

2. The miniaturized connector of claim 1, wherein said polymer plug connector further comprises a cavity and a stop associated with said cavity, said cavity and said stop configured to cooperate to align and prevent over-insertion of said flexible printed circuit board into said polymer plug connector.

3. A miniaturized connector, comprising:

a polymer connector comprising a plurality of electrical contact portions associated therewith, said plurality of electrical contact portions being disposed directly onto a polymer portion of said polymer plug connector;

one or more protrusions disposed onto said polymer connector, said one or more protrusions comprising a ridge element, said ridge element configured to extend outward from said polymer plug and disposed across said plurality of electrical contact portions;

a flexible printed circuit configured to communicate electrically with said polymer connector on a first side; and a latch element configured to secure a flexible printed circuit to said polymer connector, said latch element configured to be in physical contact with a second side of said flexible printed circuit when closed, said second side of said flexible printed circuit not configured to be in electrical communication with said polymer connector;

wherein at least one or more of said plurality of electrical contact portions are disposed at least partly on said one or more protrusions; and wherein said at least one or more protrusions are configured to generate a bump in said flexible printed circuit, physical and electrical contacts between the first side of the flexible printed circuit and the contact portions of the polymer connector being facilitated by said bump.

4. The miniaturized connector of claim 3, wherein said polymer connector comprises a laser direct structure material.

5. The miniaturized connector of claim 4, wherein said plurality of electrical contact portions are disposed in a substantially parallel orientation and further comprise a predetermined pitch spacing between adjacent contact portions.

6. The miniaturized connector of claim 5, wherein said predetermined pitch spacing is approximately 0.3 mm (0.012 inches).

7. The miniaturized connector of claim 3, wherein said polymer connector and said latch element are comprised of two or more separate materials with one of said two or more separate materials comprised of a laser direct structure material.

8. The miniaturized connector of claim 7, wherein said plurality of electrical contact portions are disposed on said laser direct structure material.

9. The miniaturized connector of claim 3, wherein said polymer connector further comprises a cavity and a stop associated with said cavity, said cavity and said stop configured to cooperate to align and prevent over-insertion of a flexible printed circuit board into said polymer connector.

10. The miniaturized connector of claim 3, wherein said latch element is adapted to be removably coupled to said polymer connector.

11. The miniaturized connector of claim 10, wherein said latch element is further adapted to rotate with respect to said polymer connector, said rotation configured to cause said latch to alternate between being coupled and uncoupled to said polymer connector.

12. The miniaturized connector of claim 10, wherein said latch element further comprises a clearance feature, said clearance feature adapted to accommodate said one or more protrusions and said bump.

13. The miniaturized connector of claim 3, wherein said plurality of electrical contact portions are disposed on two opposing sides of said polymer connector.

14. The miniaturized connector of claim 13, wherein said plurality of electrical contact portions further comprise a transitional section which joins said portions on said two opposing sides of said polymer connector.

15. The miniaturized connector of claim 14, wherein said transitional section is substantially curved.

* * * * *